US012490878B2

(12) United States Patent
Zhang et al.

(10) Patent No.: US 12,490,878 B2
(45) Date of Patent: Dec. 9, 2025

(54) CLEANING DEVICE, CLEANING MECHANISM, SWEEPER AND CLEANING APPARATUS

(71) Applicant: Dreame Innovation Technology (Suzhou) Co., Ltd., Suzhou (CN)

(72) Inventors: Lei Zhang, Suzhou (CN); Xiaofeng Yin, Suzhou (CN); Yinghao Liu, Suzhou (CN); Chao Wang, Suzhou (CN)

(73) Assignee: Dreame Innovation Technology (Suzhou) Co., Ltd., Suzhou (CN)

( * ) Notice: Subject to any disclaimer, the term of this patent is extended or adjusted under 35 U.S.C. 154(b) by 0 days.

(21) Appl. No.: 18/750,856

(22) Filed: Jun. 21, 2024

(65) Prior Publication Data

US 2024/0341556 A1 Oct. 17, 2024

Related U.S. Application Data

(63) Continuation of application No. PCT/CN2022/101031, filed on Jun. 24, 2022.

(30) Foreign Application Priority Data

Sep. 6, 2021 (CN) ..... 202111038592.2
Sep. 6, 2021 (CN) ..... 202122136259.7
(Continued)

(51) Int. Cl.
*A47L 11/40* (2006.01)
*A47L 11/24* (2006.01)

(52) U.S. Cl.
CPC ..... *A47L 11/4058* (2013.01); *A47L 11/24* (2013.01); *A47L 11/4002* (2013.01); *A47L 11/4011* (2013.01)

(58) Field of Classification Search
CPC ..... A47L 11/4058; A47L 11/4052; A47L 11/4055; A47L 9/0494; A47L 5/34
See application file for complete search history.

(56) References Cited

U.S. PATENT DOCUMENTS 1,852,100 A * 4/1932 Ballou ..... A47L 5/34 15/354
3,460,184 A 8/1969 Dyer
(Continued)

FOREIGN PATENT DOCUMENTS

CN 205268043 U 6/2016
CN 108030447 A 5/2018
(Continued)

OTHER PUBLICATIONS

Notification to Grant Patent Right for Invention dated Aug. 11, 2023 for Chinese Application No. 202111672571.6.
(Continued)

*Primary Examiner* — Katina N. Henson
*Assistant Examiner* — Sharonda T Felton

(57) ABSTRACT

A cleaning device and a sweeper, the cleaning device includes a driving module, which includes a lifting driver; a lifting module, which includes a first shaft sleeve and a second shaft sleeve, the first shaft sleeve is connected with a power output shaft of the lifting driver, a screw mechanism is formed between the first shaft sleeve and the second shaft sleeve; and a cleaning module, which includes a cleaning member connected with the second shaft sleeve; the screw mechanism is at least is subjected to a first driving force of the power output shaft of the lifting driver to drive the cleaning member to perform a descending motion relative to the lifting driver, and is subjected to a second driving force to drive the cleaning member to perform an ascending motion relative to the lifting driver.

20 Claims, 28 Drawing Sheets

(30) Foreign Application Priority Data

| | | |
|---|---|---|
| Sep. 6, 2021 | (CN) | 202122136562.7 |
| Sep. 6, 2021 | (CN) | 202122138273.0 |
| Sep. 6, 2021 | (CN) | 202122138621.4 |
| Sep. 6, 2021 | (CN) | 202122138658.7 |
| Dec. 31, 2021 | (CN) | 202111672571.6 |

(56) References Cited

U.S. PATENT DOCUMENTS

| | | | | |
|---|---|---|---|---|
| 4,910,824 | A * | 3/1990 | Nagayama | A47L 11/4011 15/49.1 |
| 5,815,880 | A | 10/1998 | Nakanishi | |
| 2020/0139561 | A1* | 5/2020 | Kim | A47L 11/4036 |
| 2022/0047141 | A1* | 2/2022 | Xu | A47L 11/4055 |

FOREIGN PATENT DOCUMENTS

| | | | |
|---|---|---|---|
| CN | 208378373 | U | 1/2019 |
| CN | 208799170 | U | 4/2019 |
| CN | 209404660 | U | 9/2019 |
| CN | 110710932 | A | 1/2020 |
| CN | 111035315 | A | 4/2020 |
| CN | 211324768 | | 8/2020 |
| CN | 111714044 | A | 9/2020 |
| CN | 211633129 | U | 10/2020 |
| CN | 112493937 | A | 3/2021 |
| CN | 112869648 | A | 6/2021 |
| CN | 112914431 | A | 6/2021 |
| CN | 112998589 | A | 6/2021 |
| CN | 113057543 | A | 7/2021 |
| CN | 113116241 | A | 7/2021 |
| CN | 215838764 | U | 2/2022 |
| CN | 216090315 | U | 3/2022 |
| CN | 216090316 | U | 3/2022 |
| CN | 216147973 | U | 4/2022 |
| CN | 216535122 | U | 5/2022 |
| EP | 0807716 | A | 11/1997 |
| EP | 0910981 | A1 * | 4/1999 |
| WO | WO9638632 | A1 | 12/1996 |

OTHER PUBLICATIONS

Notification of Grant of Utility Model Patent Rights dated Jan. 11, 2022 for Chinese Application No. 202122136259.7.

Notification of Grant of Utility Model Patent Rights dated Jan. 26, 2022 for Chinese Application No. 202122138621.4.

Notification of Grant of Utility Model Patent Rights dated Mar. 28, 2022 for Chinese Application No. 202122138273.0.

Notification of Grant of Utility Model Patent Rights dated Jan. 17, 2022 for Chinese Application No. 202122136562.7.

The First Office Action dated Jun. 2, 2023 for Chinese Application No. 202111672571.6.

International Search Report dated Sep. 21, 2022 for International Application No. PCT/CN2022/101031.

Extended European Search Report dated Jan. 28, 2025 regarding Application No. 22862828.5.

* cited by examiner

CLEANING DEVICE, CLEANING MECHANISM, SWEEPER AND CLEANING APPARATUS

CROSS-REFERENCES TO RELATED APPLICATIONS

This application is a continuation of International Application No. PCT/CN2022/101031, filed on Jun. 24, 2022, which claims the priorities to the following patent applications: Chinese Patent Application No. 202111038592.2, filed with the China National Intellectual Property Administration on Sep. 6, 2021, and entitled "SWEEPER CLEANING DEVICE AND SWEEPER", Chinese Patent Application No. 202122138658.7, filed with the China National Intellectual Property Administration on Sep. 6, 2021, and entitled "SWEEPER CLEANING DEVICE AND SWEEPER"; Chinese Patent Application No. 202122136259.7, filed with the China National Intellectual Property Administration on Sep. 6, 2021, and entitled "CLEANING MECHANISM OF SWEEPER AND SWEEPER"; Chinese Patent Application No. 202122138621.4, filed with the China National Intellectual Property Administration on Sep. 6, 2021, and entitled "LIFTABLE SWEEPER CLEANING MECHANISM AND SWEEPER"; Chinese Patent Application No. 202122138273.0, filed with the China National Intellectual Property Administration on Sep. 6, 2021, and entitled "CLEANING MECHANISM OF SWEEPER AND SWEEPER"; Chinese Patent Application No. 202122136562.7, filed with the China National Intellectual Property Administration on Sep. 6, 2021, and entitled "CLEANING MECHANISM AND CLEANING APPARATUS WITH THE SAME"; and Chinese Patent Application No. 202111672571.6, filed with the China National Intellectual Property Administration on Dec. 31, 2021, and entitled "CLEANING DEVICE AND CLEANING APPARATUS"; and the entire contents of the above patent applications are incorporated by reference in this application.

TECHNICAL FIELD

The present application relates to the field of household appliances, and in particular, to a cleaning device, and also in particular to a cleaning apparatus.

BACKGROUND

In the field of household appliances, sweepers with different structure forms are used to clean dirt, meanwhile, based on different cleaning requirements, there are also different needs for cleaning devices such as sweepers or scrubbers. This solution provides a cleaning device for a sweeper and a cleaning apparatus for applying the cleaning device, so as to meet the cleaning requirements of users in different environments.

SUMMARY

In view of shortcomings of the prior art, in a first aspect, the purpose of the present application is to provide a cleaning device, including: a driving module including a lifting driver;

a lifting module, which includes a first shaft sleeve and a second shaft sleeve, the first shaft sleeve is connected with a power output shaft of the lifting driver, and the first shaft sleeve and the second shaft sleeve form a screw mechanism; and the second shaft sleeve is suitable for being connected with a cleaning member of a cleaning module; and the screw mechanism is at least subjected to a first driving force of the power output shaft of the lifting driver, so as to drive the cleaning member to perform a descending motion relative to the lifting driver, and is subjected to a second driving force, so as to drive the cleaning member to perform an ascending motion relative to the lifting driver.

In an implementation, the screw mechanism includes a thread groove and a rib which are mated with each other; and the first shaft sleeve includes the thread groove, and the second shaft sleeve includes the rib; or, the second shaft sleeve includes the thread groove, and the first shaft sleeve includes the rib; and where lead angles of the thread groove and the rib are smaller than a self-locking lead angle.

In an implementation, the thread groove is located in the second shaft sleeve, and the rib is located on the first shaft sleeve; and the lifting module further includes a shaft sleeve cover, the shaft sleeve cover is located at a top of the second shaft sleeve, a bottom end of the shaft sleeve cover is provided with a protruding first limit portion, and the first limit portion is located at an end of the thread groove.

In an implementation, the lifting module further includes a floating assembly; the floating assembly includes a floating shaft sleeve and a floating element, the floating element is at least one of a spring, a torsion spring, a shrapnel, an elastic ball, a pneumatic support and a hydraulic support;

the floating shaft sleeve is connected with the first shaft sleeve, and the floating shaft sleeve is connected with the power output shaft; or, the floating shaft sleeve is connected with the second shaft sleeve, and the floating shaft sleeve is connected with the cleaning member.

In an implementation, one end of the floating shaft sleeve is fixedly connected with the power output shaft, and the other end of the floating shaft sleeve is connected with the first shaft sleeve;

the first shaft sleeve includes a first embedded groove, and the floating shaft sleeve is disposed within the first embedded groove; the floating shaft sleeve includes at least one first limit protrusion, a sidewall of the first embedded groove includes at least one first limit groove, and the first limit protrusion is mated with the first limit groove; and a first floating cavity is formed between the floating shaft sleeve and the first shaft sleeve, and the floating element is located in the first floating cavity.

In an implementation, the second shaft sleeve is fixedly connected with the cleaning member, or the second shaft sleeve is integrally formed with the cleaning member.

In an implementation, an elastic element is arranged between the first shaft sleeve and the second shaft sleeve, and the elastic element is at least one of a tension spring, an elastic rope, a torsion spring and a shrapnel; and the elastic element provides the second driving force, In an implementation, one end of the floating shaft sleeve is fixedly connected with the second shaft sleeve, and the other end of the floating shaft sleeve is connected with the cleaning member;

the cleaning member includes a cleaning member fixing member, the floating shaft sleeve includes a second embedded groove, and the cleaning member fixing member is disposed within the second embedded groove; and the cleaning member fixing member includes at least one second limit protrusion, the floating shaft sleeve includes at least one second limit groove, and the second limit protrusion is mated with the second limit groove; and a second floating cavity is formed between the floating shaft sleeve and the cleaning member fixing member, and the floating element is located within the second floating cavity.

In an implementation, a cross section of the floating shaft sleeve perpendicular to an axial direction is in a polygonal shape, and the first embedded groove is in a polygonal shape mated with the floating shaft sleeve; or, the cross-section of the cleaning member fixing member perpendicular to the axis direction is in a polygonal shape, and the second embedded groove is in a polygonal shape mated with the cleaning member fixing member.

In an implementation, in the above cleaning device, the driving module further includes a housing, and the housing is sleeved outside the second shaft sleeve.

In an implementation, in the above cleaning device, the lifting module further includes a damping member, and the damping member is disposed between the second shaft sleeve and the housing.

In an implementation, the above cleaning device, at least one give-way hole is disposed on the housing, at least one deformation portion is disposed within the give-way hole, and the deformation portion has at least one protrusion protruding inward, and the housing is kept in interference abut with an outer wall surface of the second shaft sleeve through the protrusion; and the protrusion is used as the damping member.

In an implementation, in the above cleaning device, the deformation portion is in a wave type.

In an implementation, the above cleaning device further includes a sensor and a controller, the controller is electrically or wirelessly connected with the lifting driver and the sensor, respectively.

In an implementation, in the above cleaning device, the driving module further includes a housing, and the housing is sleeved outside an outer wall of the second shaft sleeve;

the sensor includes a light emitter and a light receiver which are oppositely disposed on the housing, and an optical path area is formed between the light emitter and the light receiver; and when the second shaft sleeve is driven by the lifting driver to reach a highest point of an ascending position, at least part of the second shaft sleeve is located in the optical path area to block light emitted by the light emitter.

In an implementation, in the above cleaning device, the driving module further includes a housing, and the housing is sleeved outside an outer wall of the second shaft sleeve;

the sensor includes a light emitter and a light receiver which are oppositely disposed on the housing, and an optical path area is formed between the light emitter and the light receiver; and a light blocking member, liftably disposed on the housing;

a biasing member, disposed on the housing, and applies a biasing force to the light blocking member to drive one end of the light blocking member to be located right below the optical path area; and when the second shaft sleeve is driven by the lifting driver to reach a highest point of an ascending position, a top of the second shaft sleeve pushes one end of the light blocking member to perform an ascending motion to extend into the optical path area to block light emitted by the light emitter.

In an implementation, in the above cleaning device, the light blocking member includes an installation portion and a light blocking portion and a convex column disposed side by side on a sidewall of the installation portion, one end of the biasing member is disposed on the housing, and the other end of the biasing member is disposed on the convex column; and the installation portion is pushed by the second shaft sleeve to drive the light blocking portion to extend into the optical path area.

In an implementation, in the above cleaning device, one end of the floating shaft sleeve is magnetically connected with the second shaft sleeve through a magnetic assembly, and the other end of the floating shaft sleeve is connected with a cleaning member fixing member for installing the cleaning member, a second floating cavity is formed between them, and the floating element is located within the second floating cavity.

In an implementation, in the above cleaning device, the magnetic assembly includes a second magnet and a third magnet disposed on the floating shaft sleeve and the second shaft sleeve, respectively, and polarities of ends of the second magnet and the third magnet facing each other are opposite; and the cleaning device further includes a hall sensor for detecting whether the floating shaft sleeve and the second shaft sleeve are installed in place.

In an implementation, in the above cleaning device, the second shaft sleeve is provided with a first groove area on a side facing the cleaning member fixing member, and an annular second groove area on a side facing away from the cleaning member fixing member; the thread groove or the rib is disposed in the second groove area, a top of the first shaft sleeve is connected with the power output shaft, and a bottom of the first shaft sleeve is embedded in the second groove area; and the third magnet is disposed on a groove bottom of the first groove area; at least one end of the second magnet extends into the first groove area and is magnetically fixed with the third magnet.

In an implementation, in the above cleaning device, the hall sensor is disposed on a top of the power output shaft, the power output shaft is made of a magnetic conductive material, and an end of the power output shaft is distributed close to the third magnet; or the hall sensor is disposed on the top of the power output shaft, and the power output shaft is made of the magnetic conductive material, and is used as the third magnet, the end of the power output shaft is distributed close to the second magnet.

In an implementation, in the above cleaning device, the second magnets is at least two, and correspondingly, the third magnets is at least two; and where a bottom edge of the floating shaft sleeve is provided with an outer edge protruding outwards, and the outer edge is distributed oppositely with a bottom of the second groove area; and at least one third magnet is disposed on the bottom of the second groove area, at least one second magnet is disposed on the outer edge, and the second magnet is magnetically connected with the third magnet.

In an implementation, in the above cleaning device, the floating shaft sleeve is connected with the first shaft sleeve, and the floating shaft sleeve is connected with the power output shaft through a magnetic attraction assembly.

In an implementation, in the above cleaning device, the magnetic attraction assembly includes a first magnet and a fourth magnet, the first magnet is disposed on the floating shaft sleeve, and the fourth magnet is disposed on the power output shaft; polarities of ends of the first magnet and the fourth magnet facing each other are opposite; and the cleaning device further includes a hall sensor for detecting whether the floating shaft sleeve and the power output shaft are installed in place.

In an implementation, in the above cleaning device, the power output shaft is made of a magnetic material, and the power output shaft is used as the fourth magnet; and the hall sensor is disposed above a top of the power output shaft.

The present application further proves a cleaning apparatus, including: a chassis; and a cleaning device as described above, the cleaning device is installed on the chassis.

Compared with the prior art, the present application has the beneficial effects that:

the present application provides a cleaning device and a sweeper, the driving module drives the cleaning member to ascend or descend in a vertical direction by using the lifting module, so as to prevent the cleaning member from polluting a carpet, which may effectively protect the carpet; meanwhile, prevent the cleaning member from causing secondary pollution to the cleaned floor after the sweeper finishes cleaning, and improve the cleaning effect of the sweeper.

In a second aspect, in the field of household appliances, sweepers with different structure forms are used to clean dirt, meanwhile, based on different cleaning requirements, there are different needs for sweeper cleaning devices of sweepers. The solution provides a sweeper cleaning device for a sweeper and a sweeper applying the sweeper cleaning device, so as to meet the cleaning requirements of users in different environments.

In order to solve the above problems, the present application provides a sweeper cleaning device including: a lifting assembly, which includes a first shaft sleeve, a second sleeve portion and an elastic element, where the first shaft sleeve is connected with a power output shaft of the lifting driver, the first shaft sleeve and the second shaft sleeve form a screw mechanism, and the elastic element is connected with the first shaft sleeve and the second sleeve portion respectively; and a cleaning assembly, which includes a cleaning member connected with the second sleeve portion; and the screw mechanism is subjected to a first driving force of the power output shaft of the lifting driver to drive the cleaning member to perform a descending motion relative to the lifting driver, and is subjected to a second driving force of the elastic element to drive the cleaning member to perform an ascending motion relative to the lifting driver.

In an implementation, the screw mechanism includes a thread groove and a rib mated with each other, and lead angles of the thread groove and the rib are smaller than a self-locking lead angle; and the second sleeve portion includes the thread groove, and the first shaft sleeve includes the rib; or, the first shaft sleeve includes the thread groove, and the second sleeve portion includes the rib.

In an implementation, the second sleeve portion includes the thread groove, and the first shaft sleeve includes the rib.

In an implementation, the lifting assembly further includes a shaft sleeve cover, the shaft sleeve cover is located at a top end of the second sleeve portion, and a bottom end of the shaft sleeve cover is provided with a protruding first limit portion, and the first limit portion is located at an end of the thread groove.

In an implementation, the lifting assembly further includes a floating shaft sleeve and a floating element;

one end of the floating shaft sleeve is fixedly connected with the power output shaft;

the first shaft sleeve includes a first embedded groove, and the other end of the floating shaft sleeve is disposed in the first embedded groove and connected with the first shaft sleeve; and a floating cavity is formed between the floating shaft sleeve and the first shaft sleeve, the floating element is disposed within the floating cavity, and the floating element is at least one of a spring, a torsion spring, a shrapnel, an elastic ball, a pneumatic support and a hydraulic support.

In an implementation, the floating shaft sleeve includes at least one limit protrusion, the first shaft sleeve includes at least one first limit groove, and the limit protrusion is mated with the first limit groove.

In an implementation, a cross section of the floating shaft sleeve perpendicular to an axial direction is in a polygonal shape, and the first embedded groove is in a polygonal shape mated with the floating shaft sleeve.

In an implementation, the driving assembly further includes a housing, and the lifting assembly further includes a damping member, and the damping member is located between the second sleeve portion and the housing; and the damping member is made of a flexible material.

In an implementation, the sweeper cleaning device further includes a sensor and a controller, the controller is electrically or wirelessly connected with the lifting driver and the sensor, respectively.

The present application also provides a sweeper, including a chassis; and a sweeper cleaning device as described above, the sweeper cleaning device is installed on the chassis.

Compared with the prior art, the present application has the beneficial effects that;

the sweeper cleaning device and the sweeper provided in the present application control the descending of the cleaning member by using the screw mechanism through the first driving force of the lifting driver, and control the ascending of the cleaning member by using the screw mechanism through the second driving force of the elastic element, so that the structure is simple, the cost is relative low, which may prevent the cleaning member from polluting the carpet, and protect the carpet effectively; meanwhile, when the sweeper stops operating, the cleaning member automatically elevates, which may prevent the cleaning member from causing secondary pollution to the cleaned floor after the sweeper is cleaned, and improve the cleaning effect of the sweeper.

In a third aspect, in the field of household appliances, sweepers with different structure forms are used to clean dirt, meanwhile, based on different cleaning requirements, there are different needs for sweeper cleaning devices. This solution provides a cleaning device for a sweeper and a sweeper applying the cleaning device, so as to meet the cleaning requirements of users in different environments.

In order to solve the above problems, the present application provides a cleaning mechanism of a sweeper, including: a rotary driving module, which includes a rotary driver;

a cleaning module, which includes a cleaning tray connected with a power output shaft of the rotary driver; and a lifting module, which includes an elevating driver and a lifting block, the lifting block is connected with the rotary driver, and a bolt lifting structure is formed between the lifting block and an output shaft of the elevating driver; and the lifting block is subjected to a first driving force of the output shaft of the elevating driver to drive the cleaning tray to perform an ascending motion.

In an implementation, the bolt lifting structure includes a bolt portion and the lifting block;

the bolt portion is connected with the output shaft of the elevating driver, and the bolt portion has a first inclined surface; and a first tapered groove is provided within the lifting block, the first tapered groove has a second inclined surface, and the first inclined surface is mated with the second inclined surface to realize an ascent and a descent of the lifting block.

In an implementation, the lifting block is connected with the case of the rotary driver, or the lifting block is connected with the power output shaft of the rotary driver.

In an implementation, the power output shaft of the rotary driver is at least one, and the lifting block is at least one;

the at least one lifting block is connected with the power output shaft of the at least one rotary driver in one-to-one correspondence; or, one lifting block is connected with the power output shaft of the at least one rotary driver through a connection rod structure.

In an implementation, the cleaning module further includes a sleeve portion, a floating shaft sleeve and a floating element;

the sleeve portion is fixedly connected with or integrally formed with the cleaning tray, and the sleeve portion includes a first embedded groove;

the floating shaft sleeve is disposed within the first embedded groove and connected with the sleeve portion, and one end of the floating shaft sleeve far from the sleeve portion is fixedly connected with the power output shaft; and a floating cavity is defined between the floating shaft sleeve and the sleeve portion, and the floating element is located in the first floating cavity.

In an implementation, the floating element is at least one of a spring, a torsion spring, a shrapnel, an elastic ball, a pneumatic support and a hydraulic support.

In an implementation, the floating shaft sleeve further includes at least one limit portion, and the sleeve portion further includes at least one limit groove, and the limit portion is mated with the limit groove in one-to-one correspondence.

In an implementation, a cross section of the floating shaft sleeve perpendicular to an axial direction is in a polygonal shape, and the first embedded groove is a polygonal groove mated with the floating shaft sleeve.

In an implementation, the cleaning mechanism of the sweeper further includes a sensor, and the sensor is connected with the elevating driver.

The present application also provides a sweeper including a cleaning mechanism of a sweeper as described above.

Compared with the prior art, the present application has the beneficial effects that:

in the cleaning mechanism of the sweeper and the sweeper provided in the present application, the first driving force of the output shaft of the elevating driver drives the cleaning tray to move in a vertical direction by using the lifting block, so that the structure is simple, the cost is relative low, which may prevent the cleaning member from polluting the carpet, and protect the carpet effectively; meanwhile, prevent the cleaning tray from causing secondary pollution to the cleaned floor after the sweeper finishes cleaning, and improve the cleaning effect of the sweeper.

In a fourth aspect, in the field of household appliances, sweepers with different structure forms are used to clean dirt, meanwhile, based on different cleaning requirements, there are different needs for sweeper cleaning devices. This solution provides a sweeper cleaning device for a sweeper and a sweeper applying the sweeper cleaning device, so as to meet the cleaning requirements of users in different environments.

Therefore, the present application provides a liftable sweeper cleaning mechanism, including:

a rotary driving module, which includes a rotary driver and a rotary driving shaft in transmission connection with a power output end of the rotary driver;

a cleaning tray, which is mated with the rotary driving shaft; and a lifting module, which includes an elevating driver mated with the rotary driving module; and where a lifting structure is formed between the elevating driver and the rotary driving module.

In an implementation, the lifting structure includes a rack and a gear mated with the rack; and the rack is connected with the rotary driving shaft, and the gear is connected with the power output end of the lifting driver.

In an implementation, the elevating driver is not less than one, the rotary driving shaft is at least one, and the rack is at least one;

the at least one rack is connected with the at least one rotary driving shaft in one-to-one correspondence; or, one rack is connected with the at least one rotary driving shaft through a first connection rod.

In an implementation, the rack is connected with the at least one rotary driving shaft through the first connection rod, and the rack is disposed in a central area of the first connection rod, and distances from the rack to each rotary driving shaft are equal.

In an implementation, the lifting structure includes a flexible rope and a power output shaft of the elevating driver, one end of the flexible rope is connected with the rotary driving shaft, and the other end of the flexible rope is connected with the power output shaft of the elevating driver.

In an implementation, the elevating driver is at least one, the rotary driving shaft is at least one, and the flexible rope is at least one;

the at least one flexible rope is connected with the at least one rotary driving shaft in one-to-one correspondence; or, one flexible rope is connected with the at least one rotary driving shaft through a second connection rod.

In an implementation, the flexible rope is connected with the at least one rotary driving shaft through the second connection rod, and a connection point between the flexible rope and the second connection rod is located in a central area of the second connection rod, and distances from the connection point to each rotary driving shaft are equal.

In an implementation, the liftable sweeper cleaning mechanism further includes a sensor, and the sensor is electrically connected with the elevating driver.

On the other hand, the present application provides a sweeper, including a liftable sweeper cleaning mechanism as described above.

Compared with the prior art, the present application has the beneficial effects that:

the present application provides a liftable sweeper cleaning mechanism and a sweeper, the elevating driver drives the rotary driving module to ascend and descend in a vertical direction through the lifting structure, thereby to realize the ascending and descending of the cleaning tray in the vertical direction, which may prevent the cleaning tray from polluting a carpet and effectively protect the carpet, and meanwhile, may prevent the cleaning tray from causing secondary pollution to the cleaned floor after the sweeper finishes cleaning, and improve the cleaning effect of the sweeper.

In a fifth aspect, in the field of household appliances, sweepers with different structure forms are used to clean dirt, meanwhile, based on different cleaning requirements, there are different needs for sweeper cleaning devices. This solution provides a cleaning mechanism of a sweeper and a sweeper applying the cleaning mechanism, so as to meet the cleaning requirements of users in different environments.

In order to solve the above problems, the present application provides a cleaning mechanism of a sweeper, including:

a rotary driving module, which includes a rotary driver and a rotary driving shaft connected with the rotary driver;

a cleaning tray, a top surface of which is arranged with a first sleeve portion; and a floating shaft sleeve, through which the rotary driving shaft is connected with the first sleeve portion.

In an implementation, a first embedded groove is provided within the first sleeve portion, and a cross section of the first embedded groove is in a polygonal shape; and a cross section of the floating shaft sleeve is in a polygonal shape, and a lower portion of the floating shaft sleeve is embedded in the first embedded groove.

In an implementation, a first floating cavity is formed between the floating shaft sleeve and the first embedded groove;

a floating element is disposed within the first floating cavity, and the floating element is at least one of a spring, a torsion spring, a shrapnel, an elastic ball, a pneumatic support and a hydraulic support.

In an implementation, a periphery of the floating shaft sleeve is arranged with a third limit portion, and a periphery of the first sleeve portion is provided with a first limit groove, and the third limit portion is adapted to the first limit groove.

In an implementation, a side end of the third limit portion is arranged with a guide surface.

In an implementation, the floating shaft sleeve is detachably connected with the rotary driving shaft.

In an implementation, a top of the floating shaft sleeve is provided with a third embedded groove, and a cross section of the third embedded groove is in a polygonal shape; and a cross section of the rotary driving shaft is in a polygonal shape, and a lower portion of the rotary driving shaft is detachably sleeved in the third embedded groove.

In an implementation, a fifth magnet is disposed within the third embedded groove.

On the other hand, the present application provides a sweeper including a cleaning mechanism of a sweeper as described above.

Compared with the prior art, the present application has the beneficial effects that:

the present application provides a cleaning mechanism of a sweeper and a sweeper, the rotary driving shaft is connected with the first sleeve portion through a floating shaft sleeve, so that the cleaning tray floats correspondingly with different terrain on the floor, the cleaning tray may be closely attached to the uneven floor, the sweeper may be adapted to different terrain, which further improve the cleaning effect, and also enhance the obstacle-crossing function of the cleaning tray.

In a sixth aspect, a cleaning apparatus, such as a mopping machine, is used for mopping and covering the surface to be cleaned. Its cleaning parts are the dishcloth tray and the dishcloth disposed on the dishcloth tray, but the dishcloth tray is usually disposed at a bottom of the machine body, which may not realize the lifting effect, during the process of returning to a cleaning station after finishing cleaning, the dishcloth always contacts the floor, which may cause secondary pollution to the floor. In addition, in the case of a carpet on the floor, the dishcloth may hinder the movement of the cleaning apparatus because of the large friction between the dishcloth and the carpet, and meanwhile may pollute the carpet, which is not conducive to the smooth cleaning operation of the cleaning apparatus.

Therefore, the present application provides a cleaning mechanism of a magnetic lifting dishcloth tray, and the lifting control of the dishcloth tray is more flexible.

The present application provides a cleaning mechanism suitable for a cleaning apparatus, including:

a cleaning head assembly, which includes a dishcloth tray and a connecting structure for floatably connecting the dishcloth tray with a machine body of the cleaning apparatus up and down, the connecting structure includes a biasing member for pushing against the dishcloth tray downwards;

an electromagnetic assembly, which is suitable for being disposed on the machine body, the electromagnetic assembly is capable of generating an electromagnetic field by being connected with a power supply; and where the cleaning head assembly also includes a magnetic attraction part, the magnetic attraction part is disposed on the dishcloth tray and disposed oppositely to the electromagnetic assembly, and under an action of the electromagnetic field, the magnetic attraction part drives the dishcloth tray to perform an ascending motion to an elevating position high away from a cleaning surface against an acting force of the biasing member.

In an embodiment, the electromagnetic assembly is approximately uniformly arranged around a central axis of the dishcloth tray, and the magnetic attraction part is uniformly distributed right below the electromagnetic assembly.

In an embodiment, the electromagnetic assembly is configured to be in an annular shape, the magnetic attraction part is an annular iron ring consistent with the annular shape of the electromagnetic assembly, and the electromagnetic assembly is coaxially disposed with the magnetic attraction part.

In an embodiment, a number of the electromagnetic assembly is multiple, the plurality of electromagnetic assemblies are approximately uniformly arranged around the central axis of the dishcloth tray, and the magnetic attraction parts and the electromagnetic assemblies are disposed in one-to-one correspondence in an up-and-down direction.

In an embodiment, the cleaning mechanism further includes a control unit the control unit includes a switch circuit for cutting off and connecting the electromagnetic assembly and the power supply to control a generation and extinction of the electromagnetic field.

In an embodiment, the magnetic attraction part is a permanent magnet, and the control unit further includes a reverse circuit for switching a current direction in the electromagnetic assembly to change a direction of the electromagnetic field to generate a magnetic field force pushing against the magnetic attraction part.

In an embodiment, the connecting structure includes a connecting member and a fixing seat floatingly sleeved outside the connecting member, the dishcloth tray is disposed on the fixing seat and located below the fixing seat, and an upper end of the biasing member abuts against the connecting member and a lower end abuts against the dishcloth tray.

In an embodiment, the connecting member includes an annular cavity with an opening at a lower end, and the biasing member is disposed within the annular cavity.

In an embodiment, the connecting member includes an installation shaft hole for inserting a driving shaft of the cleaning apparatus, and the connecting member is driven to rotate by the driving shaft to drive the dishcloth tray to rotate.

In an embodiment, a permanent magnet is fixedly disposed on the connecting member, and an iron block is fixedly disposed below the driving shaft, and the permanent magnet is located at a bottom of the installation shaft hole, and is right facing the iron block.

In an embodiment, an outer side surface of the connecting member and an inner wall surface of the fixing seat are provided with guide structures mated with each other, and the guide structures are used for limiting the fixing seat to slide along an axial direction of the connecting member.

The present application also provides a cleaning apparatus including a cleaning mechanism provided in any one of the above embodiments.

Compared with the prior art, the beneficial effects are that: in the cleaning mechanism and the cleaning apparatus provided in the present application, the cleaning mechanism controls the generation and extinction of the electromagnetic field by turning on and off the electromagnetic assembly, so as to generate magnetic attraction to the magnetic attraction part to realize the elevating of the dishcloth tray. When the electromagnetic assembly is powered off, and the electromagnetic field disappears, the dishcloth tray is pushed downward to the mopping position by the biasing member, so as to realize the lifting control of the dishcloth tray. The electromagnetic assembly is adopted to control the elevating of the dishcloth tray by electromagnetic attraction, so that the dishcloth tray may ascend or descend according to the actual demand, and the control is more flexible. The lifting control of the dishcloth tray can effectively avoid a problem of secondary pollution caused by a second mopping of the surface that has been mopped by the dishcloth, and the floor cleaning effect is better. When encountering a floor that is not conducive to mop, such as the floor covered with carpet, the lifting of the dishcloth may avoid the contact between the dishcloth and such floor and avoid the adverse impact of such floor on cleaning work. Moreover, the cleaning apparatus may be elevated to move to a specific position after the dishcloth is stained with dirt to perform the operation of replacing the dishcloth or cleaning the dishcloth.

The above description is only an overview of technical solutions of the present application. In order to clearly understand the technical means of the present application and implement it according to the content of the specification, it is described in detail with the embodiments of the present application and in combination with the drawings in the following. Specific implementations of the present application are given in detail by the following embodiments and their drawings.

BRIEF DESCRIPTION OF DRAWINGS

The drawings described here are intended to provide a further understanding of the present application and constitute a part of the present application. The exemplary embodiments and their explanations of the present application are used to explain the present application, and do not constitute an undue limitation of the present application. In the drawings.

DESCRIPTION OF REFERENCE NUMBERS

Figure 1:
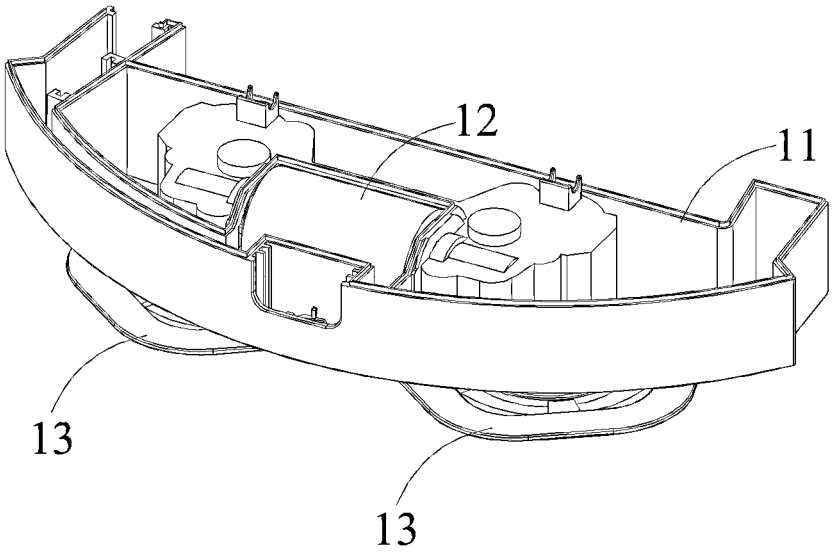
FIG. 1 is a perspective structural diagram of a sweeper cleaning device in a specific first embodiment of the present application.
Figure 2:
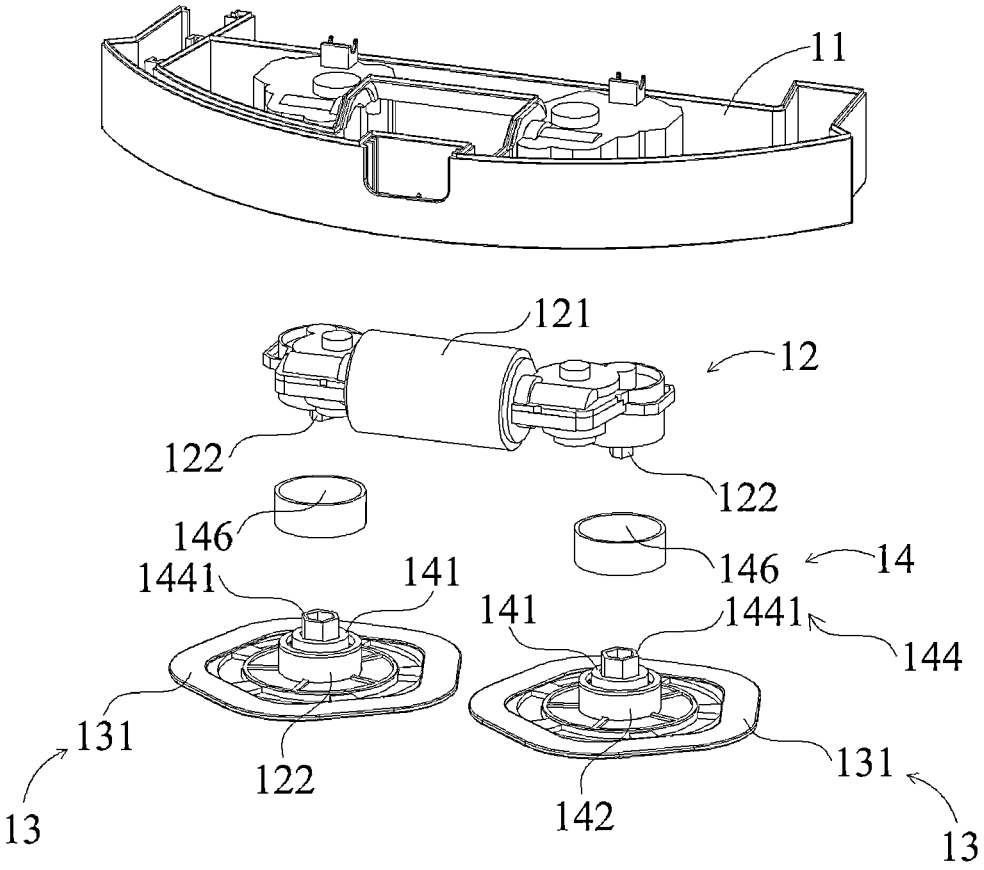
FIG. 2 is an exploded structural diagram of the sweeper cleaning device in the specific first embodiment of the present application.
Figure 3:
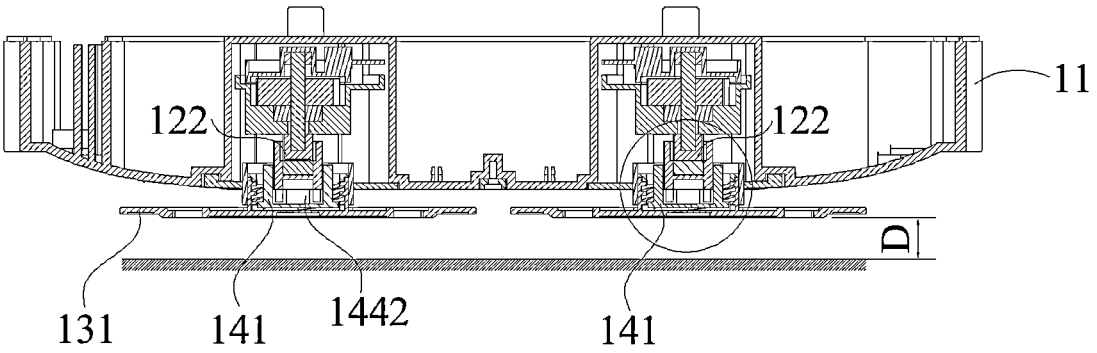
FIG. 3 is a cross-sectional view of the sweeper cleaning device in which a cleaning member is located at a highest position in the specific first embodiment of the present application.

11, chassis; 110, rotary driving module; 111, rotary driver; 112, rotary driving shaft; 113, case;

100, machine body; 1100, lower housing, 1200, lower housing bracket;

12, driving module or driving assembly;

121, lifting driver; 122, power output shaft; 123, housing; 1231, give-way hole; 1232, deformation portion; 1233-hanging ear;

13, cleaning module or cleaning assembly;

131, cleaning member or cleaning tray; 1311, cleaning member fixing member; 13111, second limit protrusion; 1312, a second connection portion;

130, lifting module; 1310, elevating driver; 1320, rack; 1330, gear; 1340, first connection rod; 1350, flexible rope; 1360, second connection rod; 1371, bolt portion; 13711, first inclined surface; 13200, lifting block; 1321, first tapered groove; 13211, second inclined surface; 13310, third connection rod; 1331, second tapered groove; 13311, third inclined surface;

140, sensor;

150, sensing piece;

14, lifting module or lifting assembly;

141, first shaft sleeve or first sleeve portion; 1411, rib; 14111, first limit surface; 14112, second limit surface; 1412, first embedded groove; 1413, first limit groove; 1414, first connection portion;

142, second shaft sleeve or second sleeve portion; 1421, thread groove; 1422, second limit portion; 1423, fourth embedded groove; 1424, sealing ring fixing groove; 1425-second groove area; 1426-extension portion; 1427-annular hole;

143, shaft sleeve cover; 1431, a first limit portion;

144, floating assembly; 1441, floating shaft sleeve; 14411, first limit protrusion or third limit portion; 144111, guide surface; 14412, second embedded groove; 14413, second limit groove; 14414, third embedded groove; 14415, fixing portion; 1442, first floating cavity; 1443, second floating cavity; 1444, first magnet; 1445, second magnet; 1446, outer edge; 1447, mating hole;

145, elastic element;

146, damping member;

147, sixth magnet; 1471, light emitter; 1472, light receiver;

148, light blocking member; 1481, installation portion; 1482, convex column; 1483, light blocking portion;

149, biasing member; 150, cover body; 151, third magnet;

17, fifth magnet;

3, dishcloth tray assembly; 31, upper dishcloth tray; 32, lower dishcloth tray; 36, connecting member; 30, fixing seat; 35, biasing member; 37, permanent magnet; 360, installation shaft hole; 33, magnetic attraction part; 362, outer sidewall; 363, shaft hole wall; 300, sleeve hole; 361, flange; 5, electromagnetic assembly; 6, driving device; 60, driving shaft; 61, iron; 62, shaft sleeve.

DESCRIPTION OF EMBODIMENTS

The foregoing and other objects, features, aspects and advantages of the present application will become more apparent in the following detailed description of the present application in combination with the drawings, so that those skilled in the art may embody it with reference to the specification. In the drawings, shapes and sizes may be exaggerated for the sake of clarity, and the same reference numerals will be used throughout the drawings to indicate the same or similar parts. In the following description, words such as center, thickness, height, length, front, back, rear, left, right, top, bottom, upper and lower are based on the orientation or positional relationship shown in the drawings. In particular, "height" is equivalent to a dimension from top to bottom, "width" is equivalent to a dimension from left to right, and "depth" is equivalent to a dimension from front to back. These relative terms are for convenience of description and are not generally intended to require a specific orientation. Terms relating to attaching, coupling, etc. (e.g., "connecting" and "attaching") refer to the relationship in which these structures are directly or indirectly fixed or attached to each other through an intermediate structure, as well as the movable or rigid attachment or relationship, unless explicitly stated otherwise.

Next, the present application is further described in combination with the drawings and specific embodiments. It should be noted that the following embodiments or technical features may be arbitrarily combined to form new embodiments without conflict. It should be understood that terms such as "having", "containing" and "including" used herein do not exclude the presence or addition of one or more other elements or a combination thereof.

In combination with FIG. 1 to FIG. 17, the present application relates to a cleaning device, including:

a driving module 12, which includes a lifting driver 121;

a lifting module 14, which includes a first shaft sleeve 141 and a second shaft sleeve 142, the first shaft sleeve 141 is connected with a power output shaft 122 of the lifting driver 121, and the first shaft sleeve 141 and the second shaft sleeve 142 form a screw mechanism; and a cleaning module 13, which includes a cleaning member 131, the cleaning member 131 is connected with the second shaft sleeve 142;

the screw mechanism is at least subjected to a first driving force of the power output shaft 122 of the lifting driver 121 to drive the cleaning member 131 to perform a descending motion relative to the lifting driver 121, and is subjected to a second driving force to drive the cleaning member 131 is driven to perform an ascending motion relative to the lifting driver 121.

In combination with FIG. 1 to FIG. 7 again, in a specific first embodiment of the present application:

the screw mechanism includes a thread groove 1421 and a rib 1411 which are mated with each other;

the first shaft sleeve 141 includes the thread groove 1421, and the second shaft sleeve 142 includes the rib 1411; or, the second shaft sleeve 142 includes the thread groove 1421, and the first shaft sleeve 141 includes the rib 1411;

lead angles of the thread groove 1421 and the rib 1411 is smaller than a self-locking lead angle.

Further, in an embodiment of the present application, the second shaft sleeve 142 includes the thread groove 1421 and the first shaft sleeve 141 includes the rib 1411.

In an embodiment of the present application, the rib 1411 is in a strip shape, and in another embodiment of the present application, the rib 1411 is in a threaded shape.

The specific setting of the shape of the rib 1411 may be selected by the workers according to the actual situation.

It may be understood that when the sweeper operates normally, the lifting driver 121 drives the power output shaft 122 to rotate in a forward direction, thereby drives the first shaft sleeve 141 to rotate in the forward direction, and further controls the rib 1411 on the first shaft sleeve 141 to rotate in the forward direction along the thread grooves 1421 on the second shaft sleeve 142, so that a relative displacement occurs between the first shaft sleeve 141 and the second shaft sleeve 142, the cleaning member 131 performs a descending motion relative to the lifting driver 121, and the cleaning member 131 is in contact with the floor for cleaning operation.

When the sweeper senses a carpet or when the sweeper finishes mopping the floor, the lifting driver 121 drives the power output shaft 122 to rotate in a reverse direction, further controls the rib 1411 on the first shaft sleeve 141 to rotate in the reverse direction along the thread groove 1421 on the second shaft sleeve 142, so that a relative displacement occurs between the first shaft sleeve 141 and the second shaft sleeve 142 again, and the cleaning member 131 performs an ascending motion relative to the lifting driver 121, disengages from the floor, thereby realizes an elevating operation of the cleaning member 131.

Meanwhile, the self-locking lead angle is determined according to the static friction factor between materials. In the present application, the lead angles of the thread groove 1421 and the rib 1411 are the same, and the lead angles of the thread groove 1421 and the rib 1411 are smaller than the self-locking lead angle determined based on the static friction factor, so as to prevent the cleaning member 131 from rotating and descending under the action of its own gravity when it ascends to a highest position, which may effectively limit and fix the cleaning member 131.

In an embodiment of the present application, the cleaning member 131 is located at a lowest position during normal operation, and at this time, a distance between the cleaning member 131 and the floor is H, and the distance H is 1 mm-3 mm. When the sweeper meets the carpet to avoid or finishes the work, the cleaning member 131 is located at the highest position, and the distance between the cleaning member 131 and the floor is D, the distance D is 5 mm-9 mm, and an elevating height of the cleaning member 131 is 4 mm-6 mm.

In an embodiment of the present application, the cleaning member 131 is located at the lowest position during normal operation, and a distance between the cleaning member 131 and the floor is H, and the distance H is 1.5 mm. When the sweeper meets the carpet to avoid or finishes the wok, the cleaning member 131 is located at the highest position, and the distance between the cleaning member 131 and the floor is D, the distance D is 6.5 mm, and an elevating height of the cleaning member 131 is 5 mm.

The workers may adjust the elevating height of the cleaning member 131 by selecting setting the thread groove 1421 with different number of turns according to the actual situation, so that the sweeper may be applicable to different scenes and has a certain universality.

There is a certain gap provided between each thread groove 1421 and a corresponding rib 1411, and lubricating grease is provided in each thread groove 1421, so that the second shaft sleeve 142 may rotate smoothly.

Further, the lifting module 14 further includes a shaft sleeve cover 143, the shaft sleeve cover 143 is located at a top of the second shaft sleeve 142, and there is a protruding first limit portion 1431 at a bottom of the shaft sleeve cover 143, and the first limit portion 1431 is located at an end of the thread groove 1421.

In an embodiment of the present application, the other end of the thread groove 1421 is provided with a second limit portion 1422;

one side end of the rib 1411 is provided with a first limit surface 14111, and the other side end of the rib 1411 is provided with a second limit surface 14112;

when the cleaning member 131 reaches the lowest position under the drive of the first driving force of the power output shaft 122 of the lifting driver 121, the cleaning member 131 is limited at the lowest position by the mating of the first limit portion 1441 and the first limit surface 14111; and when the cleaning member 131 reaches the highest position under the drive of the first driving force of the power output shaft 122 of the lifting driver 121, the cleaning member 131 is limited at the highest position by the mating of the second limit portion 1422 and the second limit surface 14112.

Further, the power output shaft 122 is fixedly connected with the first shaft sleeve 141; on the power output shaft 122 is in floating connection with the first shaft sleeve 141.

Specifically, in an embodiment of the present application, the power output shaft 122 is in floating connection with the first shaft sleeve 141.

Further, the lifting module 14 further includes a floating assembly 144; the floating assembly 144 includes a floating shaft sleeve 1441 and a floating element, and the floating element is at least one of a spring, a torsion spring, a shrapnel, an elastic ball, a pneumatic support and a hydraulic support;

The floating shaft sleeve 1441 is connected with the first shaft sleeve 141, and the floating shaft sleeve 1441 is connected with the power output shaft 122.

In an embodiment of the present application, the floating element is a spring, in another embodiment of the present application, the floating element is a torsion spring, and in yet another embodiment of the present application, the floating element is a shrapnel.

The specific setting of the floating element may be selected by the workers according to the actual situation.

Meanwhile, a pressure range of the floating element is 5 N-10 N, and a floating stroke of the cleaning member 131 may be specifically set according to the actual situation.

Further, one end of the floating shaft sleeve 1441 is fixedly connected with the power output shaft 122, and the other end of the floating shaft sleeve 1441 is connected with the first shaft sleeve 141; and the first shaft sleeve 141 includes a first embedded groove 1412, and the floating shaft sleeve 1441 is disposed within the first embedded groove 1412; the floating shaft sleeve 1441 includes at least one first limit protrusion 14411, a sidewall of the first embedded groove 1412 includes at least one first limit groove 1413, and the first limit protrusion 14411 is mated with the first limit groove 1413.

A first floating cavity 1442 is formed between the floating shaft sleeve 1441 and the first shaft sleeve 141, and the floating element is located within the first floating cavity 1442.

It may be understood that the floating shaft sleeve 1441 and the first shaft sleeve 141 are limited and fixed by the mating of the first limit protrusion 14411 and the first limit groove 1413.

In an embodiment of the present application, a side end of the first limit protrusion 14411 is provided with a guide surface 144111, the guide surface 144111 is a transitional structure of the first limit protrusion 14411. When the floating shaft sleeve 1441 is installed, the guide surface 144111 may guide the first limit protrusion 14411 to slide to the first limit groove 1413, so as to facilitate the shaft sleeve 1441 to be sleeved within the first embedded groove 1412.

By disposing the floating element between the first shaft sleeve 141 and the floating shaft sleeve 1441, the pressure between the cleaning member 131 and the floor is increased, and the cleaning effect of the cleaning member 131 is improved, and meanwhile, the cleaning member 131 floats correspondingly with different terrain on the floor, so that the dishcloth on the cleaning member 131 may be closely attached to the uneven floor, the sweeper may be adapted to different terrain, the cleaning effect is further improved, and an obstacle-crossing function of the cleaning member 131 is enhanced.

Further, a cross section of the floating shaft sleeve 1441 perpendicular to an axial direction is in a polygonal shape, and the first embedded groove 1412 is in a polygonal shape mated with the floating shaft sleeve; and in a specific embodiment of the present application, a cross section of the floating shaft sleeve 1441 perpendicular to the axial direction is in a quadrangular shape, and the first embedded groove 1412 is in a quadrangular shape mated with the floating shaft sleeve 1441; in another specific embodiment of the present application, the cross section of the floating shaft sleeve 1441 perpendicular to the axial direction is in a pentagonal shape, and the first embedded groove 1412 is in a pentagonal shape mated with the floating shaft sleeve 1441; and in yet another specific embodiment of the present application, the cross section of the floating shaft sleeve 1441 perpendicular to the axial direction is in a hexagonal shape, and the first embedded groove 1412 is a hexagonal shape mated with the floating shaft sleeve 1441.

The specific setting of the cross sections of the floating shaft sleeve 1441 and the first embedded groove 1412 perpendicular to the axis direction may be selected by the workers according to the actual situation.

It may be understood that the polygonal floating shaft sleeve 1441 and the first embedded groove 1412 are a limit structure, and the mating of the floating shaft sleeve 1441 and the first embedded groove 1412 is used to limit and fix a lower portion of the floating shaft sleeve 1441 with the first shaft sleeve 141 relative to each other, so that the lower portion of the floating shaft sleeve 1441 is firmly embedded with the first shaft sleeve 141.

Figure 4:
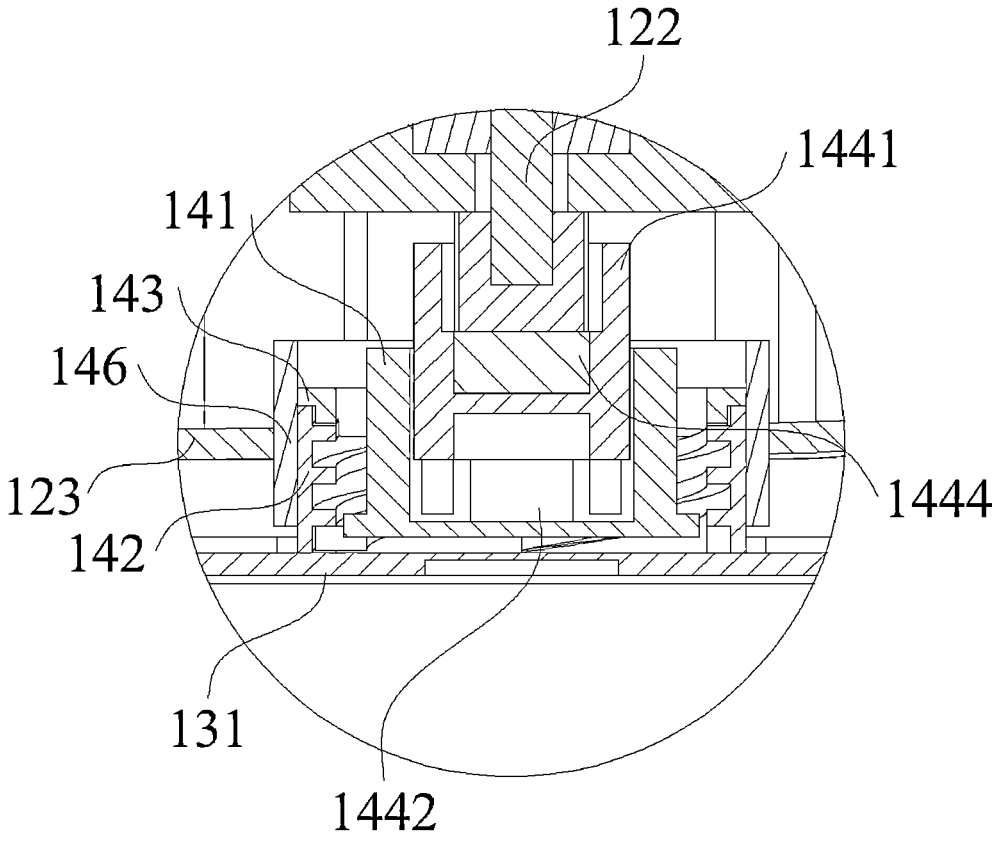
FIG. 4 is a partially enlarged view of FIG. 3.
Figure 5:
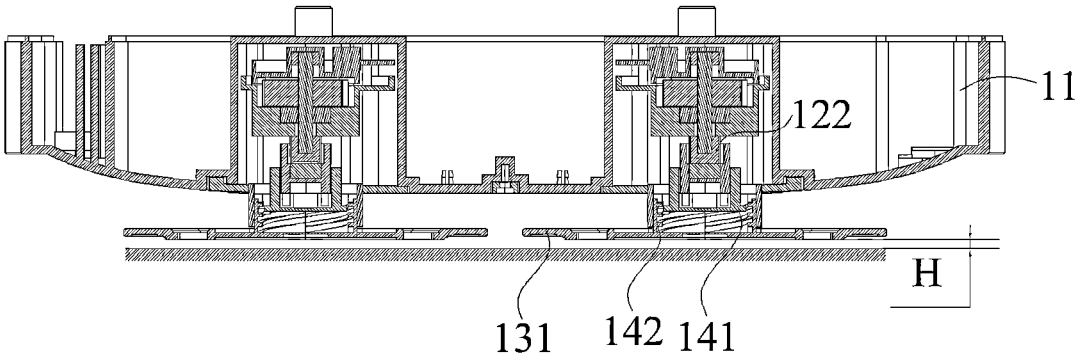
FIG. 5 is a cross-sectional view of the sweeper cleaning device in which the cleaning member is located at a lowest position in the specific first embodiment of the present application.
Figure 6:
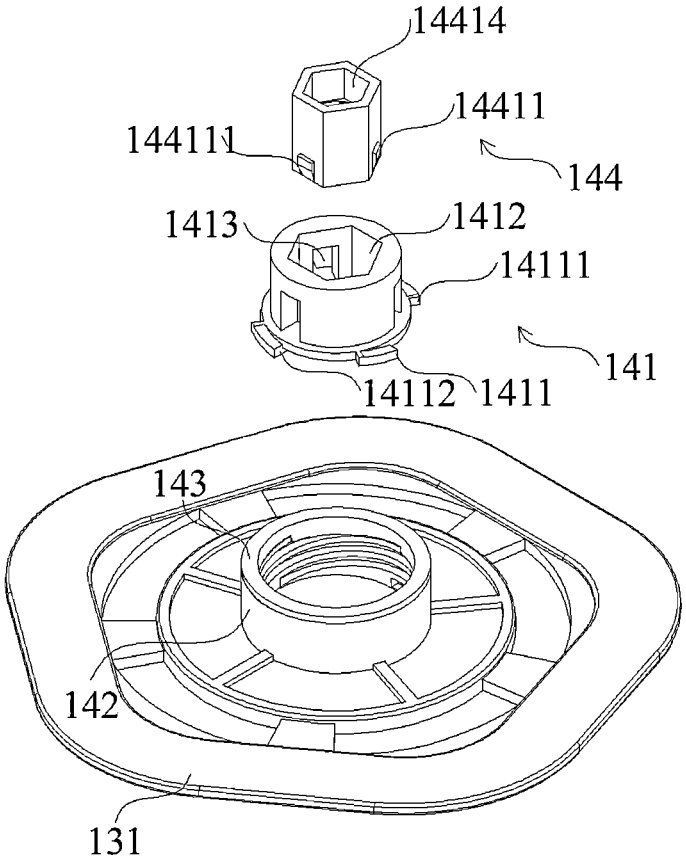
FIG. 6 is an exploded structural diagram of a lifting module and a cleaning module in the specific first embodiment of the present application.
Figure 7:
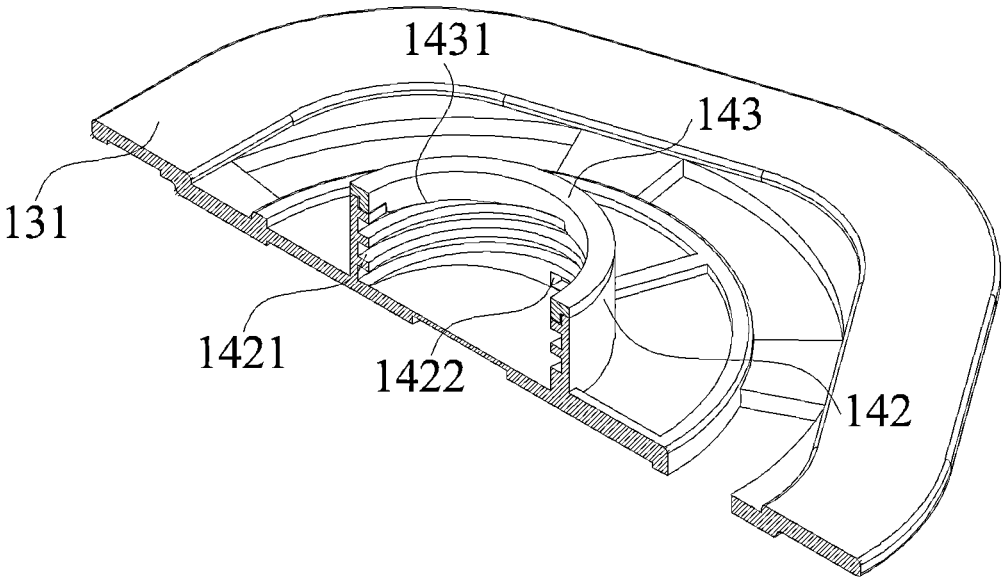
FIG. 7 is a cross-sectional view of the cleaning member in the specific first embodiment of the present application.

In an embodiment, as shown in FIG. 4, the floating shaft sleeve 1441 is connected with the first shaft sleeve 141, and the floating shaft sleeve 1441 is connected with the power output shaft 122 through a magnetic attraction assembly, and a floating cavity is formed between a bottom of the floating shaft sleeve 1441 and the first shaft sleeve 141 for the installation of the floating element. The magnetic attraction assembly includes a first magnet 1444 and a fourth magnet, the first magnet 1444 is disposed on the floating shaft sleeve 1441, and the fourth magnet is disposed on the power output shaft 122; polarities of ends of the first magnet 1444 and the fourth magnet facing each other are opposite; the cleaning device further includes a hall sensor (not shown in the drawings) fixedly disposed relative to one of the first magnet and the fourth magnet, and it is used to detect whether the floating shaft sleeve 1441 and the power output shaft 122 are installed in place.

During the installation, the second shaft sleeve 142, the first shaft sleeve 141, the floating shaft sleeve 1441, a cleaning member fixing member 1311 and the first magnet 1444 are pre-installed to form a cleaning member combination, and then the cleaning member combination is integrally installed on the power output shaft 122, that is, the first magnet 1444 and the fourth magnet are magnetically fixed, when the first magnet 1444 and the fourth magnet are magnetically attracted, the hall sensor detects a magnetic flux of a magnetic field loop formed after the magnetic attraction of the first magnet 1444 and the fourth magnet, and feeds it back to the controller, the controller compares this magnetic flux with a preset magnetic flux. If the detected magnetic flux reaches the preset magnetic flux, it indicates that the cleaning member combination and the power output shaft 122 are installed in place. If the detected magnetic flux does not reach the preset magnetic flux, it indicates that the cleaning member combination and the power output shaft. 122 are not installed in place. That is, it is used for detecting whether the cleaning member combination is installed in place with the power output shaft 122.

Further, the power output shaft 122 is made of magnetic material, and the power output shaft 144 is used as the fourth magnet; the hall sensor is disposed above a top of the power output shaft. In an implementation, the hall sensor is disposed right above the top of the power output shaft 122 to improve the detection accuracy.

In an implementation, the floating shaft sleeve 1441 is provided with a give-way hole, so that the magnetic attraction of the first magnet and the fourth magnet or the power output shaft is firmer.

Figure 10:
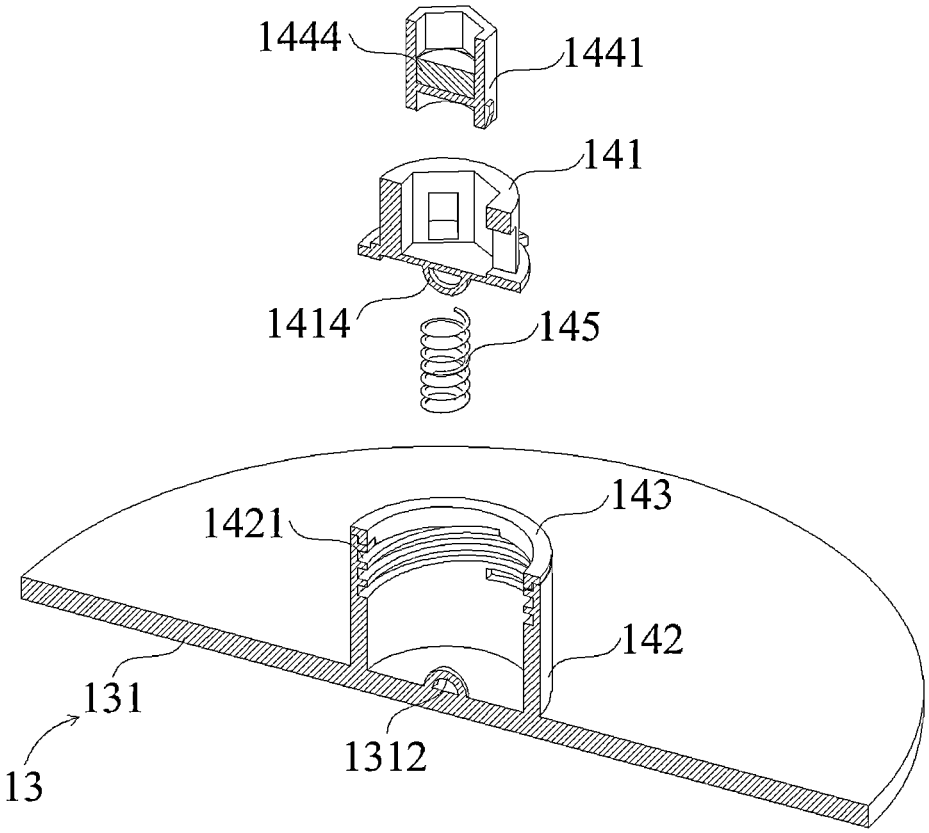
FIG. 10 is a cross-sectional view of a cleaning member and a shaft sleeve cover in the specific second embodiment of the present invention.
Figure 11:
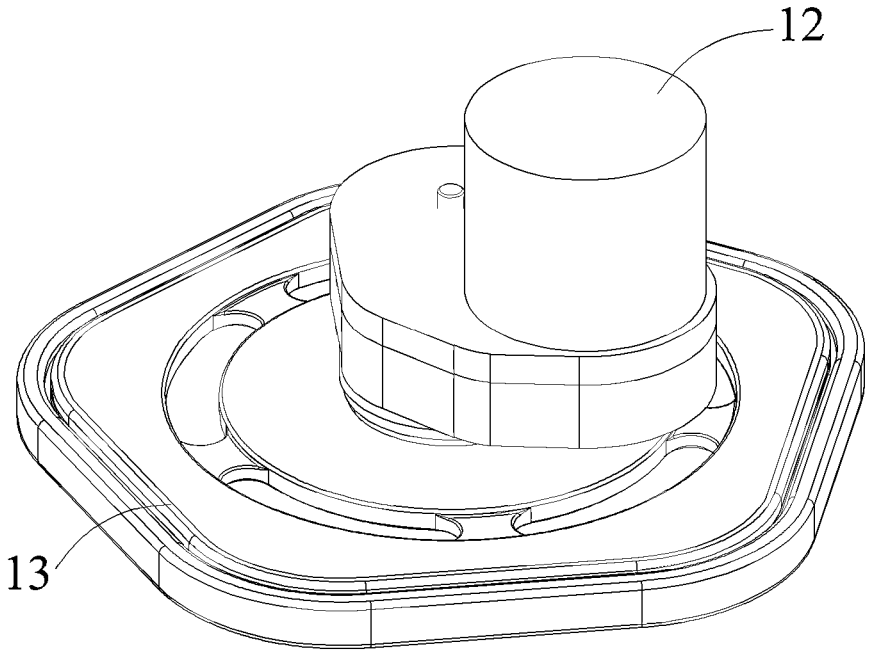
FIG. 11 is a perspective structural diagram of a sweeper cleaning device in a specific third embodiment of the present invention.
Figure 12:
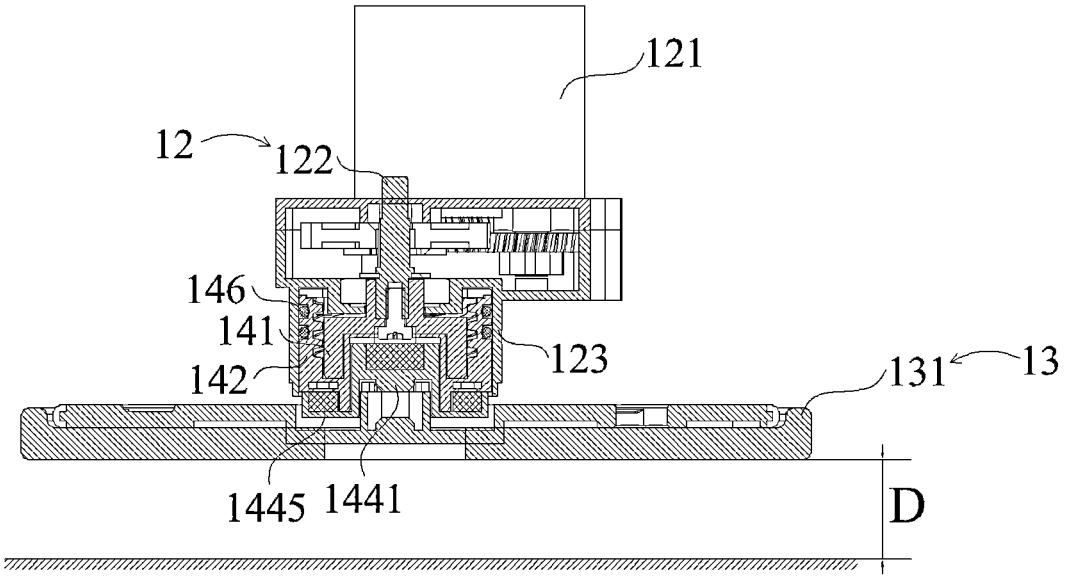
FIG. 12 is a cross-sectional view of the sweeper cleaning device in which a cleaning member is located at a highest position in the specific third embodiment of the present invention.
Figure 13:
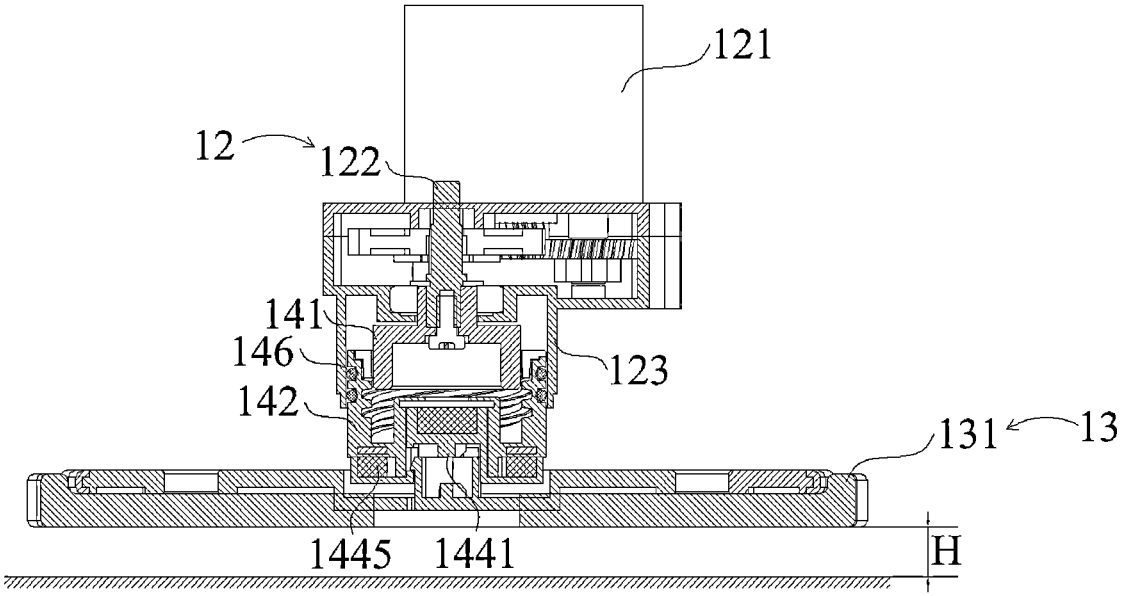
FIG. 13 is a cross-sectional view of the sweeper cleaning device in which the cleaning member is located at a lowest position in the specific third embodiment of the present application.
Figure 14:
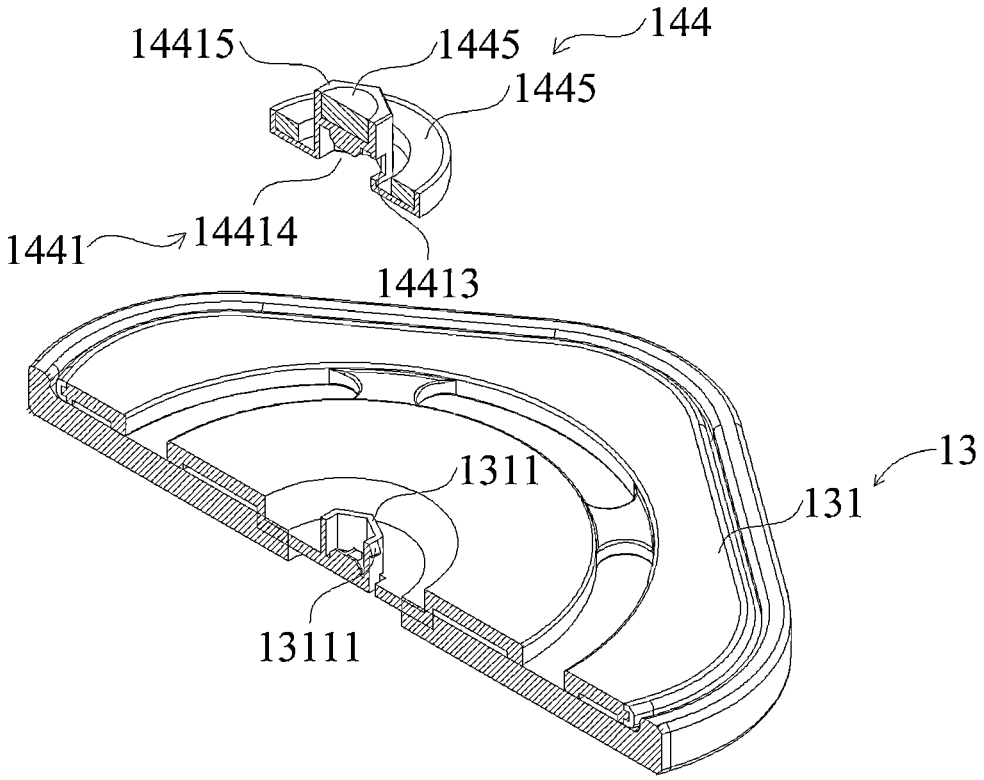
FIG. 14 is a cross-sectional view of the floating shaft sleeve and the cleaning member in the specific third embodiment of the present application.
Figure 15:
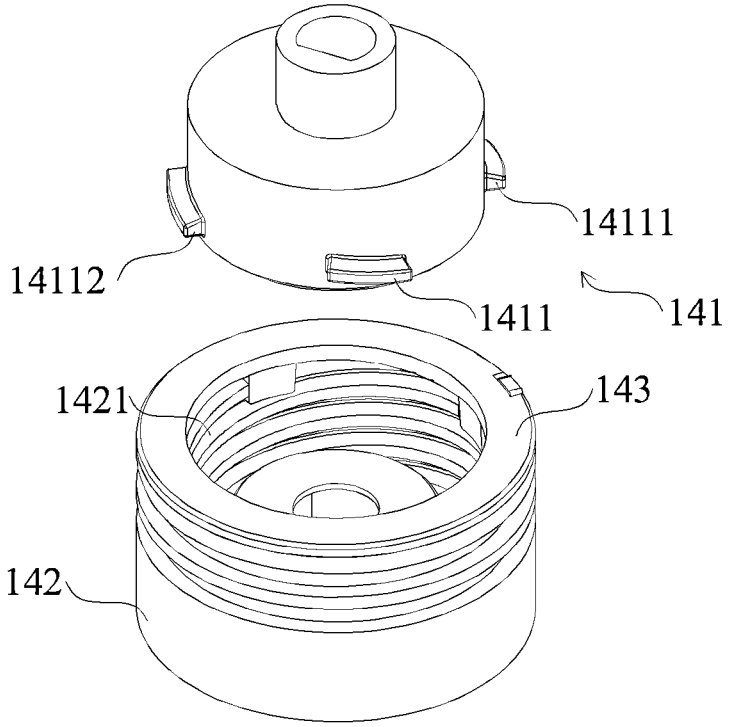
FIG. 15 is an exploded structural view of a first shaft sleeve and a second shaft sleeve in the specific third embodiment of the present application.
Figure 16:
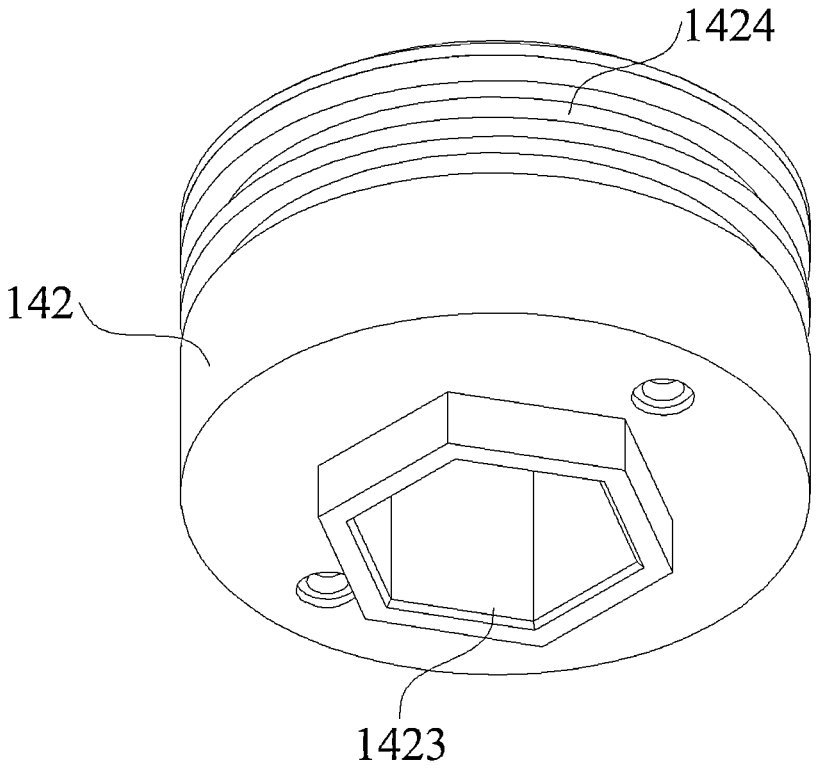
FIG. 16 is a perspective structural diagram of the second shaft sleeve in the specific third embodiment of the present application.
Figure 17:
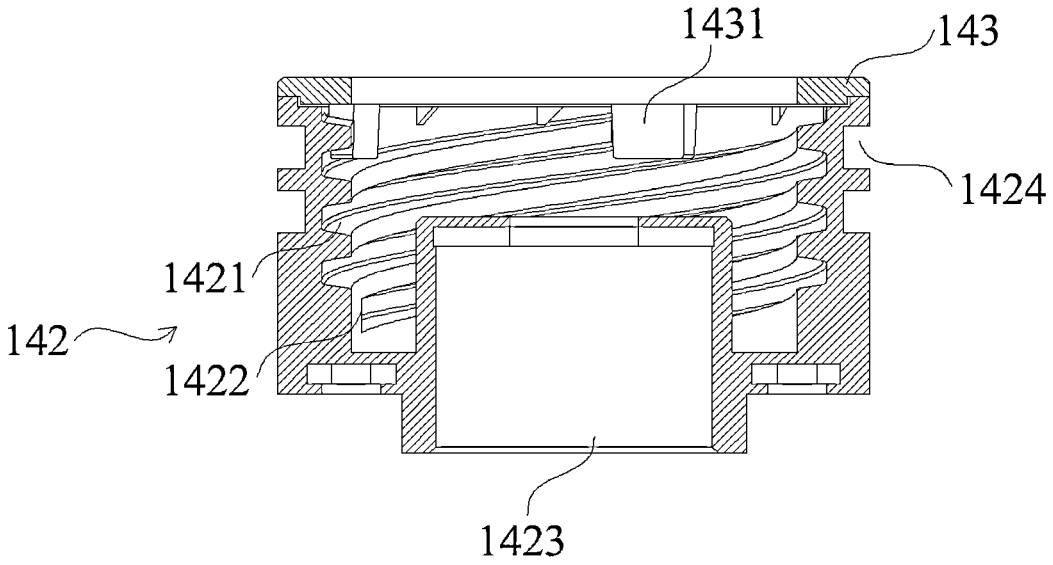
FIG. 17 is a cross-sectional view of the second shaft sleeve in the specific third embodiment of the present application.

As a deformation, as shown in FIG. 10, above second shaft sleeve 142 may be integrally formed on the cleaning member fixing member 1311, which further facilitates the pre-installation of the cleaning member combination. Or, as shown in FIG. 4, the second shaft sleeve 142 is detachably connected with the cleaning member fixing member 1311, for example, by snap or screw connection.

In an embodiment of the present application, the floating shaft sleeve 1441 further includes a third embedded groove 14414, and the other end of the power output shaft 122 is disposed in the third embedded groove 14414 and connected with the floating shaft sleeve 1441.

Specifically, the power output shaft 122 is connected with the third embedded groove 14414 in a snap manner, or the power output shaft 122 is magnetically connected with the third embedded groove 14414 through the first magnet 1444.

In an embodiment of the present application, the power output shaft 122 is magnetically connected with the third embedded groove 14414 through the first magnet 1444.

The first magnet 1444 may be arranged at a bottom of the third embedded groove 14414, or the first magnet 1444 is arranged at a circumferential area inside the third embedded groove 14414.

The specific setting of a position of the first magnet 1444 may be selected by the workers according to the actual situation.

A cross section of the power output shaft 122 perpendicular to an axial direction is in a polygonal shape, and the third embedded groove 14414 is in a polygonal shape mated with the power output shaft 122.

In a specific embodiment of the present application, the cross section of the power output shaft 122 perpendicular to the axial direction is in a quadrangular shape, and the third embedded groove 14414 is in a quadrangular shape mated with the power output shaft 122. In another specific embodiment of the present application, the cross section of the power output shaft 122 perpendicular to the axial direction is in a pentagonal shape, and the third embedded groove 14414 is in a pentagonal shape mated with the power output shaft 122; in yet another specific embodiment of the present application, the cross section of the power output shaft 122 perpendicular to the axial direction is in a hexagonal shape, and the third embedded groove 14414 is in a hexagonal shape mated with the power output shaft 122.

The specific setting of the cross sections of the power output shaft 122 and the third embedded groove 14414 perpendicular to the axis direction may be selected by the workers according to the actual situation.

It may be understood that a polygonal third embedded groove 14414 and the power output shaft 122 are a limit structure, and the mating of the third embedded groove 14414 and the power output shaft 122 is used to preliminarily limit and fix the power output shaft 122 of the lifting driver 121 and the floating shaft sleeve 1441; meanwhile, the first magnet 1444 is disposed inside the third embedded groove 14414, and the power output shaft 122 and the floating shaft sleeve 1441 are further limited and fixed by the first magnet 1444, so that the power output shaft 122 and the floating shaft sleeve 1441 are firmly embedded, and it is convenient to easily detach and separate the power output shaft 122 and the floating shaft sleeve 1441, and it is finally convenient to detach the cleaning member 131.

Further, the worker controls different initial positions of the cleaning member 131 by controlling different assembly directions of the power output shaft 122 and the floating shaft sleeve 1441, and the floating shaft sleeve 1441 and the first shaft sleeve 141.

Further, a rotation speed of the power output shaft 122 of the lifting driver 121 is different, and the magnetic force of the first magnet 1444 is different.

When the rotation speed of the power output shaft 122 of the lifting driver 121 is relatively high, the first magnet 1444 with a relatively large magnetic force may be selected; and when the rotation speed of the power output shaft 122 of the lifting driver 121 is relatively low, the first magnet 1444 with a relatively small magnetic force may be selected. According to the rotation speed of the power output shaft 122 of the lifting driver 121, the first magnet 1444 with a specific magnetic force is selected to ensure that the floating shaft sleeve 1441 is stably connected with the power output shaft 122 of the lifting driver 121.

Further, the second shaft sleeve 142 is fixedly connected with the cleaning member 131, or the second shaft sleeve 142 is integrally formed with the cleaning member 131.

The specific setting of a connection manner between the second shaft sleeve 142 and the cleaning member 131 may be selected by the workers according to the actual situation.

Further, the lifting module 14 further includes a damping member 146, and the driving module further includes a housing 123, and the damping member 146 is disposed between the second shaft sleeve 142 and the housing 123.

In an embodiment of the present application, the damping member 146 is made of a flexible material.

It may be understood that in the present application, the damping member 146 is disposed between the second shaft sleeve 142 and the housing 123 to avoid the friction between the second shaft sleeve 142 and the housing 123, and prolong a service life of the second shaft sleeve 142; meanwhile, the damping member 146 is made of a flexible material, which results in a friction between the damping member 146 and the housing 123, plays a hindering role of hindering the second shaft sleeve 142 from reaching the same rotation speed as the first shaft sleeve 141, extends the time for the second shaft sleeve 142 to reach the same rotation speed as the first shaft sleeve 141, so that no matter how the rotation speed of the power output shaft 122 of the lifting driver 121 is set, as long as the power output shaft 122 rotates normally, it may rotate relative to the second shaft sleeve 142, and the cleaning member 131 may ascend or descend under the action of a screw mechanism.

Further, the cleaning device further includes a sensor and a controller, and the controller is electrically or wirelessly connected with the lifting driver 121 and the sensor respectively.

It may be understood that the sensor is used to inductively identify the carpet. When the sensor senses the existence of the carpet, the sensor sends a feedback signal to the controller, after receiving the feedback signal, the controller sends a control instruction to the lifting driver 12 according to a feedback result, the first driving force of the power output shaft 122 of the lifting driver 121 drives the cleaning member 131 to perform the ascending motion relative to the lifting driver 121, so as to realize the elevating function of the cleaning member 131, and perform avoidance operations on the carpet.

To sum up, before the sweeper starts operating, the cleaning member 131 is located at the highest position. When the sweeper starts operating, the controller sends a control instruction to the lifting driver 121 to control the power output shaft 122 of the lifting driver 121 to start rotating in a forward direction, thereby drives the first shaft sleeve 141 to rotate in a forward direction, and further controls the rib 1411 on the first shaft sleeve 141 to rotate reversely along the thread groove 1421 of the second shaft sleeve 142, and meanwhile, under the action of the damping member 146, a relative displacement occurs between the first shaft sleeve 141 and the second shaft sleeve 142, and the cleaning member 131 performs a descending motion relative to the lifting driver 121, and the cleaning member 131 contacts the floor for cleaning operation; and when the sensor senses the existence of the carpet, the sensor sends a feedback signal which sensed the carpet to the controller, and the controller sends a control instruction to the lifting driver 121 according to the feedback result after receiving the feedback signal, so as to control the power output shaft 122 of the lifting driver 121 to start to rotate reversely, further control the rib 1411 on the first shaft sleeve 141 to rotate reversely along the thread groove 1421 on the second shaft sleeve 142, and meanwhile, under the action of the damping member 146, a relative displacement occurs between the first shaft sleeve 141 and the second shaft sleeve 142 again, and the cleaning member 131 performs an ascending motion relative to the lifting driver 121 and disengage from the floor, thereby realizes the elevating operation of the cleaning member 131 to perform avoidance operations on the carpet; and when the sweeper finishes operating, the controller sends a control instruction to the lifting driver 121 to control the power output shaft 122 of the lifting driver 121 to start rotate reversely, thereby drives the first shaft sleeve 141 to rotate reversely, and further controlling the rib 1411 on the first shaft sleeve 141 to rotate reversely along the thread groove 1421 of the second shaft sleeve 142, meanwhile, under the action of the damping member 146, a relative displacement occurs between the first shaft sleeve 141 and the second shaft sleeve 142 again, and the cleaning member 131 performs an ascending motion relative to the lifting driver 121 and disengages from the floor, thereby realizing the elevating operation of the cleaning member 131, and preventing the cleaning member 131 from causing secondary pollution to the cleaned floor.

Figure 8:
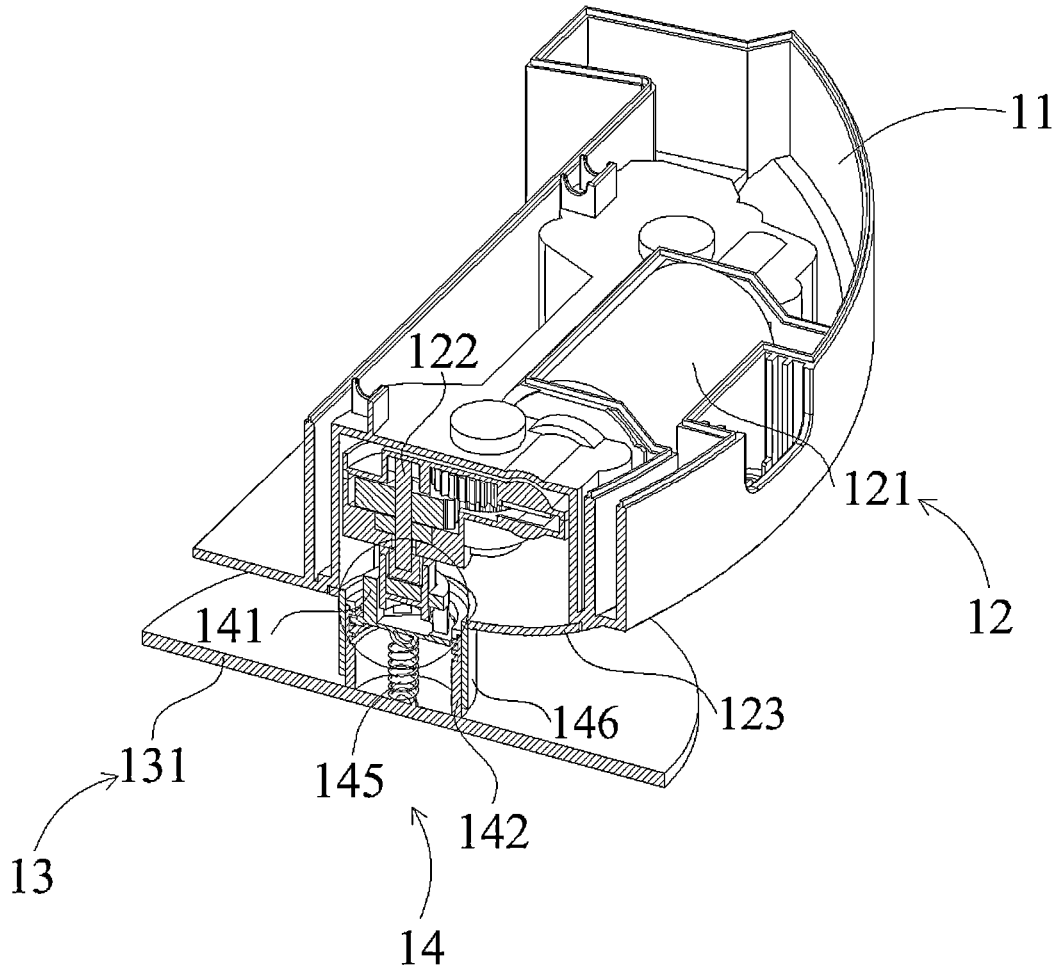
FIG. 8 is a perspective structural diagram of a sweeper cleaning device in a specific second embodiment of the present application.
Figure 9:
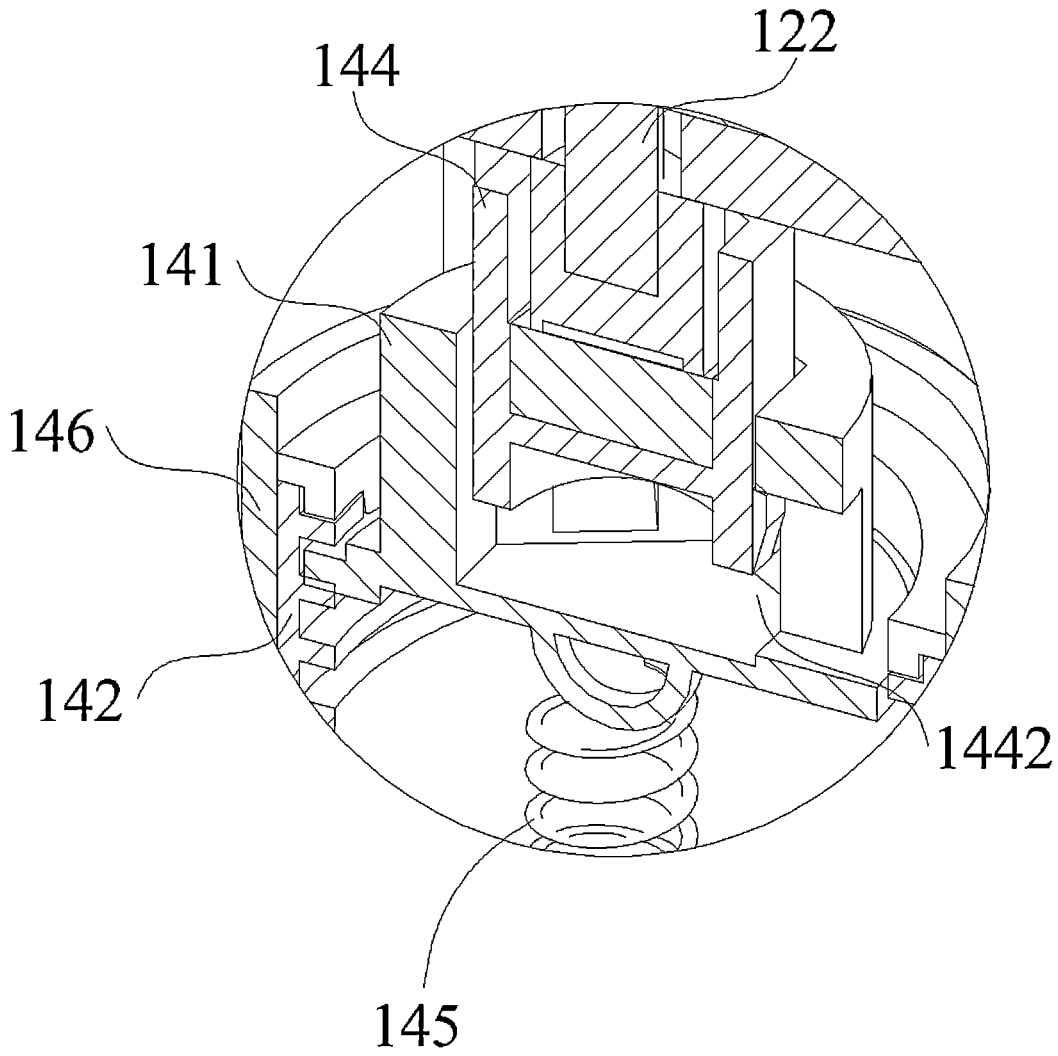
FIG. 9 is a partially enlarged view of FIG. 8.

In combination with FIG. 8 to FIG. 10 again, in a specific second embodiment of the present application:

it is a solution further formed on the basis of the specific first embodiment;

an elastic element 145 is arranged between the first shaft sleeve 141 and the second shaft sleeve 142, and the elastic element 145 is at least one of a tension spring, an elastic rope, a torsion spring and a shrapnel; and the elastic element 145 provides the second driving force.

In an embodiment of the present application, the elastic element 145 is a tension spring, in another embodiment of the present application, the elastic element 145 is a torsion spring, and in yet another embodiment of the present application, the elastic element 145 is a shrapnel.

The specific setting of the elastic element 145 may be selected by the workers according to the actual situation.

In an embodiment of the present application, the cleaning member 131 further includes a second connection portion 1312, and the first shaft sleeve 141 further includes a first connection portion 1414, and a first end and a last end of the elastic element 145 are connected with the first connection portion 1414 and the second connection portion 1312, respectively.

It may be understood that when the sweeper operates normally, the controller sends a control instruction to the lifting driver 121, and the lifting driver 121 drives the power output shaft 122 to rotate according to the control instruction, thereby drives the first shaft sleeve 141 to rotate, and further controls the rib 1411 on the first shaft sleeve 141 to rotate along the thread groove 1421, meanwhile, under the action of the damping member 146, a relative displacement occurs between the first shaft sleeve 141 and the second shaft sleeve 142, the cleaning member 131 descends in vertical direction, the dishcloth on the cleaning member 131 contacts the floor to mop the floor, and meanwhile, the elastic element 145 is in a stretched state;

when the sensor senses the existence of carpet, the sensor sends a feedback signal to the controller, and after receiving the feedback signal, the controller sends a control instruction to the lifting driver 121 according to the feedback result, so as to control the lifting driver 121 to stop operating, thereby stop the stretching operation of the elastic element 145, under the action of the second driving force of the elastic element 145, the rib 1411 rotates along the thread groove 1421 again, and meanwhile, under the action of the damping element 146, a relative displacement between the first shaft sleeve 141 and the second shaft sleeve 142 occurs again, and the cleaning member 131 ascends in the vertical direction and disengages from the floor, thereby realizes the elevating function of the dishcloth on the cleaning member 131, and further to perform avoidance operations on the carpet;

or, when the sweeper finishes operating, the controller sends a control instruction to the lifting driver 121 to control the lifting driver 121 to stop operating, so as to stop the stretching operation of the elastic element 145, and under the action of the second driving force of the elastic element 145, the rib 1411 rotates along the thread groove 1421 again, and meanwhile, under the action of the damping member 146, a relative displacement between the first shaft sleeve 141 and the second shaft sleeve 142 occurs again, and the cleaning member 131 ascends in the vertical direction and disengages from the floor, thereby realizes the elevating function of the dishcloth on the cleaning member 131 to prevent the cleaning member 131 from causing secondary pollution to the cleaned floor.

In combination with FIG. 11 to FIG. 27 again, in a specific third embodiment of the present application:

a solution further formed on the basis of the specific first embodiment; and the floating shaft sleeve 1441 is connected with the second shaft sleeve 142, and the floating shaft sleeve 1441 is connected with the cleaning member 131.

Further, one end of the floating shaft sleeve 1441 is fixedly connected with the second shaft sleeve 142, and the other end of the floating shaft sleeve 1441 is connected with the cleaning member 131;

the cleaning member 131 includes a cleaning member fixing member 1311, the floating shaft sleeve 1441 includes a second embedded groove 14412, and the cleaning member fixing member 1311 is disposed within the second embedded groove 14412; the cleaning member fixing member 1311 includes at least one second limit protrusion 13111, the floating shaft sleeve 1441 includes at least one second limit groove 14413, and the second limit protrusion 13111 is mated with the second limit groove **14413*r*, and a second floating cavity 1443 is formed between the floating shaft sleeve 1441 and the cleaning member fixing member 1311, and the floating element is located in the second floating cavity 1443**.

It may be understood that the floating shaft sleeve 1441 and the cleaning member 131 are limited and fixed by the mating of the second limit protrusion 13111 and the second limit groove 14413.

By disposing the floating element between the floating shaft sleeve 1441 and the cleaning member 131, a pressure between the cleaning member 131 and the floor is increased, and the cleaning effect of the cleaning member 131 is improved, meanwhile, the cleaning member 131 floats correspondingly with different terrain on the floor, so that the dishcloth on the cleaning member 131 may be closely attached to the uneven floor, the sweeper may be adapted to different terrain, the cleaning effect is further improved, and the obstacle-crossing function of the cleaning member 131 is enhanced.

Further, a cross section of the cleaning member fixing member 1311 perpendicular to the axial direction is in a polygonal shape, and the second embedded groove 14412 is in a polygonal shape mated with the cleaning member fixing member 1311.

In a specific embodiment of the present application, the cross section of the cleaning member fixing member 1311 perpendicular to the axial direction is in a quadrangular shape, and the second embedded groove 14412 is in a quadrangular shape mated with the cleaning member fixing member 1311; in another specific embodiment of the present application, the cross section of the cleaning member fixing member 1311 perpendicular to the axial direction is in a pentagonal shape, and the second embedded groove 14412 is in a pentagonal shape mated with the cleaning member fixing member 1311; and in yet another specific embodiment of the present application, the cross section of the cleaning member fixing member 1311 perpendicular to the axial direction is in a hexagonal shape, and the second embedded groove 14412 is in a hexagonal shape mated with the cleaning member fixing member 1311.

It may be understood that a polygonal second embedded groove 14412 and cleaning member fixing member 1311 are a limit structure, and the mating of the second embedded groove 14412 and the cleaning member fixing member 1311 is used to limit and fix the cleaning member 131 and the floating shaft sleeve 1441.

In an embodiment of the present application, the floating sleeve 144 includes a fixing portion 14415, and the second shaft sleeve 142 includes a fourth embedded groove 1423, and the fixing portion 14415 is disposed within the fourth embedded groove 1423.

A cross-section of the fixing portion 14415 perpendicular to the axial direction is in a polygonal shape, and the fourth embedded groove 1423 is in a polygonal shape mated with the fixing portion.

In a specific embodiment of the present application, the cross section of the fixing portion 14415 perpendicular to the axial direction is in a quadrangular shape, and the fourth embedded groove 1423 is in a quadrangular shape mated with the fixing portion 14415; in another specific embodiment of the present application, the cross section of the fixing portion 14415 perpendicular to the axial direction is in a pentagonal shape, and the fourth embedded groove 1423 is in a pentagonal shape mated with the fixing portion 14415; and in yet another specific embodiment of the present application, the cross section of the fixing portion 14415 perpendicular to the axial direction is in a hexagonal shape, and the fourth embedded groove 1423 is in a hexagonal shape mated with the fixing portion 14415.

It may be understood that a polygonal fourth embedded groove 1423 and fixing portion 14415 are a limit structure, and the mating of the fourth embedded groove 1423 and the fixing portion 14415 is used to preliminarily limit and fix the second shaft sleeve 142 and the floating shaft sleeve 1441.

Further, the second shaft sleeve 142 and the floating shaft sleeve 1441 are connected in a snap manner. Or, the second shaft sleeve 142 and the floating shaft sleeve 1441 are connected in a magnetic attraction manner.

Specifically, in an embodiment of the present application, the second shaft sleeve 142 and the floating shaft sleeve 1441 are connected in a magnetic attraction manner.

A second magnet 1445 is arranged on the floating shaft sleeve 1441, and the second shaft sleeve 142 and the floating shaft sleeve 1441 are further limited and fixed by the second magnet 1445, so that the second shaft sleeve 142 and the floating shaft sleeve 1441 are firmly embedded, and it is convenient to detach and separate the second shaft sleeve 142 and the floating shaft sleeve 1441, and finally it is convenient to detach the cleaning member 131.

Figure 23:
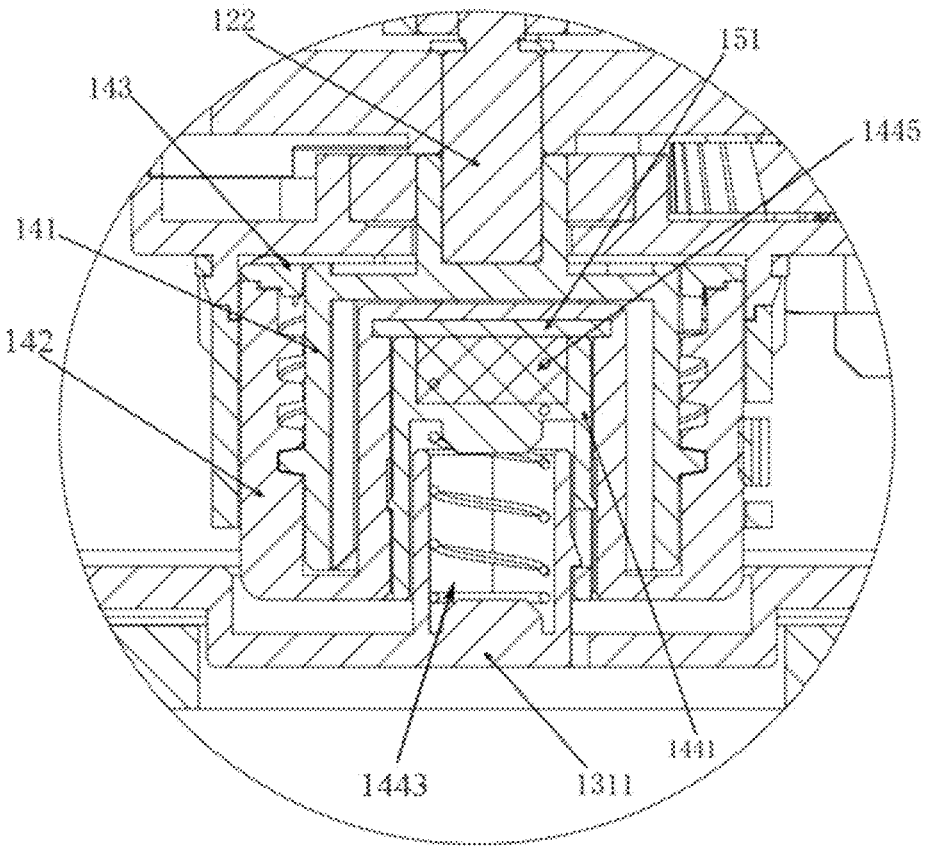
FIG. 23 is a partial cross-sectional view of a cleaning device in one embodiment of the present application.

In an embodiment of the present application, as shown in FIG. 23, one end of the floating shaft sleeve 1441 is magnetically connected with the second shaft sleeve 142 through a magnetic assembly, and the other end of the floating shaft sleeve 1441 is connected with the cleaning member fixing member 1311 for installing the cleaning member, and a second floating cavity is formed between them, and the floating element is located within the second floating cavity.

In an implementation, the magnetic assembly includes a second magnet 1445 and a third magnet 151 disposed on the floating shaft sleeve 1441 and the second shaft sleeve 142, respectively, Polarities of ends of the second magnet 1445 and the third magnet 151 facing each other are opposite, and the floating shaft sleeve 1441 is detachably and fixedly connected with the second shaft sleeve 142 through mutual attraction of the second magnet 1445 and the third magnet 151.

Further, the cleaning device further includes a hall sensor (not shown in the drawings) fixedly disposed relative to one of the second magnet and the third magnet and used to detect whether the floating shaft sleeve 1441 and the second shaft sleeve 142 are installed in place. In actual use, the floating shaft sleeve 1441, the cleaning member fixing member 1311 and the second magnet 1445 are pre-installed to form a combination, and then the second magnet 1445 at a top of the entire combination is fixedly connected with the third magnet 151, at this time, the hall sensor detects that a magnetic flux is formed after the magnetic attraction of the second magnet and the third magnet and feeds it back to the controller, and the controller compares this magnetic flux with a preset magnetic flux. If the detected magnetic flux reaches the preset magnetic flux, it indicates that the combination and the second shaft sleeve are installed in place. If the detected magnetic flux does not reach the preset magnetic flux, it indicates that the combination and the second shaft sleeve are not installed in place.

Figure 24:
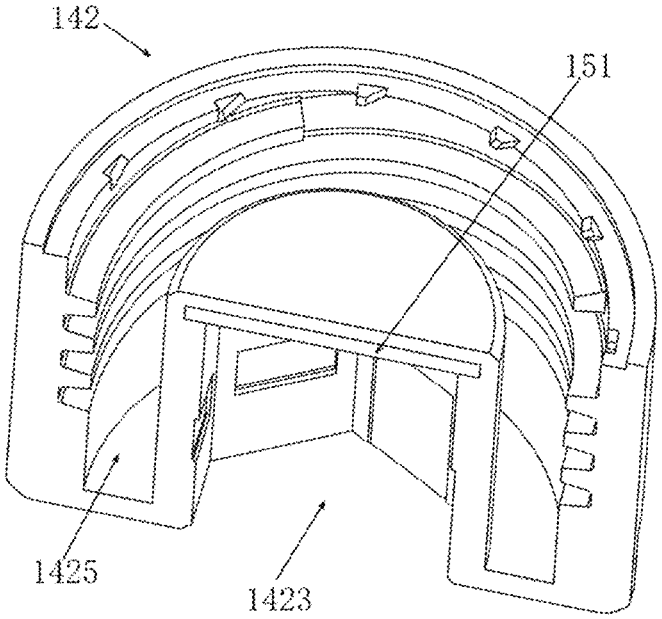
FIG. 24 is a cross-sectional diagram of the second shaft sleeve in FIG. 23.

In an implementation, as shown in FIG. 23 and FIG. 24, a side of the second shaft sleeve 142 facing the cleaning member fixing member 1311 is provided with a first groove area, i.e., the above fourth embedded groove 1423, and a side of the second shaft sleeve 142 facing away from the cleaning member fixing member 1311 is provided with an annular second groove area 1425; the thread groove 1421 or the rib 1411 is disposed in the second groove area 1425, a top of the first shaft sleeve 141 is connected with the power output shaft 122, and a bottom of the first shaft sleeve 141 is embedded within the second groove area 1425. In an implementation, a cross section of the first shaft sleeve is inverted U-shaped.

The third magnet 151 is disposed on a groove bottom of the first groove area; at least the second magnet 1445 extends into the first groove area and is magnetically fixed with the third magnet 1425, so that the whole second shaft sleeve 142, the first shaft sleeve 141 and the power output shaft 122 are compact in structure.

In an implementation, the above ball sensor may be disposed in the first groove area, and the hall sensor is closer to the groove bottom of the first groove area than the third magnet 151, that is, the hall sensor is located at a groove bottom of the first groove area. As a deformation, the hall sensor may also be disposed on the floating shaft sleeve 1441, and the second magnet 1445 is closer to the groove bottom of the first groove area than the hall sensor.

In an implementation, the hall sensor is disposed on the top of the power output shaft 122, the power output shaft 122 is made of magnetic conductive material, and an end of the power output shaft 122 is distributed to be close to and right face the third magnet 151. Or, the power output shaft 122 is made of a magnetic conductive material and is directly used as the third magnet, and there is no need to dispose the third magnet 151 in the first groove area. At this time, optimally, the groove bottom of the first groove area is provided with an opening or a give-way hole, which is convenient for the magnetic attraction fixation of the third magnet and the second magnet.

Figure 25:
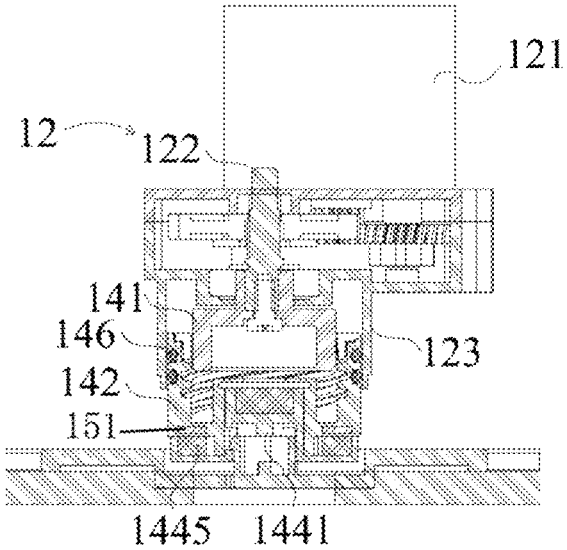
FIG. 25 is a partially enlarged diagram of FIG. 13.
Figure 26:
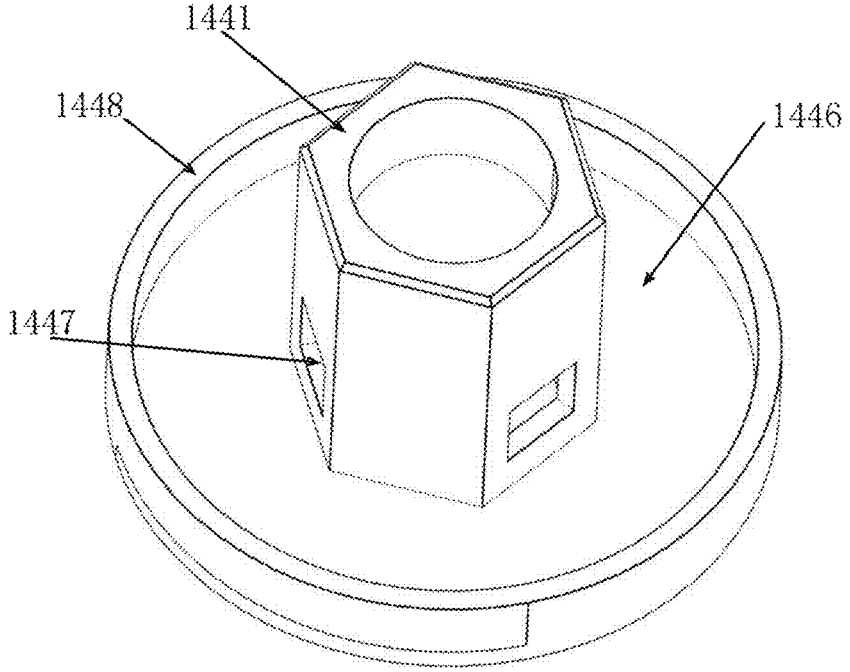
FIG. 26 is a structural diagram of the floating shaft sleeve in FIG. 25.

As shown in FIG. 25 and FIG. 26, there are at least two second magnets 1445, and correspondingly, there are at least two third magnets 151. A bottom edge of the floating shaft sleeve 1441 is provided with an outer edge 1446 protruding outward, and the outer edge 1446 is distributed opposite to a bottom of the second groove region 1425. At least one third magnet 151 is disposed on the bottom of the second groove region 1425, and at least one second magnet 1445 is disposed on the outer edge 1446, and the second magnets 1445 are magnetically connected with the third magnets 151, which further increases the connection firmness between the second shaft sleeve 142 and the floating shaft sleeve 1441.

Figure 27:
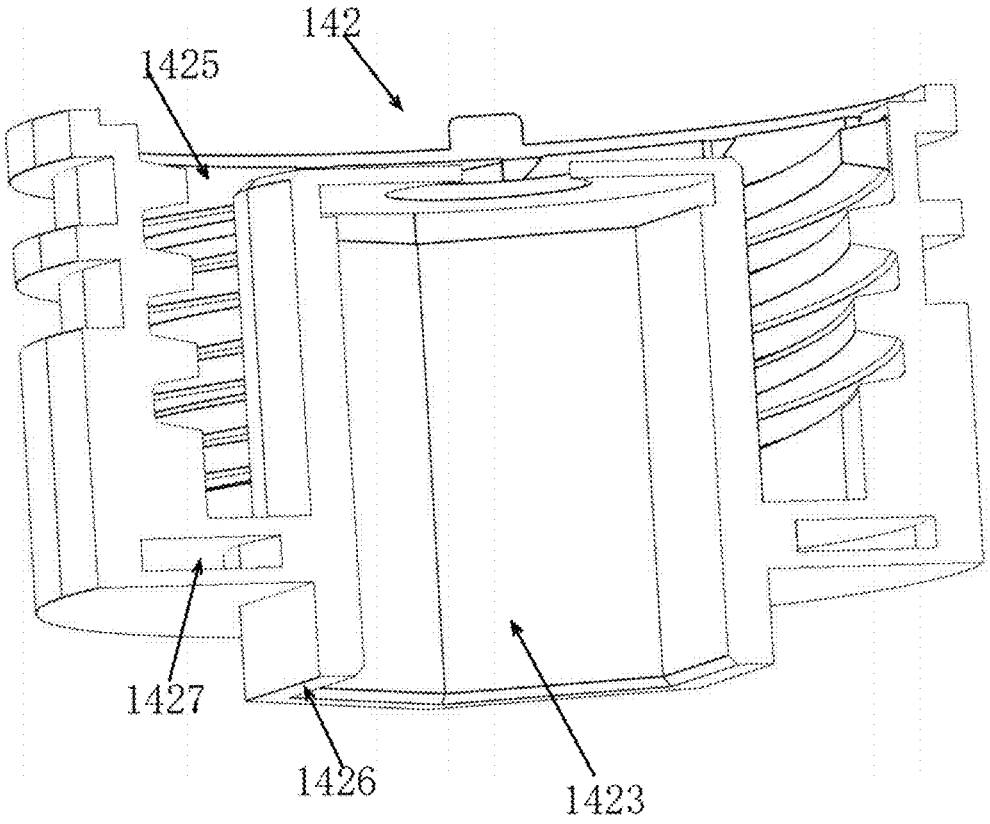
FIG. 27 is a cross-sectional diagram of the second shaft sleeve in FIG. 25.
Figure 28:
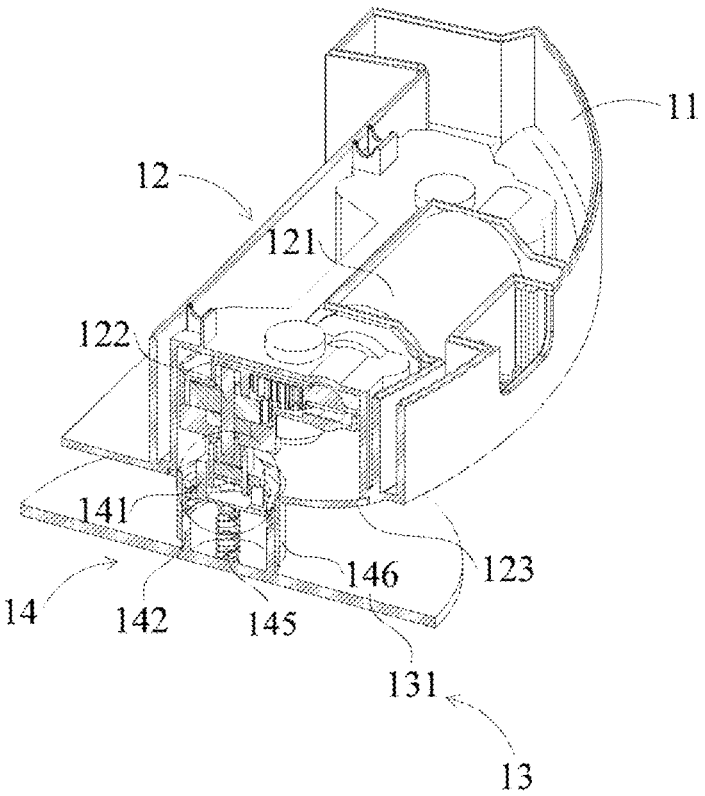
FIG. 28 is a perspective cross-sectional structural diagram of a sweeper cleaning device of the present application.
Figure 29:
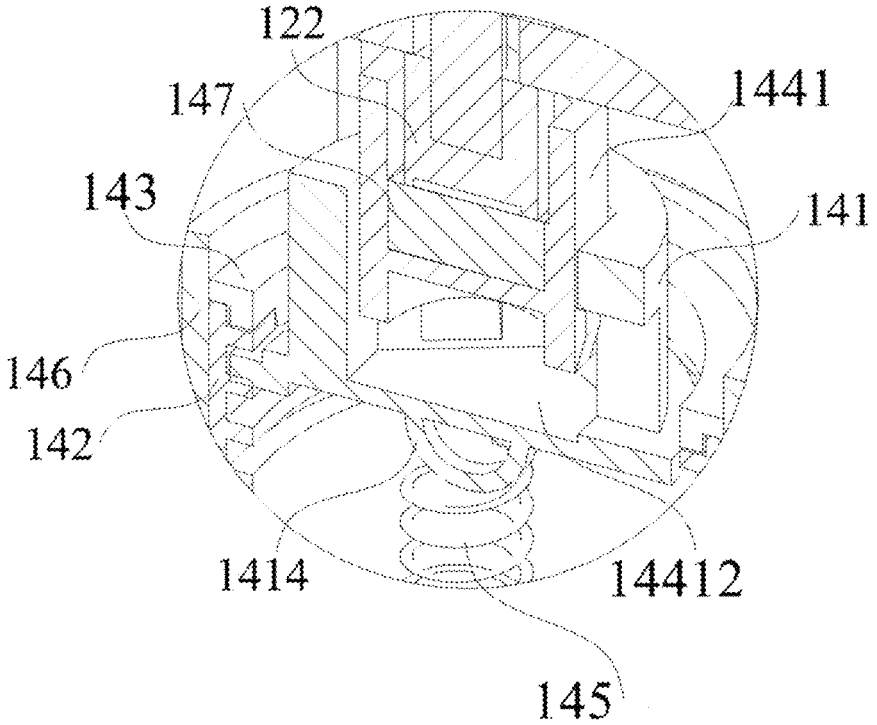
FIG. 29 is a partially enlarged view of FIG. 28.
Figure 30:
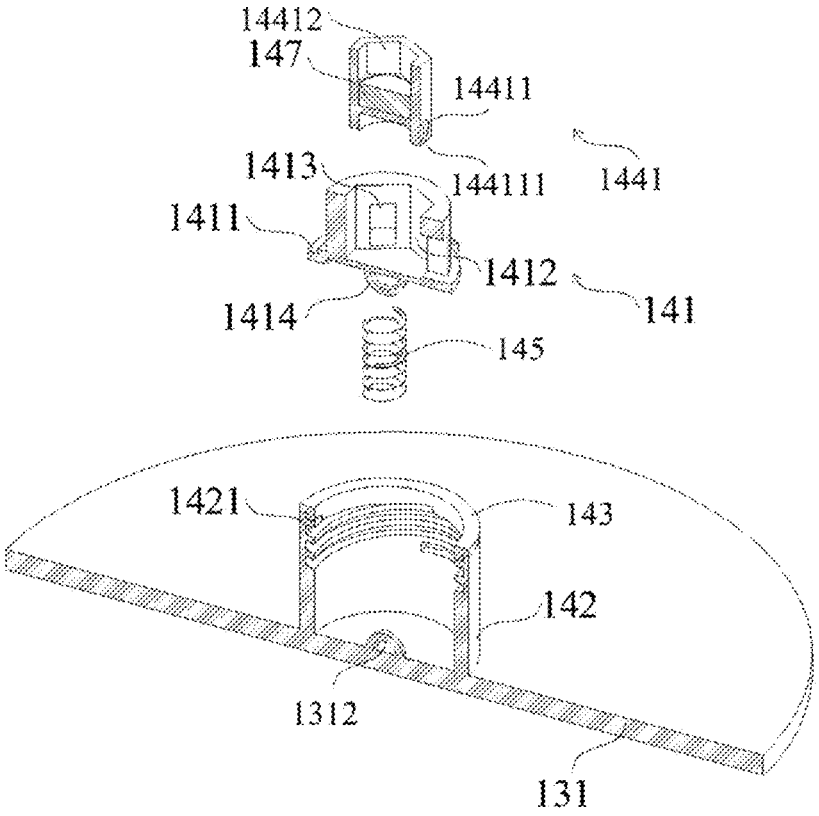
FIG. 30 is an exploded cross-sectional structural diagram of a cleaning assembly and a lifting assembly of the present application.
Figure 31:
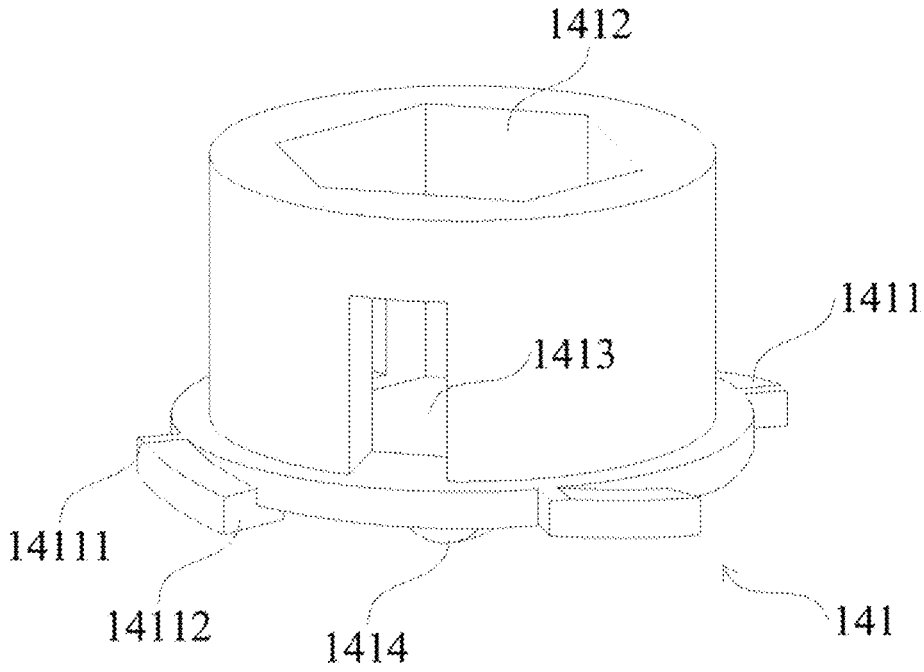
FIG. 31 is a perspective cross-sectional structural diagram a first shaft sleeve of the present application.
Figure 32:
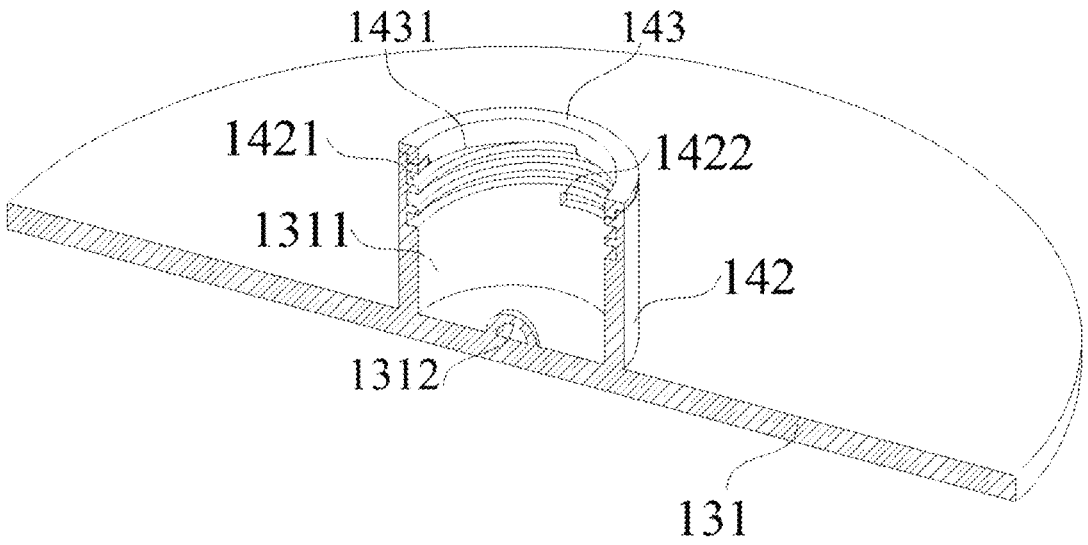
FIG. 32 is a perspective structural diagram of a cleaning member of the present application.

As shown in FIG. 26, an annular flange 1448 is disposed on and edge of the outer edge, and correspondingly, as shown in FIG. 27, a bottom of the second shaft sleeve 142 is provided with an extension portion 1426, and the extension portion 1426 abuts on the outer edge, so that the annular flange, the outer edge and an outer wall of the extension portion 1426 are enclosed to form an annular groove, and the second magnet 1445 is in an annular shape and disposed in the annular groove.

As shown in FIG. 27, the second groove area of the second shaft sleeve 142 is provided with an annular hole 1427, and the third magnet 151 is embedded within the annular hole 1427, so that the third magnet and the second magnet are oppositely distributed.

As a deformation, the above annular flange and the above extension may not be disposed, and the third magnet and the second magnet are directly disposed on the bottom of the second shaft sleeve and the top of the floating shaft sleeve, respectively.

In an implementation, the cleaning member fixing member 1311 and the floating shaft sleeve are connected in a snap manner. Specifically, as shown in FIG. 25 and FIG. 26, a sidewall of the floating shaft sleeve 1441 is provided with at least one mating hole 1447, and a top of the cleaning member fixing member 1311 extends into a bottom cavity of the floating shaft sleeve, and the top or sidewall of the cleaning member fixing member 1311 is provided with a snap, and the snap is hooked on the mating hole 1447 to realize a detachable connection of the two. Positions of the snap and the mating hole may be reversed, or they may be fixedly connected in other ways, such as magnetic attraction. Or, as shown in FIG. 23, the floating shaft sleeve 1441 is also molded on the cleaning member fixing member 1311.

Further, the lifting module 14 further includes a damping member 146, the driving module further includes a housing 123, and the damping member 146 is disposed between the second shaft sleeve 142 and the housing 123.

In an embodiment of the present application, the damping member 146 is an O-shaped sealing ring, and a sealing ring fixing groove 1424 is disposed on the second shaft sleeve 142, and the damping member 146 is arranged in the sealing ring fixing groove 1424.

It may be understood that in the present application, by disposing the O-shaped sealing ring between the second shaft sleeve 142 and the housing 123, there is a friction between the O-shaped sealing ring and the housing 123, it plays a hindering role of hindering the second shaft sleeve 142 from reaching the same rotation speed as the first shaft sleeve 141, prolongs the time for the second shaft sleeve 142 reaching the same rotation speed as the first shaft sleeve 141, so that no matter how the rotation speed of the power output shaft 122 of the lifting driver 121 is set, as long as the power output shaft 122 rotates normally, it may rotate relatively with the second shaft sleeve 142, and the cleaning member 131 may ascend or descend under the action of the screw mechanism.

Figure 18:
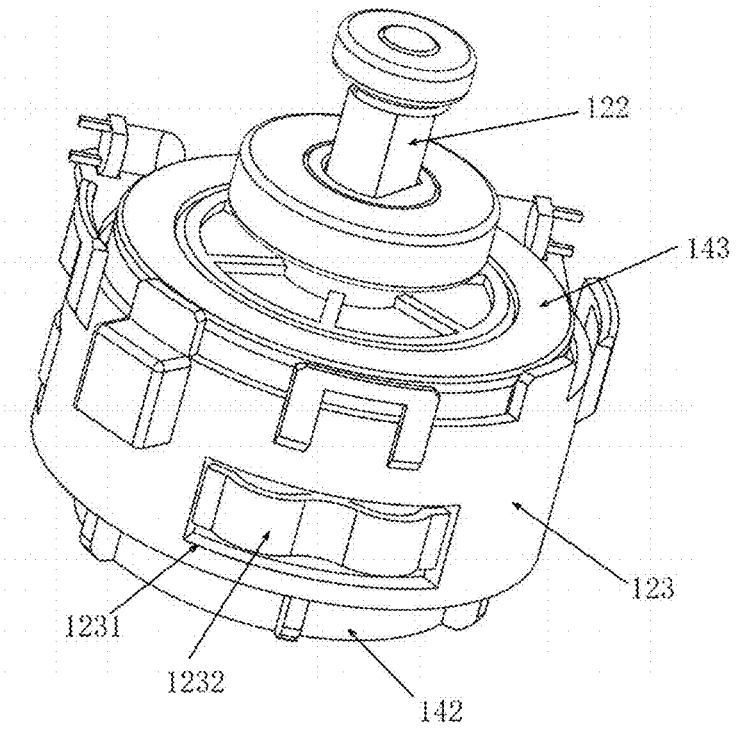
FIG. 18 is a schematic diagram of the mating of a housing with a second shaft sleeve, a shaft sleeve cover and a power output shaft in one embodiment of the present application.
Figure 19:
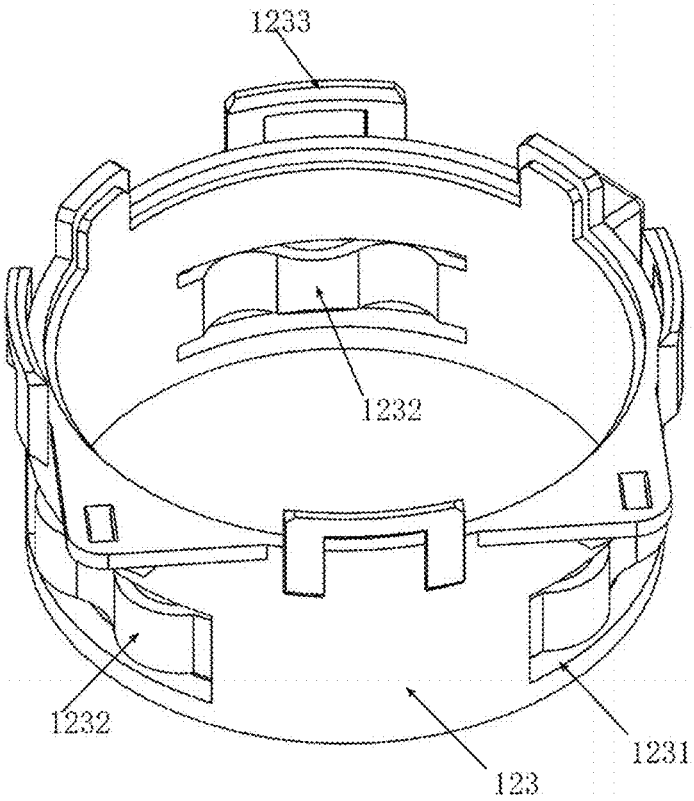
FIG. 19 is a schematic structural diagram of the housing in FIG. 18.

In another embodiment, as shown in FIG. 18 and FIG. 19, the driving module further includes a housing 123, the housing 123 is sleeved outside the second shaft sleeve 143. The housing 123 is provided with at least one give-way hole 1231, and at least one deforming part 1232 is disposed in the give-way hole 1231, the deforming part 1232 has at least one protrusion protruding inward, and the housing 123 is kept an interference abutment with the outer wall surface of the second shaft sleeve through the protrusion. Because the deformation portion has a deformation space in the give-way hole, the protrusion forms elastic interference abutment with the outer wall of the second shaft sleeve, which ensures that the protrusion always maintains a certain friction force with the outer wall of the second shaft sleeve and plays a damping role.

Or, the housing and the deformation portion 1232 are integrally formed and made of a plastic material, for example, the plastic may be POM (Polyformaldehyde), PP (Polypropylene) plastic, etc.

As shown in FIG. 19, the give-way hole 1231 on the housing may be set to be one or two or more, and when the give-way bole 1231 is set to be multiple, optimally, a plurality of give-way holes 1231 are evenly distributed on a circle of an outer wall of the housing 123. The deformation portion 1232 disposed within each give-way hole 1231 may be one, two or more, and at least one protrusion is disposed on the deformation portions 1232. For example, the deformation portion 1232 may be in a wave type, and a peak position of the wave type is just a protrusion. By disposing a plurality of protrusions as damping members, the damping effect of the housing and the second shaft sleeve is further enhanced.

As a deformation, the deformation portion may be not only in a wave shape, but also in other shapes, such as in an M type, a V type, or other cambered surfaces or curved surfaces.

As shown in FIG. 19, for the housing, a plurality of hanging ears 1233 distributed at intervals are also disposed on the top of the housing 123, and the housing is detachably connected with the chassis 11 of the sweeper or cleaning apparatus through the hanging ears 1233, and the hanging cars may be connected with the chassis 11 through a snap, a magnetic connection or other detachable connection manners.

Figure 20:
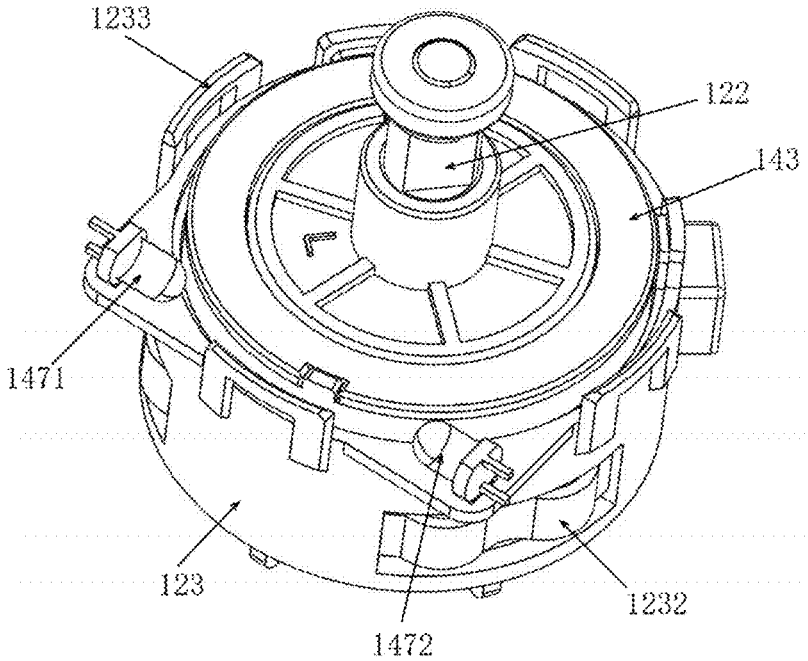
FIG. 20 is a schematic diagram of the other side of the housing after being mated with the second shaft sleeve, the shaft sleeve cover and the power output shaft in FIG. 18.
Figure 21:
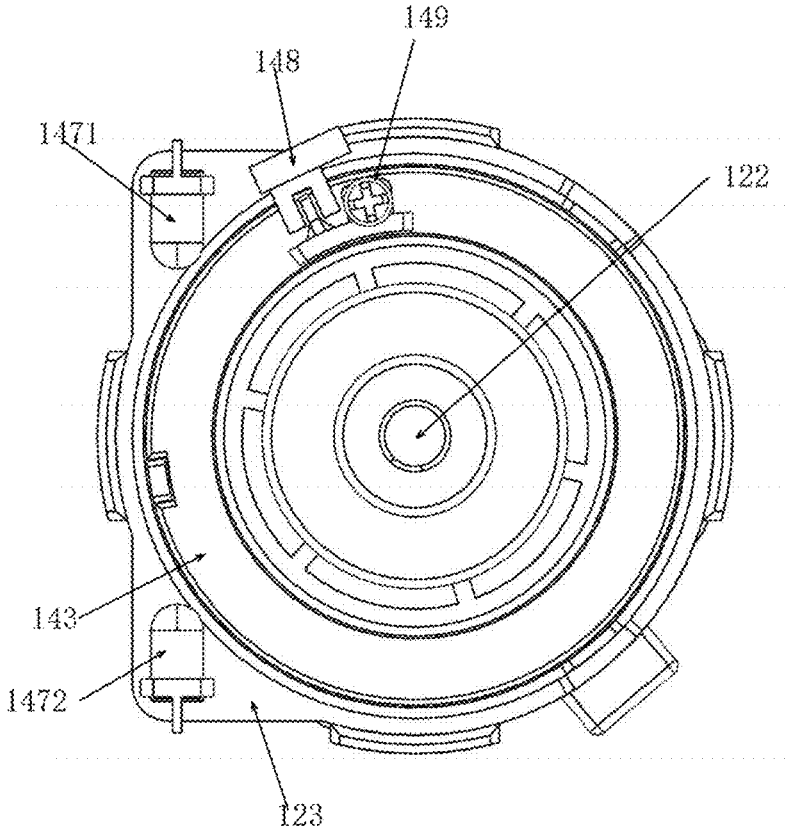
FIG. 21 is a top view schematic diagram of the housing after being mated with the second shaft sleeve, the shaft sleeve cover and the power output shaft in FIG. 20.

In another embodiment, as shown in FIG. 20 and FIG. 21, the cleaning device further includes a sensor and a controller, and the controller is electrically or wirelessly connected with the lifting driver 121 and the sensor, respectively.

In an embodiment, the driving module further includes a housing 123, the housing 123 is sleeved outside the outer wall of the second shaft sleeve 142. The sensor includes a light emitter 1471 and a light receiver 1472 which are oppositely disposed on the housing 123, and an optical path area is formed between the light emitter 1471 and the light receiver 1472. When the second shaft sleeve 142 is driven by the lifting driver 121 to reach a highest point of the ascending position, at least a part of the second shaft sleeve 142 is located in the optical path. area, to block light emitted by the light emitter 1471, so that the light receiver 1472 cannot receive light emitted by the light emitter 1471. At this time, the sensor feeds back a signal to the controller that the second shaft sleeve 142 ascends in place, that is, a signal that the cleaning member ascends in place, and according to this signal, the controller outputs a control signal to control the lifting driver to stop moving. On the contrary, when the second shaft sleeve 142 does not reach the highest ascending position, light emitted by the light emitter 1471 is always received by the light receiver 1472, at this time, the sensor feeds back to the controller that the elevating height of the second shaft sleeve is not in place, and the lifting driver continues to operate or start to move, so as to acquire the positions of the second shaft sleeve and the cleaning member.

Figure 22:
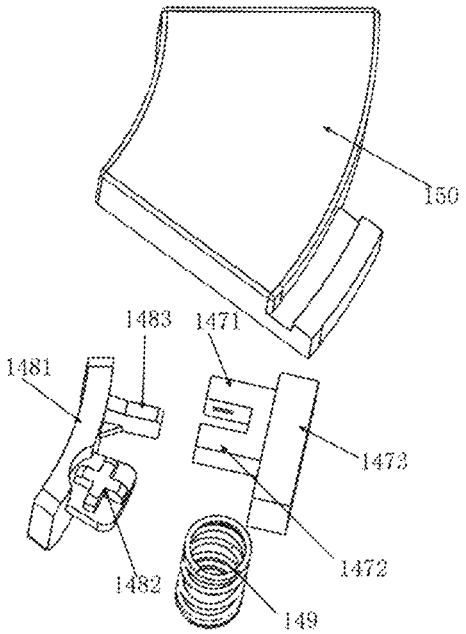
FIG. 22 is an exploded diagram of a light blocking member, a biasing member, a sensor and a cover body in another embodiment of the present application.

In another embodiment, as shown in FIG. 20, FIG. 21 and FIG. 22, the driving module further includes a housing 123, a light blocking member 148 and a biasing member 149, and the housing is sleeved outside the outer wall of the second shaft sleeve 142. The sensor includes a light emitter 1471 and a light receiver 1472 which are oppositely disposed on the housing, and an optical path area is formed between the light emitter 1471 and the light receiver 1472. The light blocking member 148 is liftably disposed on the housing 123. The biasing member 149 is disposed on the housing 123, and exerts a biasing force on the light blocking member 148 to drive a bottom of the light blocking member 148 to be located right below the optical path area. When the second shaft sleeve 142 is driven by the lifting driver 122 to reach a highest point of an ascending position, a top of the second shaft sleeve 142 pushes the light blocking member 148 to perform an ascending motion to extend into the optical path area to block light emitted by the light emitter 1471, so that the light receiver 1472 cannot receive light emitted by the light emitter 1471, at this time, the sensor feeds back a signal to the controller that the second shaft sleeve 142 ascends in place, that is, a signal that the cleaning member ascends in place, and the controller outputs a control signal according to this signal to control the lifting driver to stop moving. On the contrary, when the second shaft sleeve 142 does not reach the highest ascending position, light emitted by the light emitter 1471 is always received by the light receiver 1472, at this time, the sensor feeds back to the controller that an elevating height of the second shaft sleeve is not in place, and the lifting driver continues to operate or starts to operate.

In an implementation, as shown in FIG. 22, the light blocking member 148 includes an installation portion 1481, a light blocking portion 1483 and a protruding column 1482 disposed side by side on a sidewall of the installation portion 1481, one end of the biasing member 149 is disposed on the housing 123, and the other end of the biasing member 149 is disposed on the protruding column 1482; and the installation portion 1481 is pushed by the second shaft sleeve 142 to drive the light blocking portion 1483 to extend into the optical path area. For the biasing member, the biasing member is a compression spring, and the biasing member and the light blocking portion are disposed side by side, so that the biasing member may not be located in the optical path area and may not interfere with the light transmission in the optical path area.

For the above sensor, it may be an optocoupler sensor, an op sensor, or other types of sensors.

In an implementation, as shown in FIG. 22, the driving module further includes a cover 150, the cover is fixedly connected with the chassis 11 (mentioned below), and the housing 123 is connected with the chassis 11, so that a top of the above biasing member is disposed on a bottom of the cover 150, and the light emitter and the light receiver are disposed on the cover through a fixing seat 1473, and the light emitter 1471 and the light receiver 1472 are oppositely distributed on two sidewalls of the U shape.

In addition, it should be noted that the above first shaft sleeve and the above second shaft sleeve may be sleeves or other annular structures in nature, and are not limited to the forms or shapes mentioned above.

The present application also relates to a cleaning apparatus, which includes a chassis 11; and a cleaning device as described above, the cleaning device is installed on the chassis 11.

For the cleaning apparatus, it may be a sweeper, a self-propelled scrubber, or other apparatus using the above cleaning device, not limited to a sweeper or a scrubber.

It should be understood that the above embodiments are only illustrative of part of the present application, and are not used to limit the scope of the present application.

In combination with FIG. 28 to FIG. 32, the present application relates to a sweeper cleaning device, including:

a driving assembly 12, which includes a lifting driver 121;

a lifting assembly 14, which includes a first shaft sleeve 141, a second shaft sleeve portion 142 and an elastic element 145, the first shaft sleeve 141 is connected with a power output shaft 122 of the lifting driver 121, and the first shaft sleeve 141 and the second shaft sleeve 142 form a screw mechanism, and the elastic element 145 is connected with the first shaft sleeve 141 and the second shaft sleeve portion 142, respectively; and a cleaning assembly 13, which includes a cleaning member 131 connected with the second shaft sleeve portion 142; and the screw mechanism is driven by a first driving force of the power output shaft 122 of the lifting driver 121 to drive the cleaning member 131 to perform a descending motion relative to the lifting driver 121, and is driven by a second driving force of the elastic element 145 to drive the cleaning member 131 to perform an ascending motion relative to the lifting driver 121.

It may be understood that when the sweeper operates normally, the cleaning member 131 is driven to perform a descending motion relative to the lifting driver 121 through the power output shaft 122 of the lifting driver 121 by using the screw mechanism, so that the cleaning member 131 may perform a normal cleaning operation. When the sweeper senses a carpet or when the sweeper finishes mopping the floor, the second driving force of the elastic element 145 drives the cleaning member 131 to perform an ascending motion relative to the lifting driver 121, so as to prevent the cleaning member 131 from polluting the carpet and effectively protect the carpet. Meanwhile, when the sweeper stops operating, the cleaning member 131 automatically elevates, which may prevent the cleaning member 131 from causing secondary pollution to the cleaned floor after the sweeper is cleaned, and improve the cleaning effect of the sweeper.

In an embodiment of the present application, the cleaning member 131 includes a second connection portion 1312, the first shaft sleeve 141 includes a first connection portion 1414, and a first end and a last end of the elastic element 145 are connected with the second connection portion 1312 and the first connection portion 1414, respectively;

the clastic element 142 is at least one of a tension spring, an elastic rope, a torsion spring and a shrapnel; and in an embodiment of the present application, the elastic element 142 is a tension spring, in another embodiment of the present application, the elastic element 142 is a torsion spring, and in yet another embodiment of the present application, the elastic element 142 is a shrapnel.

The specific setting of the elastic element 142 may be selected by the workers according to the actual situation.

Further, the screw mechanism includes a thread groove 1421 and a rib 1411 which are mated with each other, and lead angles of the thread groove 1421 and the rib 1411 are smaller than a self-locking lead angle; and specifically, the second shaft sleeve portion 142 includes the thread groove 1421, and the first shaft sleeve 141 includes the rib 1411; or, the first sleeve 141 includes the thread groove 1421, and the second shaft sleeve portion 142 includes the rib 1411.

The setting of specific positions of the thread groove 1421 and the rib 1411 may be specifically selected by the workers according to the actual situation.

Further, in an embodiment of the present application, the second shaft sleeve portion 142 includes the thread groove 1421, and the first shaft sleeve 141 includes the rib 1411.

In an embodiment of the present application, the rib 1411 is in a strip shape, and in another embodiment of the present application, the rib 1411 is in a threaded shape.

The specific setting of the shape of the rib 1411 may be selected by the workers according to the actual situation.

It may be understood that when the sweeper operates normally, the lifting driver 121 drives the power output shaft 122 to rotate, thereby drives the first shaft sleeve 141 to rotate, and further controls the rib 1411 on the first shaft sleeve 141 to rotate along the thread groove 1421, so that a relative displacement occurs between the first shaft sleeve 141 and the second shaft sleeve portion 142, and the cleaning member 131 performs a descending motion relative to the lifting driver 121, the cleaning member 131 contacts the floor for cleaning operation, and meanwhile, the elastic element 145 is in a stretched state.

When the sweeper senses the carpet or when the sweeper finishes mopping the floor, the lifting driver 121 stops operating, thereby stops a stretching operation of the elastic element 145, and the rib 1411 rotates along the thread groove 1421 again under the second driving force of the elastic element 145, so that a relative displacement occurs between the first sleeve 141 and the second shaft sleeve portion 142 again, and the cleaning member 131 performs an ascending motion relative to the lifting driver 121, disengages from the floor, thereby realizes the elevating operation of the cleaning member 131.

Meanwhile, the self-locking lead angle is determined according to the static friction factor between the materials. In the present application, the lead angles of the thread groove 1421 and the rib 1411 are the same, and the lead angles of the thread groove 1421 and the rib 1411 are smaller than the self-locking lead angle determined based on the static friction factor, so as to prevent the cleaning member 131 from rotating and descending under the action of its own gravity when it ascends to the highest position, and effectively limit and fix the cleaning member 131.

Further, the lifting assembly 14 further includes a shaft sleeve cover 143, the shaft sleeve cover 143 is located at a top end of the second shaft sleeve portion 142, and a bottom end of the shaft sleeve cover 143 has a protruding first limit portion 1431, the protruding first limit portion 1431 is located at an end of the thread groove 1421.

In an embodiment of the present application, the other end of the thread groove 1421 is provided with a second limit portion 1422;

a top end of the rib 1411 is provided with a first limit surface 14111, and a side end of the rib 1411 is provided with a second limit surface 14112; and when the cleaning member 131 reaches a lowest position under a drive by the first driving force of the power output shaft 122 of the lifting driver 121, the cleaning member 131 is limited by the mating of the first limit portion 1431 and the first limit surface 14111; and when the cleaning member 131 reaches a highest position under the drive by the second driving force of the elastic element 145, the cleaning member 131 is limited by the mating of the second limit portion 1422 and the second limit surface 14112.

Further, the power output shaft 122 is fixedly connected with the first shaft sleeve 141; or, the power output shaft 122 is in floating connection with the first shaft sleeve 141.

Specifically, in an embodiment of the present application, the power output shaft 122 is in floating connection with the first shaft sleeve 141.

Further, the lifting assembly 14 further includes a floating shaft sleeve 1441 and a floating element;

one end of the floating shaft sleeve 1441 is fixedly connected with the power output shaft 122;

the first shaft sleeve 141 includes a first embedded groove 1412, and the other end of the floating shaft sleeve 1441 is disposed in the first embedded groove 1412 and connected with the first shaft sleeve 141; and a first floating cavity 1442 is formed between the floating shaft sleeve 1441 and the first shaft sleeve 141, and the floating element is disposed within the first floating cavity 1442, and the floating element is at least one of a spring, a torsion spring, a shrapnel, an elastic ball, a pneumatic support and a hydraulic support.

In an embodiment of the present application, the floating element is a spring, in another embodiment of the present application, the floating element is a torsion spring, and in yet another embodiment of the present application, the floating element is a shrapnel.

The specific setting of the floating element may be selected by the workers according to the actual situation, It may be understood that the floating element is disposed between the first shaft sleeve 141 and the floating shaft sleeve 1441, so as to increase the pressure between the cleaning member 131 and the floor, improve the cleaning effect of the cleaning member 131. Meanwhile, the cleaning member 131 may float correspondingly with different terrain on the floor, so that the dishcloth on the cleaning member 131 may be closely attached to the uneven floor, so that the sweeper may be adapted to different terrain, which further improves the cleaning effect, and enhances the obstacle-crossing function of the cleaning member 131.

Meanwhile, the pressure range of the floating element is 5 N-10 N, and a floating stroke of the cleaning member 131 may be specifically set according to the actual situation.

Further, the floating shaft sleeve 1441 includes at least one first limit protrusion 14411, and the first shaft sleeve 141 includes at least one first limit groove 1413, and the first limit protrusion 14411 is mated with the first limit groove 1413.

It may be understood that the floating shaft sleeve 1441 and the first shaft sleeve 141 are limited and fixed by the mating of the first limit protrusion 14411 and the first limit groove 1413.

In an embodiment of the present application, a side end of the first limit protrusion 14411 is provided with a guide surface 144111, the guide surface 144111 is a transitional structure of the first limit protrusion 14411, and when the floating shaft sleeve 1441 is installed, the guide surface 144111 may guide the first limit protrusion 14411 to slide to the first limit groove 1413, so as to facilitate to sleeve the floating shaft sleeve 1441 within the first embedded groove 1412.

Further, a cross section of the floating shaft sleeve 1441 perpendicular to the axial direction is in a polygonal shape, and the first embedded groove 1412 is in a polygonal shape mated with the floating shaft sleeve 1441.

In a specific embodiment of the present application, the cross section of the floating shaft sleeve 1441 perpendicular to the axial direction is in a quadrangular shape, and the first embedded groove 1412 is in a quadrangular shape mated with the floating shaft sleeve 1441; in another specific embodiment of the present application, the cross section of the floating shaft sleeve 1441 perpendicular to the axial direction is in a pentagonal shape, and the first embedded groove 1412 is in a pentagonal shape mated with the floating shaft sleeve 1441; and in yet another specific embodiment of the present application, the cross section of the floating shaft sleeve 1441 perpendicular to the axial direction is in a hexagonal shape, and the first embedded groove 1412 is in a hexagonal shape mated with the floating shaft sleeve 1441.

The specific setting of the cross sections of the floating shaft sleeve 1441 and the first embedded groove 1412 perpendicular to the axis direction may be selected by the workers according to the actual situation.

It may be understood that a polygonal floating shaft sleeve 1441 and the first embedded groove 1412 are a limit structure, and the mating of the floating shaft sleeve 1441 and the first embedded groove 1412 is used to limit and fix a lower portion of the floating shaft sleeve 1441 relative to the first shaft sleeve 141, so that the lower portion of the floating shaft sleeve 1441 is firmly embedded with the first shaft sleeve 141.

In an embodiment of the present application, the floating shaft sleeve 1441 further includes a second embedded groove 14412, and the other end of the power output shaft 122 is disposed in the second embedded groove 14412 and connected with the floating shaft sleeve 1441.

Specifically, the power output shaft 122 is connected with the second embedded groove 14412 in a snap manner, or the power output shaft 122 is magnetically connected with the second embedded groove 14412 through a sixth magnet 147.

In an embodiment of the present application, the power output shaft 122 is magnetically connected with the second embedded groove 14412 through the sixth magnet 147.

The sixth magnet 147 may be arranged at a bottom of the second embedded groove 14412, or the sixth magnet 147 may be arranged at a circumferential area inside the second embedded groove 14412.

The specific setting of a position of the sixth magnet 147 may be selected by the workers according to the actual situation.

The cross section of the power output shaft 122 perpendicular to the axial direction is in a polygonal shape, and the second embedded groove 14412 is in a polygonal shape mated with the power output shaft 122.

In a specific embodiment of the present application, the cross section of the power output shaft 122 perpendicular to the axial direction is in a quadrangular shape, and the second embedded groove 14412 is in a quadrangular shape mated with the power output shaft 122: in another specific embodiment of the present application, the cross section of the power output shaft 122 perpendicular to the axial direction is in a pentagonal shape, and the second embedded groove 14412 is in a pentagonal shape mated with the power output shaft 122; and in yet another specific embodiment of the present application, the cross section of the power output shaft 122 perpendicular to the axial direction is in a hexagonal shape, and the second embedded groove 14412 is in a hexagonal shape mated with the power output shaft 122.

The specific setting of the cross sections of the power output shaft 122 and the second embedded groove 14412 perpendicular to the axis direction may be selected by the workers according to the actual situation.

It may be understood that the polygonal second embedded groove 14412 and the power output shaft 122 are a limit structure, and the mating of the second embedded groove 14412 and the power output shaft 122 is used to preliminarily limit and fix the power output shaft 122 of the lifting driver 121 and the floating shaft sleeve 1441; meanwhile, the sixth magnet 147 is disposed within the second embedded groove 14412, and the power output shaft 122 and the floating shaft sleeve 1441 are further limited and fixed by the sixth magnet 147, so that the power output shaft 122 and the floating shaft sleeve 1441 are firmly embedded, and it is convenient to easily detach and separate the power output shaft 122 and the floating shaft sleeve 1441, and finally it is convenient to detach the cleaning member 131.

Further, the worker controls different initial positions of the cleaning member 131 by controlling different assembly directions of the power output shaft 122 with the floating shaft sleeve 1441, the floating shaft sleeve 1441 and the first shaft sleeve 141.

Further, the rotation speed of the power output shaft 122 of the lifting driver 121 is different, and the magnetic force of the sixth magnet 147 is different.

When the rotation speed of the power output shaft 122 of the lifting driver 121 is relatively high, the sixth magnet 147 with a greater magnetic force may be selected; and when the rotation speed of the power output shaft 122 of the lifting driver 121 is relatively low, the sixth magnet 147 with a smaller magnetic force may be selected. According to the rotation speed of the power output shaft 122 of the lifting driver 121, the sixth magnet 147 with a specific magnetic force is selected to ensure that the floating shaft sleeve 1441 is stably connected with the power output shaft 122 of the lifting driver 121.

Further, the driving assembly further includes a housing 123, and the lifting assembly 14 further includes a damping member 146 located between the second shaft sleeve portion 142 and the housing 123.

The damping member 146 is made of a flexible material.

It may be understood that in the present application, the damping member 146 is disposed between the second shaft sleeve portion 142 and the housing 123, so as to avoid a friction between the second shaft sleeve portion 142 and the housing 123 and prolong the service life of the second shaft sleeve portion 142, meanwhile, the damping member 146 is made of a flexible material, which results in a friction between the damping member 146 and the housing 123, plays a hindering role of hindering the second shaft sleeve portion 142 from reaching the same rotation speed as the first sleeve portion 141, and extends the time for the second shaft sleeve portion 142 to reach the same rotation speed as the first sleeve portion 141, so that no matter how the rotation speed of the power output shaft 122 of the lifting driver 121 is set, as long as the power output shaft 122 rotates normally, it may rotate relative to the second shaft sleeve portion 142, and the cleaning member 131 may ascend or descend under the action of the screw mechanism.

Further, the sweeper cleaning device further includes a sensor (not shown in the drawings) and a controller (not shown in the drawings), and the controller is electrically or wirelessly connected with the lifting driver 121 and the sensor, respectively.

It may be understood that the sensor is used to sense and identify the carpet. When the sensor senses the existence of the carpet, the sensor sends a feedback signal to the controller, after receiving the feedback signal, the controller sends a control instruction to the lifting driver 121 according to the feedback result to control the lifting driver 121 to stop operating, and the screw mechanism is subjected to the second driving force of the elastic element 145 to drive the cleaning member 131 to perform an ascending motion relative to the lifting driver 121, further to perform avoidance operations on the carpet.

To sum up, when the sweeper operates normally, the controller sends the control instruction to the lifting driver 121, and the lifting driver 121 drives the power output shaft 122 to rotate according to the control instruction, thereby drives the first shaft sleeve 141 to rotate, and further controls the rib 1411 on the first shaft sleeve 141 to rotate along the thread groove 1421, meanwhile, under the action of the damping member 146, a relative displacement occurs between the first sleeve 141 and the second shaft sleeve portion 142, the cleaning member 131 descends in the vertical direction, and the dishcloth on the cleaning member 131 contacts the floor to mop the floor, while the elastic element 145 is in a stretched state; and when the sensor senses the existence of carpet, the sensor sends the feedback signal to the controller, and after receiving the feedback signal, the controller sends a control instruction to the lifting driver 121 according to the feedback result, so as to control the lifting driver 121 to stop operating, thereby stop the stretching operation of the elastic element 145, under the action of the second driving force of the elastic element 142, the rib 1411 rotates along the thread groove 1421 again, and meanwhile, under the action of the damping element 146, a relative displacement occurs between the first shaft sleeve 141 and the second shaft sleeve portion 142 again, and the cleaning member 131 ascends in the vertical direction and disengages from the floor, thereby realizes the elevating function of the dishcloth on the cleaning member 131, and further to perform avoidance operations on the carpet;

or, when the sweeper finishes operating, the controller sends a control instruction to the lifting driver 121 to control the lifting driver 121 to stop operating, so as to stop the stretching operation of the elastic element 145, under the action of the second driving force of the elastic element 142, the rib 1411 rotates along the thread groove 1421 again, and meanwhile, under the action of the damping member 146, a relative displacement occurs between the first shaft sleeve 141 and the second shaft sleeve portion 142 again, and the cleaning member 131 ascends in the vertical direction and disengages from the floor, thereby realizes the elevating function of the dishcloth on the cleaning member 131 to prevent the cleaning member 131 from causing secondary pollution to the cleaned floor.

The present application also relates to a sweeper, which including a chassis 11; and a sweeper cleaning device as mentioned above, the sweeper cleaning device is installed on the chassis 11.

It should be understood that the above embodiments are only illustrative of part of the present application, and are not used to limit the scope of the present application.

In combination with FIG. 33 to FIG. 38, the present application relates to a cleaning mechanism of a sweeper, which includes: a rotary driving module 110 including a rotary driver 111;

a cleaning module 13, which includes a cleaning tray 131 connected with a power output shaft 112 of the rotary driver 111; and a lifting module 130, which includes an elevating driver 1310 and a lifting block 13200, the lifting block 13200 is connected with the rotary driver 111, and a bolt lifting structure is formed between the lifting block 13200 and an output shaft of the elevating driver 1310; the lifting block 13200 is subjected to a first driving force of the output shaft of the elevating driver 1310 to drive the cleaning tray 131 to perform an ascending motion.

It may be understood that in the present application, the first driving force of the output shaft of the elevating driver drives the cleaning tray to move in a vertical direction by using the lifting block, so that the structure is simple, the cost is relative low, a carpet may be prevented from being polluted by the cleaning tray, and the carpet may be effectively protected; meanwhile, the cleaning tray may be prevented from causing secondary pollution to the cleaned floor after the sweeper finishes cleaning, and the cleaning effect of the sweeper is improved.

Further, the bolt lifting structure includes a bolt portion 1371 and the lifting block 13200; and the bolt portion 137 is connected with the output shaft of the elevating driver 1310, and has a first inclined surface 13711.

A first tapered groove 1321 is provided within the lifting block 13200, the first tapered groove 1321 has a second inclined surface 13211, and the first inclined surface 13711 is mated with the second inclined surface 13211 to realize an ascending and a descending of the lifting block 13200.

It may be understood that the elevating driver 1310 drives the bolt portion 1371 to approach or move away from the first tapered groove 1321, and then controls the first inclined surface 13711 and the second inclined surface 13211 to approach to or move away from each other, so as to finally realize the ascending and descending of the lifting block 13200.

Further, the lifting block 13200 is connected with the case 113 of the rotary driver 111 or the lifting block 13200 is connected with the power output shaft 112 of the rotary driver 111.

Specifically, in an embodiment of the present application, the lifting block 13200 is connected with the power output shaft 112 of the rotary driver 111.

It may be understood that the lifting block 13200 is connected with the power output shaft 112 of the rotary driver 111, and the power output shaft 112 of the rotary driver III is connected with the cleaning tray 131, so that the elevating driver 1310 may drive the cleaning tray 131 to perform an ascending motion through the lifting block 13200 and the power output shaft 112.

Further, the power output shaft 112 of the rotary driver III is at least one, and the lifting block 13200 is at least one;

At least one lifting block 13200 is connected with the power output shaft 112 of at least one rotary driver 111 in one-to-one correspondence; or, one lifting block 13200 is connected with the power output shaft 112 of at least one rotary driver 111 through a connection rod structure.

Figure 33:
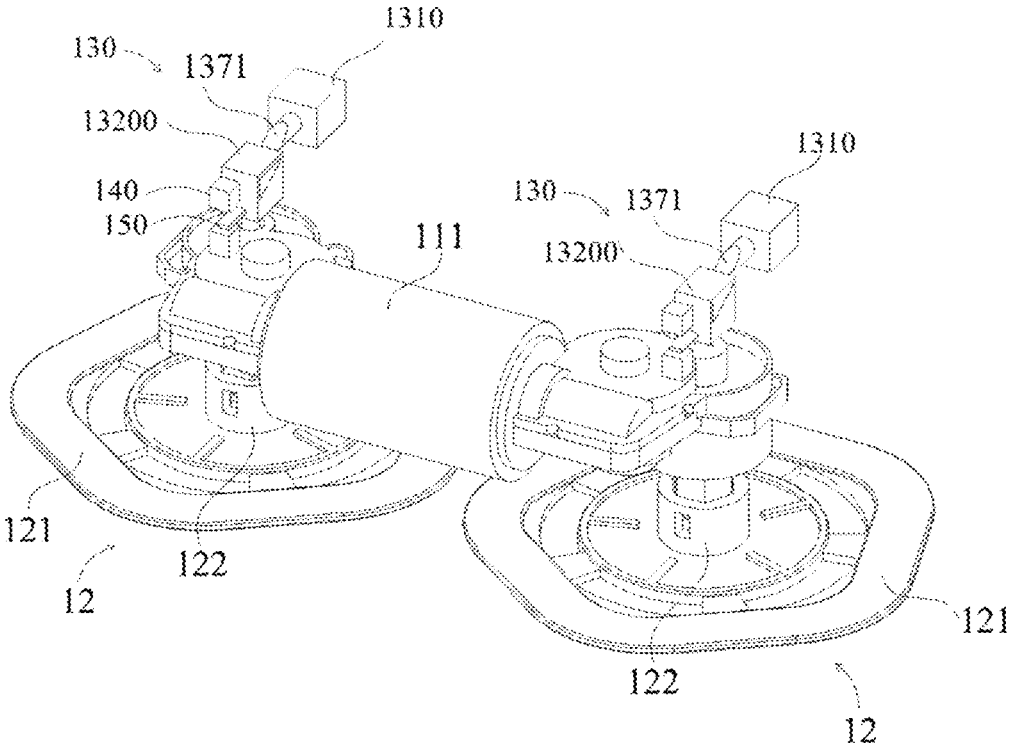
FIG. 33 is a perspective structural diagram of one embodiment of the present application.
Figure 34:
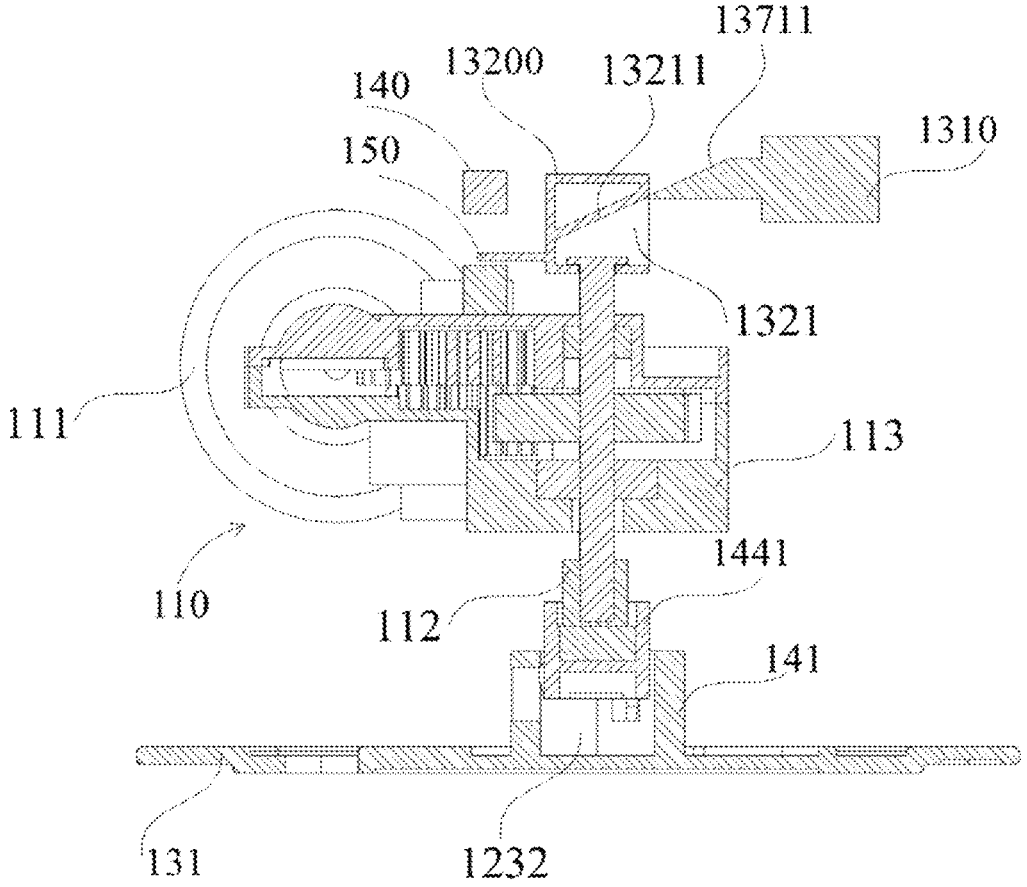
FIG. 34 is an exploded structural diagram of one embodiment of the present application.
Figure 35:
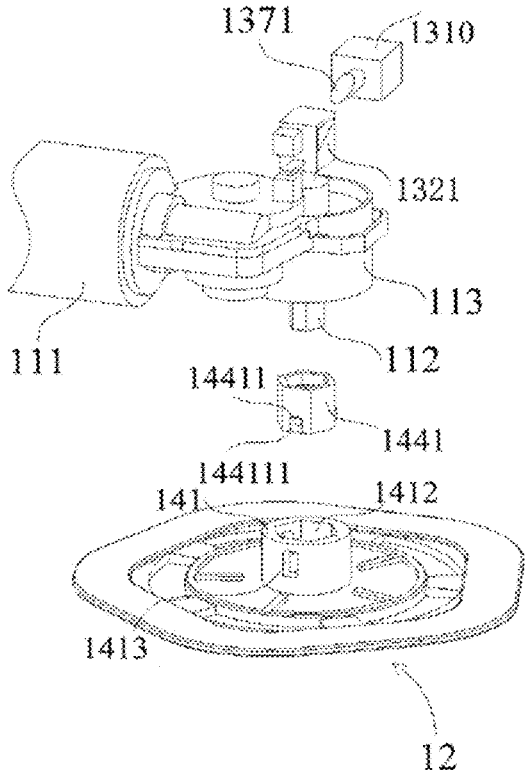
FIG. 35 is a cross-sectional view of one embodiment of the present application.
Figure 36:
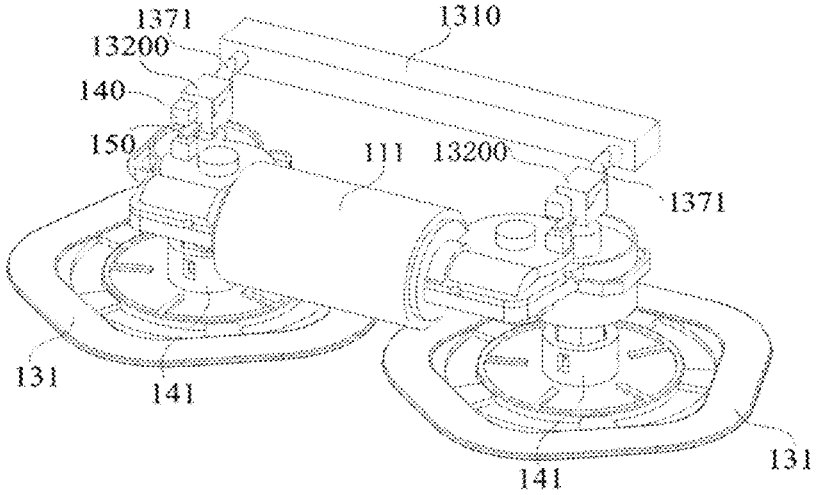
FIG. 36 is a perspective structural diagram of sill another embodiment of the present application.

Specifically, in combination with FIG. 33 to FIG. 35 again, in a specific first embodiment of the present application, the elevating driver 1310 is at least one, the lifting block 13200 is at least one, the bolt portion 1371 is at least one, and the power output shaft 112 of the rotary driver 111 is at least one.

The output shaft of each elevating driver 1310 is connected with a corresponding bolt portion 1371, each lifting block 13200 is connected with a corresponding power output shaft 112 of the rotary driver 111, and each elevating driver 1310 realizes an ascending and a descending of a corresponding lifting block. 13200 by the mating of the first inclined surface 13711 and the second inclined surface 13211, and further realizes an ascending and a descending of the power output shaft 112 of a corresponding rotary driver 111, and finally realizes the ascending and descending of a corresponding cleaning tray 131, so that the independent control of a single elevating driver 1310 to a single cleaning tray 131, each cleaning tray 131 may be independently controlled to ascend and descend, which is convenient for accurate control for each cleaning tray 131.

In combination with FIG. 36 again, in the specific second embodiment of the present application, one elevating driver 121 is disposed, and the elevating driver 121 includes at least one output shaft, the lifting block 13200 is at least one, the bolt portion 1371 is at least one, and the power output shaft 112 of the rotary driver 111 is at least one.

Each output shaft is connected with a corresponding bolt portion 1371, each lifting block 13200 is connected with the power output shaft 112 of a corresponding rotary driver 111, and each bolt portion 1371 is mated with one corresponding lifting block 13200; and a plurality of output shafts of the elevating driver 1310 realizes a synchronous ascending and descending of the multiple lifting blocks 13200 by the mating of the first inclined surface 13711 and the second inclined surface 13211, further realizes an ascending and a descending of a plurality of power output shafts 112, and finally realizes a synchronous ascending and descending of the plurality of cleaning trays 131, so as to realize the overall synchronous control for the multiple cleaning trays 131 by a single elevating driver 1310, which reduces occupied space of the lifting module 130, and simultaneously improves the lifting efficiency of the cleaning tray 131.

Figure 37:
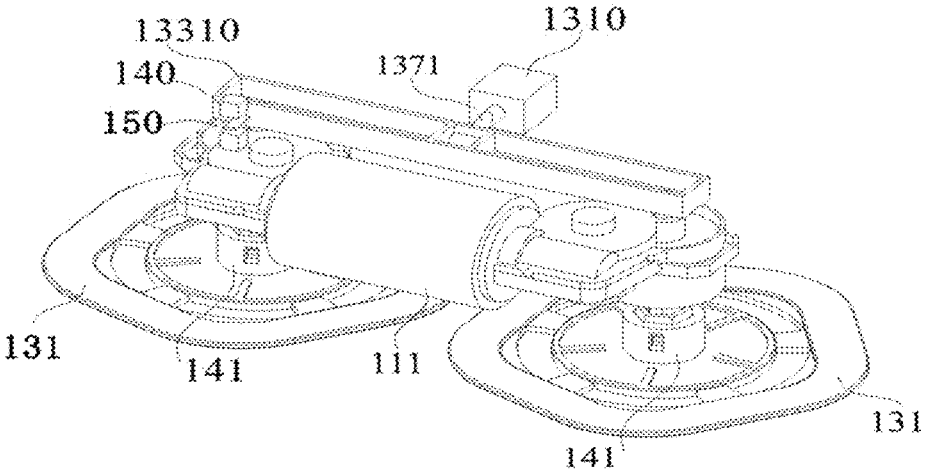
FIG. 37 is a perspective structural diagram of yet another embodiment of the present application.
Figure 38:
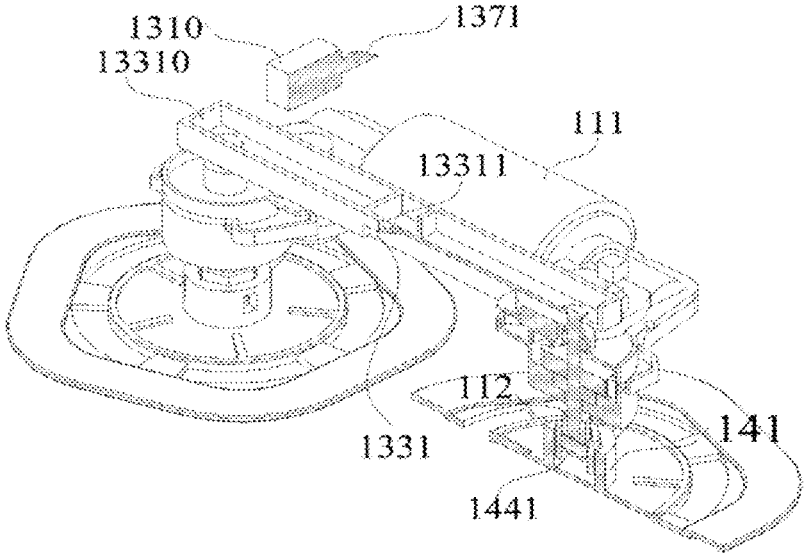
FIG. 38 is a cross-sectional view of still yet another embodiment of the present application.
Figure 39:
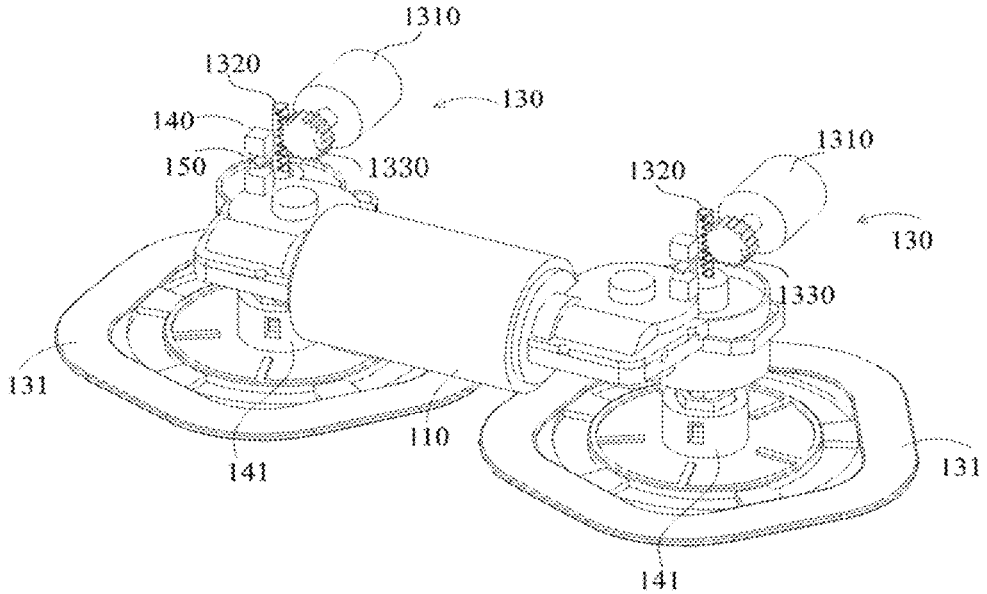
FIG. 39 is a perspective structural diagram of the first embodiment of the present application.
Figure 40:
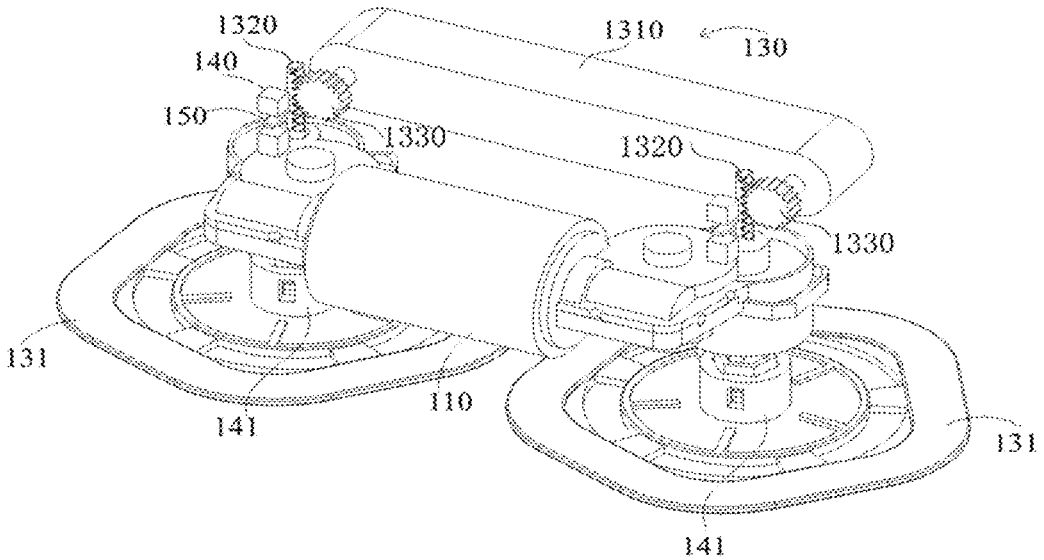
FIG. 40 is a perspective structural diagram of the second embodiment of the present application.
Figure 41:
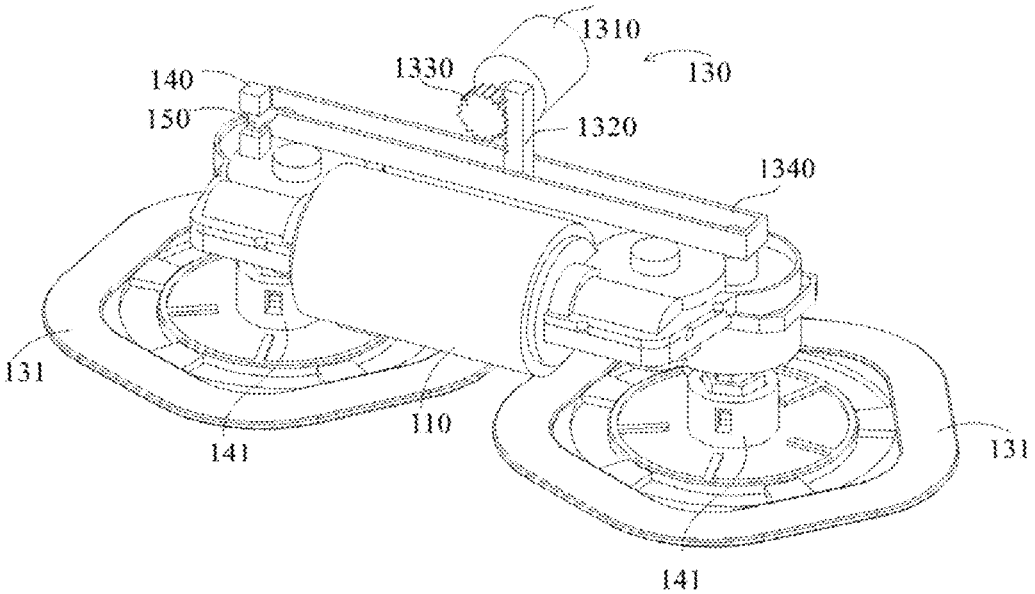
FIG. 41 is a perspective structural diagram of the third embodiment of the present application.
Figure 42:
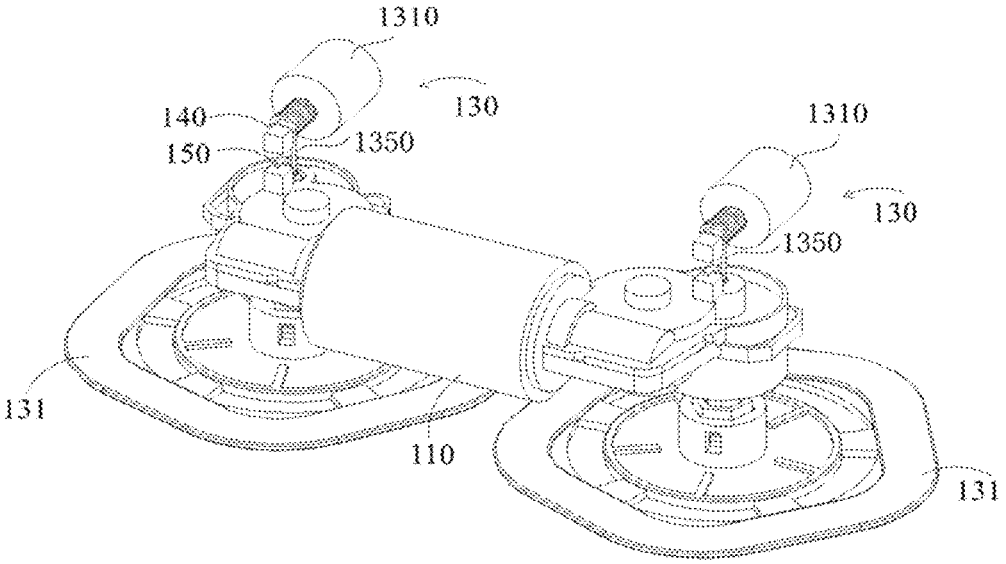
FIG. 42 is a perspective structural diagram of a fourth embodiment of the present application.
Figure 43:
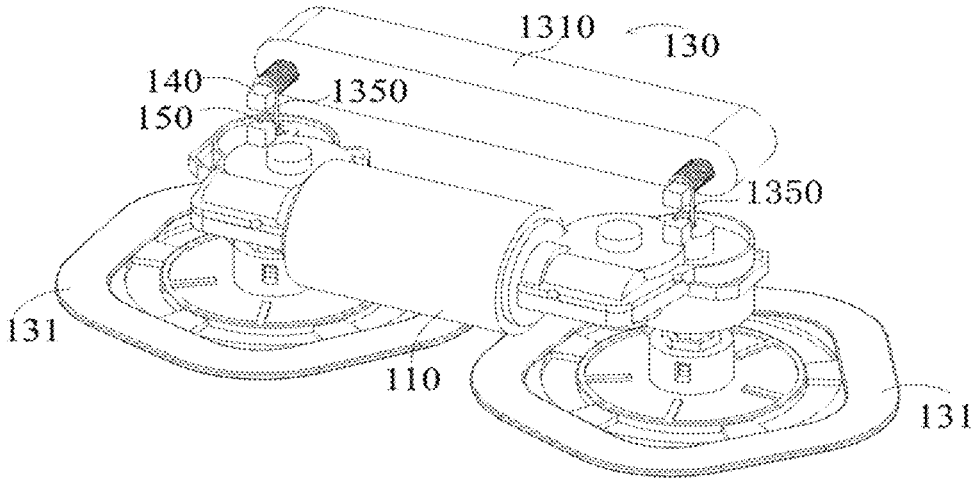
FIG. 43 is a perspective structural diagram of a fifth embodiment of the present application.
Figure 44:
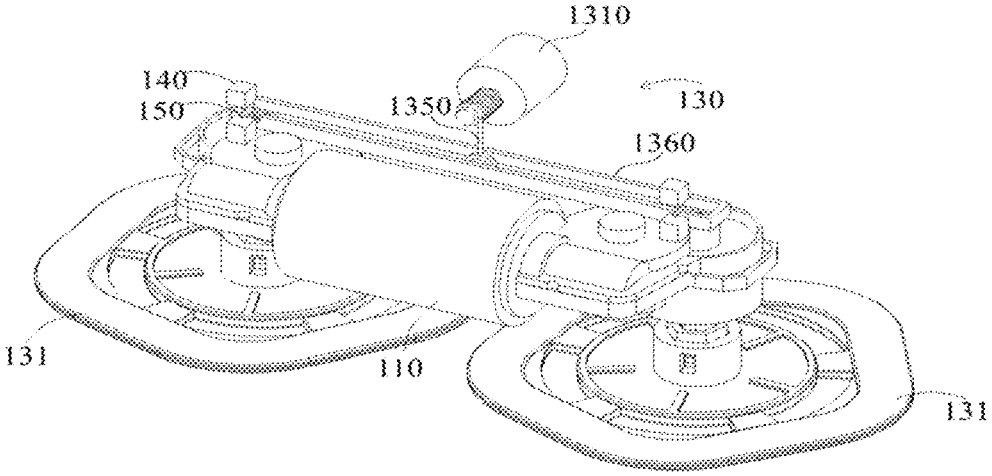
FIG. 44 is a perspective structural diagram of a sixth embodiment of the present application.

In combination with FIG. 37 and FIG. 38 again, in a specific third embodiment of the present application, the elevating driver 1310 is one, the bolt portion 1371 is one, and the power output shaft 112 of the rotary driver 111 is at least one.

Each of the power output shafts 112 is connected through a third connection rod 13310, and a second tapered groove 1331 is provided within the third connection rod 13310, and the second tapered groove 1331 has a third inclined surface 13311, the third inclined surface 13311 is adapted with the first inclined surface 13711, and the output shaft is connected with the bolt portion 1371; and the output shaft of the elevating driver 1310 realizes an ascending and a descending of the third connection rod 13310 through the mating of the third inclined surface 13311 and the first inclined surface, then realizes the ascending and the descending of a plurality of power output shafts 112, and finally realizes the synchronous ascending and descending of a plurality of cleaning trays 131, so as to realize the overall synchronous control for the plurality of cleaning trays 131 through a single elevating driver 1310, which reduces the occupied space of the lifting module 130, and simultaneously improves the lifting efficiency of the cleaning tray 130.

Further, the cleaning module 13 further includes a first sleeve portion 141, a floating shaft sleeve 1441 and a floating element, and the first sleeve portion 141 is fixedly connected or integrally formed with the cleaning tray 131, and the first sleeve portion 141 includes a first embedded groove 1412;

the floating shaft sleeve 1441 is disposed within the first embedded groove 1412, and the floating shaft sleeve 1441 is connected with the first sleeve portion 141, and an end of the floating shaft sleeve 1441 far away from the first sleeve portion 141 is fixedly connected with the power output shaft 112; and a first floating cavity 1442 is defined between the floating shaft sleeve 1441 and the first sleeve portion 141, and the floating element is located within the first floating cavity 1442.

It may be understood that the floating element is disposed between the floating shaft sleeve 1441 and the first sleeve portion 141, so as to increase the pressure between the cleaning tray 131 and the floor, and improve the cleaning effect of the cleaning tray 131, meanwhile, the cleaning tray 131 may float correspondingly with different terrain of the floor, so that the cleaning tray 131 may be closely attached to the uneven floor, the sweeper may be adapted to different terrain, which further improves the cleaning effect, and enhances the obstacle-crossing function of the cleaning tray 131.

Meanwhile, the pressure range of the floating element is 5 N-10 N, and a floating stroke of the cleaning member 131 may be specifically set according to the actual situation.

Further, that floating element is at least one of a spring, a torsion spring, a shrapnel, an elastic ball, a pneumatic support and a hydraulic support.

In one embodiment of the present application, the floating element is a spring, in another embodiment of the present application, the floating element is a torsion spring, and in yet another embodiment of the present application, the floating element is a shrapnel.

The specific setting of the floating element may be selected by the workers according to the actual situation.

Further, the floating shaft sleeve 1441 further includes at least one third limit portion 14411, and the first sleeve portion 141 further includes at least one first limit groove 1413, and the third limit portion 14411 is mated with the first limit groove 1413 in one-to-one correspondence.

It may be understood that the floating shaft sleeve 1441 and the first shaft sleeve 141 are limited and fixed by the mating of the third limit portion 14411 and the first limit groove 1413.

In an embodiment of the present application, a side end of the third limit portion 14411 is provided with a guide surface 144111, the guide surface 144111 is a transitional structure of the third limit portion 14411. When the floating shaft sleeve 1441 is installed, the guide surface 144111 may guide the third limit portion 14411 to slide to the first limit groove 1413, so as to facilitate to sleeve the floating shaft sleeve 145 within the first embedded groove 1412.

Further, a cross section of the floating shaft sleeve 1441 perpendicular to an axial direction is in a polygonal shape, and the first embedded groove 1412 is a polygonal groove mated with the floating shaft sleeve 1441.

In a specific embodiment of the present application, the cross section of the floating shaft sleeve 1441 perpendicular to the axial direction is in a quadrangular shape, and the first embedded groove 1412 is in a quadrangular shape mated with the floating shaft sleeve 1441; in another specific embodiment of the present application, the cross section of the floating shaft sleeve 1441 perpendicular to the axial direction is in a pentagonal shape, and the first embedded groove 1412 is in a pentagonal shape mated with the floating shaft sleeve 1441; and in yet another specific embodiment of the present application, the cross section of the floating shaft sleeve 1441 perpendicular to the axial direction is in a hexagonal shape, and the first embedded groove 1412 is in a hexagonal shape mated with the floating shaft sleeve 1441.

The specific setting of the cross sections of the floating shaft sleeve 1441 and the first embedded groove 1412 perpendicular to the axis direction may be selected by the workers according to the actual situation.

It may be understood that the polygonal floating shaft sleeve 1441 and the first embedded groove 1412 are a limit structure, and the mating of the floating shaft sleeve 1441 and the first embedded groove 1412 is used to relatively limit and fix a lower portion of the floating shaft sleeve 1441 and the first sleeve portion 141, so that the lower portion of the floating shaft sleeve 1441 is firmly embedded with the first sleeve portion 141.

Further, the cleaning mechanism of the sweeper further includes a sensor 140, and the sensor 140 is connected with the elevating driver 1310.

In an embodiment of the present application, the sensor 140 is a position sensor;

the cleaning mechanism of the sweeper further includes a sensing piece 150; and specifically, the sensing piece 150 is disposed on the case 113; or, the sensing piece 150 is disposed on the rotary driving shaft 112; or, the sensing piece 150 is disposed on the lifting block 13200.

The specific setting of the position of the sensing piece 150 may be selected by the workers according to the actual situation.

In an embodiment of the present application, the sensing piece 150 is disposed on the lifting block 13200.

The position of the cleaning tray 131 in the vertical direction may be monitored in real time through the mating of the sensing piece 150 and the sensor 140, so that the position of the cleaning tray 131 may be easily adjusted and controlled.

The present application also relates to a sweeper, which includes a cleaning mechanism of a sweeper as described above.

It should be understood that the above embodiments are only illustrative of part of the present application, and are not used to limit the scope of the present application.

In combination with FIG. 39 to FIG. 46, the present application relates to a liftable sweeper cleaning mechanism, which includes a rotary driving module 110 including a rotary driver 111 and a rotary driving shaft 112 in transmission connection with a power output end of the rotary driver 111;

a cleaning tray 131, which is mated with the rotary driving shaft 112; and a lifting module 130, which includes an elevating driver 1310 mated with the rotary driving module 110; and a lifting structure, which is formed between the elevating driver 1310 and the rotary driving module 110.

It may be understood that the elevating driver 1310 drives the rotary driving module 110 to ascend and descend in a vertical direction through the lifting structure, thereby realizes the ascending and the descending of the cleaning tray 131 in the vertical direction, which may prevent the cleaning tray from polluting a carpet and effectively protect the carpet, and meanwhile, may prevent the cleaning tray from causing secondary pollution to the cleaned floor after the sweeper finishes cleaning, and improve the cleaning effect of the sweeper.

Further, the lifting structure includes a rack 1320 and a gear 1330 mated with the rack 1320; and the rack 1320 is connected with the rotary driving shaft 112, and the gear 1330 is connected with the power output end of the elevating driver 1310.

It may be understood that the elevating driver 1310 drives the gear 1330 to rotate in a forward direction or in a reverse direction, and then drives the rack 133 to ascend and descend in a vertical direction through the mating of the gear 1330 and the rack 1320, further drives the rotary driving shaft 112 to ascend and descend in the vertical direction, and finally drives the cleaning tray 131 to ascend and descend in the vertical direction, so as to realize the lifting operation of the cleaning tray 131, which may prevent the cleaning tray from polluting the carpet, and may effectively protect the carpet, and meanwhile, may prevent the cleaning tray from causing secondary pollution to the cleaned floor after the sweeper finishes cleaning, and improve the cleaning effect of the sweeper.

Further, the elevating driver 1310 is not less than one, the rotary driving shaft 112 is at least one, and the rack 1320 is at least one; and at least one rack 1320 is connected with at least one rotary driving shaft 112 in one-to-one correspondence; or, one rack 1320 is connected with at least one rotary driving shaft 112 through a first connection rod 1340.

Specifically, in combination with FIG. 39 again, in a specific first embodiment of the present application:

the elevating driver 1310 is at least one, the rack 1320 is at least one, the gear 1330 is at least one, and the rotary driving shaft 112 of the rotary driver 111 is at least one, the elevating driver 1310 is at least one, the rack 1320 is at least one, the gear 1330 is at least one, and the rotary driving shaft 112 of the rotary driver 111 is at least one, the output shaft of each elevating driver 1310 is connected with a corresponding gear 1330, each rack 1320 is connected with the rotary driving shaft 112 of a corresponding rotary driver 111, and each elevating driver 1310 realizes an ascending and a descending of the rotary driving shaft 112 of a corresponding rotary driver 111 by the mating of the gear 1330 and the rack 1320, and finally realizes the ascending and the descending of a corresponding cleaning tray 131, so that the independent control of a single elevating driver 1310 to a single cleaning tray 131, and each cleaning tray 131 may be independently controlled to ascend and descend, which is convenient for accurate control for each cleaning tray 131.

Specifically, in combination with FIG. 40 again, in a specific second embodiment of the present application:

there is one lifting driver 121, and the lifting driver 121 includes at least one output shaft, the rack 1320 is at least one, the gear 1330 at least one, and the rotary driving shaft 112 of the rotary driver 111 is at least one.

Each output shaft is connected with a corresponding gear 1330, and each rack 1320 is connected with the rotary driving shaft 112 of a corresponding rotary driver 111.

A plurality of output shafts of the elevating driver 1310 realize the ascending and the descending of the plurality of rotary driving shafts 112 through the mating of the rack 1320 and the gear 1330, and finally realize the synchronous ascending and descending of a plurality of cleaning trays 131, so as to realize the overall synchronous control for the plurality of cleaning trays 131 by a single elevating driver 1310, which reduces the occupied space of the lifting module 130, and meanwhile, improves the lifting efficiency of the cleaning trays 131.

Specifically, in combination with FIG. 41 again, in a specific third embodiment of the present application:

the elevating driver 1310 is one, the rack 1320 is one, the gear 1330 is one, and the rotary driving shaft 112 of the rotary driver 111 is at least one.

The rack 1320 is connected with at least one rotary driving shaft 112 through a first connection rod 1340; and the output shaft of the elevating driver 1310 realizes the ascending and the descending of the first connection rod 1340 through the mating of the rack 1320 and the gear 1330, and then realizes the ascending and the descending of a plurality of rotary driving shafts 112, and finally realizes the synchronous ascending and descending of a plurality of cleaning trays 131, so as to realize the overall synchronous control for the plurality of cleaning trays 131 by a single elevating driver 1310, which reduces the occupied space of the lifting module 130, and simultaneously improves the lifting efficiency of the cleaning trays 131.

Further, the rack 1320 is disposed in a central area of the first connection rod 1340, and distances from the rack. 1320 to each rotary driving shaft 112 are equal.

Further, the lifting structure includes a flexible rope 1350 and a power output shaft of the elevating driver 1310. One end of the flexible rope 1350 is connected with the rotary driving shaft 112, and the other end of the flexible rope 1350is connected with the power output shaft of the elevating driver 1310.

It may be understood that the elevating driver 1310 drives the power output shaft to rotate in a forward direction or in a reverse direction, then drives the rotary driving shaft 112 to ascend and descend in a vertical direction through the flexible rope 1350, and finally drives the cleaning tray 131 to ascend and descend in the vertical direction, so as to realize the lifting operation of the cleaning tray 131, which may prevent the cleaning tray from polluting a carpet, may effectively protect the carpet, simultaneously prevent the cleaning tray from causing secondary pollution the cleaned floor after the sweeper finishes cleaning, and improve the cleaning effect of the sweepe.

Further, the elevating driver 1310 is at least one, the rotary driving shaft 112 is at least one, and the flexible rope 1350 is at least one;

at least one flexible rope 1350 is connected with at least one rotary driving shaft 112 in one-to-one correspondence; or, one flexible rope 1350 is connected with at least one rotary driving shaft 112 through a second connection rod 1360.

Specifically, in combination with FIG. 42 again, in a specific fourth embodiment of the present application:

the elevating driver 1310 is at least one, the flexible rope 1350 is at least one, and the rotary driving shaft 112 of the rotary driver 111 is at least one.

The output shaft of each elevating driver 1310 is connected with one end of a corresponding flexible rope 1350, and the other end of each flexible rope 1350 is connected with the rotary driving shaft 112 of a corresponding rotary driver 111. Each elevating driver 1310 realizes the ascending and the descending of the rotary driving shaft 112 of a corresponding rotary driver 111 through the flexible rope 1350, and finally realizes the ascending and the descending of a corresponding cleaning tray 131, so that realizes the independent control of a single elevating driver 1310 to a single cleaning tray 131, and each cleaning tray 131 may be independently controlled to ascend and descend, which is convenient for accurate control for each cleaning tray 131.

Specifically, in combination with FIG. 43 again, in a specific fifth embodiment of the present application:

there is one lifting driver 121 is disposed, and the lifting driver 121 includes at least one output shaft, the flexible rope 1350 is at least one, and the rotary driving shaft 112 of the rotary driver III is at least one.

Each output shaft is connected with one end of a corresponding flexible rope 1350, and the other end of each flexible rope 1350 is connected with the rotary driving shaft 112 of a corresponding rotary driver 111; and a plurality of output shafts of the elevating driver 1310 realize the ascending and the descending of a plurality of rotary driving shafts 112 through the flexible rope 1350, and finally realize the synchronous ascending and descending of a plurality of cleaning trays 131, so as to realize the overall synchronous control for a plurality of cleaning trays 131*by* a single elevating driver 1310, which reduces the occupied space of the lifting module 130, and simultaneously improves the lifting efficiency of the cleaning trays 131.

Specifically, in combination with FIG. 44 again, in a specific sixth embodiment of the present application:

the elevating driver 1310 is one, the flexible rope 1350 is one, and the rotary driving shaft 112 of the rotary driver 111 is at least one.

The flexible rope 1350 is connected with at least one rotary driving shaft 112 through a second connection rod 1360.

The output shaft of the elevating driver 1310 realizes the ascending and the descending of the second connection rod 1360 through the mating of the flexible rope 1350, and then realizes the ascending and the descending of a plurality of rotary driving shafts 112, and finally realizes the synchronous ascending and descending of a plurality of cleaning trays 131, so as to realize the overall synchronous control for the plurality of cleaning trays 131 by a single elevating driver 1310, which reduces the occupied space of the lifting module 130, and simultaneously improves the lifting efficiency of the cleaning trays 131.

Further, a connection point between the flexible rope 1350 and the second connection rod 1360 is located in a central area of the second connection rod 1360, and distances from the connection point to each rotary driving shaft 112 are equal.

Further, the liftable sweeper cleaning mechanism further includes a sensor 140, and the sensor 140 is electrically connected with the elevating driver 1310.

In an embodiment of the present application, the sensor 140 is a position sensor;

the liftable sweeper cleaning mechanism further includes a sensing piece 150;

specifically, the sensing piece 150 is disposed on the case 113; or, the sensing piece 150 is disposed on the rotary driving shaft 112; or, the sensing piece 150 is disposed on the rack 1320; or, the sensing piece 150 is disposed on the flexible rope 1350, or the sensing piece 150 is disposed on the first connection rod 1340; or, the sensing piece 150 is disposed on the second connection rod 1360; and the specific setting of the position of the sensing piece 150 may be selected by the workers according to the actual situation.

In a specific first embodiment and a specific second embodiment of the present application, the sensing piece 150 is disposed on the rack 1320; in a specific third embodiment of the present application, the sensing piece 150 is disposed on the first connection rod 1340; in a specific fourth embodiment and a specific fifth embodiment of the present application, the sensing piece 150 is disposed on the rotary driving shaft 112; and in a specific sixth embodiment of the present application, the sensing piece 150 is disposed on the second connection rod 1360.

The position of the cleaning tray 131 in the vertical direction may be monitored in real time through the mating of the sensor 150 and the sensor 140, so that the position of the cleaning tray 131 may be easily adjusted and controlled.

Figure 45:
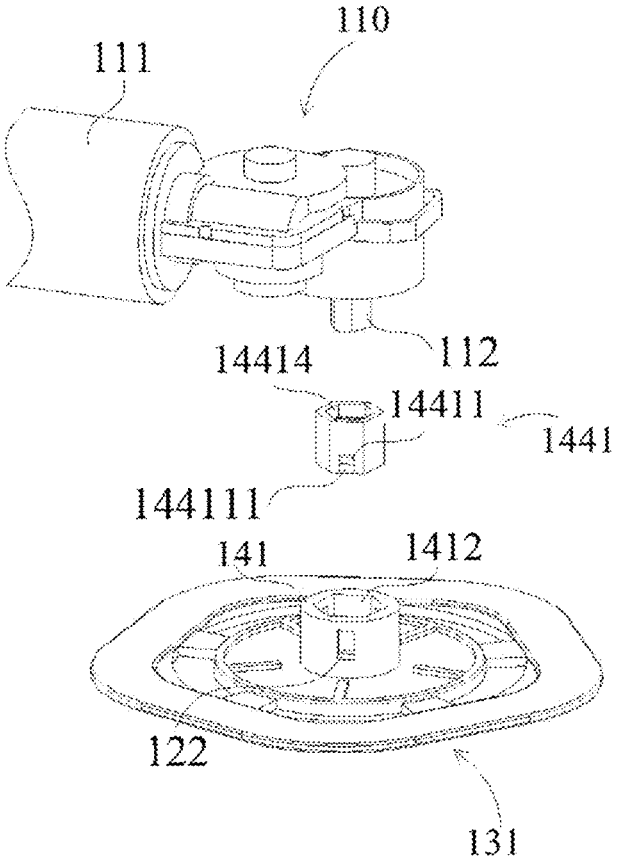
FIG. 45 is an exploded structural diagram of a cleaning mechanism of the present application.
Figure 46:
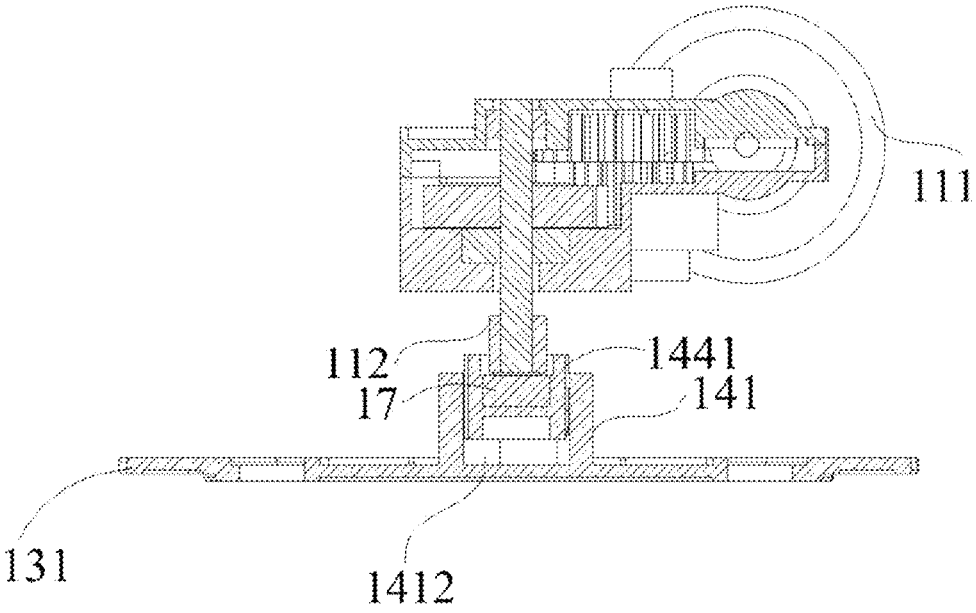
FIG. 46 is a cross-sectional view of a cleaning mechanism of the present application.
Figure 47:
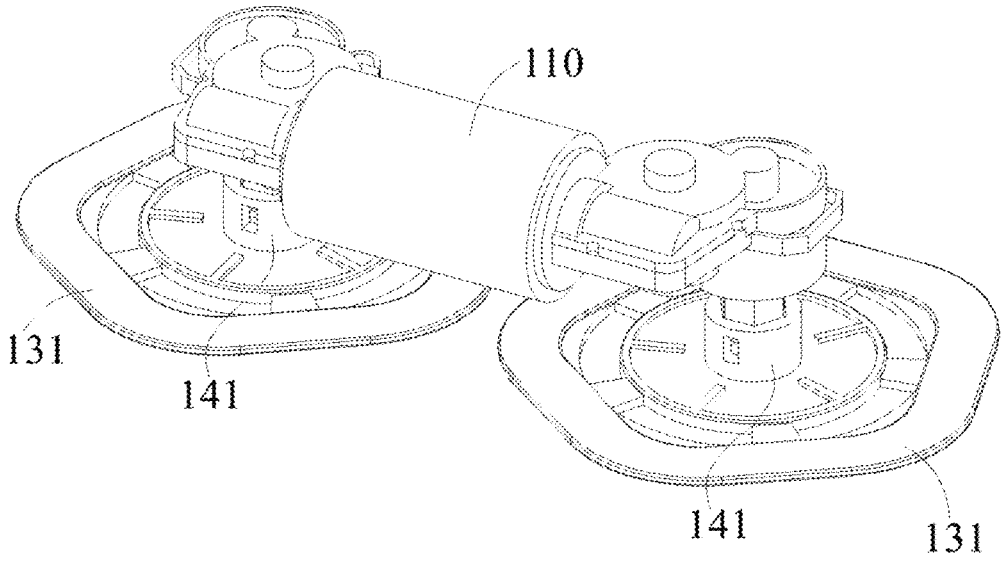
FIG. 47 is a perspective structural diagram of a cleaning mechanism of a sweeper of the present application.

In an embodiment of the present application, in combination with FIG. 45 and FIG. 46 again, the liftable sweeper cleaning mechanism further includes a floating shaft sleeve 1441, and the rotary driving shaft 112 is connected with the first sleeve portion 141 through the floating shaft sleeve 1441.

Further, a first embedded groove 1412 is provided inside the first sleeve portion 141, and a cross section of the first embedded groove 1412 is in a polygonal shape;

a cross section of the floating shaft sleeve 1441 is in a polygonal shape, and a lower portion of the floating shaft sleeve 1441 is embedded within the first embedded groove 1412.

In an embodiment of the present application, the cross section of the first embedded groove 1412 is in a quadrangular shape, and the cross section of the floating shaft sleeve 1441 is in a quadrangular shape; in another embodiment of the present application, the cross section of the first embedded groove 1412 is in a pentagonal shape, and the cross section of the floating shaft sleeve 1441 is in a pentagonal shape; and in yet another embodiment of the present application, the cross section of the first embedded groove 1412 is in a hexagonal shape, and the cross section of the floating shaft sleeve 1441 is in a hexagonal shape;

The specific selection of the shapes of the cross sections of the first embedded groove 1412 and the floating shaft sleeve 1441 may be made according to the actual situation.

It may be understood that the polygonal first embedded groove 1412 and the floating shaft sleeve 1441 are a limit structure, and the mating of the first embedded groove 1412 and the floating shaft sleeve 1441 is used to limit and fix the lower portion of the floating shaft sleeve 1441 relative to the first sleeve portion 141, so that the lower portion of the floating shaft sleeve 1441 is firmly embedded with the first sleeve portion 141.

Further, a first floating cavity 1442 is formed between the floating shaft sleeve 1441 and the first embedded groove 1412;

a floating element is disposed within the first floating cavity 1442, and the floating element is at least one of a spring, a torsion spring, a shrapnel, an elastic ball, a pneumatic support and a hydraulic support.

In an embodiment of the present application, the floating element is a spring, in another embodiment of the present application, the floating element is a torsion spring, and in yet another embodiment of the present application, the floating element is a shrapnel.

The specific setting of the floating element may be selected by the workers according to the actual situation.

It may be understood that by disposing the floating element between the floating shaft sleeve 1441 and the first sleeve portion 141, the pressure between the cleaning tray 131 and the floor is increased, and the cleaning effect of the cleaning tray 131 is improved, meanwhile, the cleaning tray 131 floats correspondingly with different terrain of the floor, the cleaning tray 131 may be closely attached to the uneven floor, the sweeper may be adapted to different terrain, which further improve the cleaning effect, and also enhance the obstacle-crossing function of the cleaning tray 131.

Meanwhile, a pressure range of the floating element is 5 N-10 N, and a floating stroke of the cleaning tray 131 may be specifically set according to the actual situation.

Further, a periphery of the floating shaft sleeve 1441 is arranged with a third limit portion 14411, and a periphery of the first sleeve portion 141 is provided with a first limit groove 1413, and the third limit portion 14411 is adapted to the first limit groove 1413.

It may be understood that the floating shaft sleeve 6 and the first sleeve portion 141 are further limited and fixed by the mating of the third limit portion 14411 and the first limit groove 1413, so that the connection between the floating shaft sleeve 6 and the first sleeve portion 141 is firmer.

Further, a side end of the third limit portion 14411 is provided with a guide surface 144111.

It may be understood that the guide surface 144111 is a transitional structure of the third limit portion 14411, when the floating shaft sleeve 1441 is installed, the guide surface 144111 may guide the third limit portion 14411 to slide to the first limit groove 1413, so as to facilitate sleeve the floating shaft sleeve 1441 within the first sleeve portion 141.

Further, the floating shaft sleeve 1441 is detachably connected with the rotary driving shaft 122.

In an embodiment of the present application, the floating shaft sleeve 1441 and the rotary driving shaft 122 are detachably connected in a snap manner, and in another embodiment of the present application, the floating shaft sleeve 1441 and the rotary driving shaft 122 are detachably connected by magnetic attraction.

Specifically, in an embodiment of the present application, the floating shaft sleeve 1441 and the rotary driving shaft 122 are detachably connected by magnetic attraction.

Further, a top of the floating shaft sleeve 1441 is provided with a third embedded groove 14414, and a cross section of the third embedded groove 14414 is in a polygonal shape; and a cross section of the rotary driving shaft 122 is in a polygonal shape, and a lower portion of the rotary driving shaft 122 is detachably sleeved within the third embedded groove 14414.

In an embodiment of the present application, the cross section of the third embedded groove 14414 is in a quadrangular shape, and the cross section of the rotary driving shaft 122 is in a quadrangular shape; in another embodiment of the present application, the cross section of the third embedded groove 14414 is in a pentagonal shape, and the cross section of the rotary driving shaft 122 is in a pentagonal shape; and in yet another embodiment of the present application, the cross section of the third engaging groove 14414 is in a hexagonal shape, and the cross section of the rotary driving shaft 122 is in a hexagonal shape.

The specific selection of shapes of the cross sections of the third embedded groove 14414 and the rotary driving shaft 122 may be made according to the actual situation.

It may be understood that the polygonal third engaging groove 14414 and the rotary driving shaft 122 are a limit structure, and the mating of the third engaging groove 14414 and the rotary driving shaft 122 is used to relatively limit and fix an upper portion of the floating shaft sleeve 1441 and the rotary driving shaft 122, so that the upper portion of the floating shaft sleeve 1441 is firmly embedded with the rotary driving shaft 122.

Further, a fifth magnet 17 is disposed within the third embedded groove 14414.

In an embodiment of the present application, the fifth magnet 17 is arranged at a bottom of the third embedded groove 1452; in another embodiment of the present application, the fifth magnet 17 is arranged in a circumferential area inside the third embedded groove 1452.

The specific setting of the position of the fifth magnet 17 may be specifically selected by the workers according to the actual situation.

It may be understood that the rotary driving shaft 122 and the floating shaft sleeve 1441 are further limited and fixed by the fifth magnet 17, so that the rotary driving shaft 122 and the floating shaft sleeve 1441 are firmly embedded, and it is convenient to detach and separate the rotary driving shaft 122 and the floating shaft sleeve 1441, and finally it is convenient to detach the cleaning tray 131.

Further, the worker controls initial positions of different cleaning trays 131 by controlling different assembly directions of the rotary driving shaft 122 and the floating shaft sleeve 1441, and the floating shaft sleeve 1441 and the first sleeve portion 141.

In an embodiment of the present application, a rotation speed of the rotary driving shaft 122 driven by the rotary driver 121 is different, and a magnetic force of the fifth magnet 17 is different.

When the rotation speed of the rotary driving shaft 122 driven by the rotary driver 121 is relative high, the fifth magnet 17 with a greater magnetic force may be selected; and when the rotation speed of the rotary driving shaft 122 driven by the rotary driver 121 is relative low, the fifth magnet 17 with a smaller magnetic force may be selected. According to the rotation speed of the rotary driving shaft 122 driven by the rotary driver 121, the fifth magnet 17 with a specific magnetic force is selected to ensure that the floating shaft sleeve 1441 is stably connected with the rotary driving shaft 122.

The present application also relates to a sweeper, which includes the liftable sweeper cleaning mechanism as described above.

In combination with FIG. 39 to FIG. 47, the present application relates to a cleaning mechanism of a sweeper, which includes: a rotary driving module 110, including a rotary driver 111 and a rotary driving shaft 112 connected with the rotary driver 111;

a cleaning tray 131, a top surface of which is arranged with a first sleeve portion 141; and a floating shaft sleeve 1441, through which the rotary driving shaft 112 is connected with the first sleeve portion 141.

It may be understood that in the present application, the rotary driving shaft 112 is connected with the first sleeve portion 141 through the floating shaft sleeve 1441, so that the cleaning tray 131 floats correspondingly with different terrain on the floor, the cleaning tray 131 may be closely attached to the uneven floor, the sweeper may be adapted to different terrain, which further improve the cleaning effect, and also enhance the obstacle-crossing function of the cleaning tray 131.

Further, the first embedded groove 1412 is provided inside the first sleeve portion 141, and a cross section of the first embedded groove 1412 is in a polygonal shape; and the cross section of the floating shaft sleeve 1441 is in a polygonal shape, and the lower portion of the floating shaft sleeve 1441 is embedded in the first embedded groove 1412.

In an embodiment of the present application, the cross section of the first embedded groove 1412 is in a quadrangular shape, and the cross section of the floating shaft sleeve 1441 is in a quadrangular shape; in another embodiment of the present application, the cross section of the first embedded groove 1412 is in a pentagonal shape, and the cross section of the floating shaft sleeve 1441 is in a pentagonal shape; and in yet another embodiment of the present application, the cross section of the first embedded groove 1412 is in a hexagonal shape, and the cross section of the floating shaft sleeve 1441 is in a hexagonal shape; and the specific selection of the cross-sectional shapes of the first embedded groove 1412 and the floating shaft sleeve 1441 may be made according to the actual situation.

It may be understood that the polygonal first embedded groove 1412 and floating shaft sleeve 1441 are a limit structure, and the mating of the first embedded groove 1412 and the floating shaft sleeve 1441 is used to limit and fix the lower portion of the floating shaft sleeve 1441 relative to the first sleeve portion 141, so that the lower portion of the floating shaft sleeve 1441 is firmly embedded with the first sleeve portion 141.

Further, a first floating cavity 1442 is formed between the floating shaft sleeve 1441 and the first embedded groove 1412; and a floating element is disposed within the first floating cavity 1442, and the floating element is at least one of a spring, a torsion spring, a shrapnel, an elastic ball, a pneumatic support and a hydraulic support.

In an embodiment of the present application, the floating element is a spring, in another embodiment of the present application, the floating element is a torsion spring, and in yet another embodiment of the present application, the floating element is a shrapnel.

The specific setting of the floating element may be selected by the workers according to the actual situation.

It may be understood that by disposing a floating element between the floating shaft sleeve 1441 and the first sleeve portion 141, the pressure between the cleaning tray 131 and the floor is increased, and the cleaning effect of the cleaning tray 131 is improved. Meanwhile, the cleaning tray 131 may float correspondingly with different terrain of the floor, the cleaning tray 131 may be closely attached to the uneven floor, the sweeper may be adapted to different terrain, which further improve the cleaning effect, and also enhance the obstacle-crossing function of cleaning tray 131.

Meanwhile, a pressure range of the floating element is 5 N-10 N, and a floating stroke of the cleaning tray 131 may be specifically set according to the actual situation.

Further, a periphery of the floating shaft sleeve 1441 is arranged with a third limit portion 14411, and a periphery of the first sleeve portion 141 is provided with a first limit groove 1413, and the third limit portion 14411 is adapted to the first limit groove 1413.

It may be understood that the floating shaft sleeve 6 and the first sleeve portion 141 are further limited and fixed by the mating of the third limit portion 14411 and the first limit groove 1413, so that the connection between the floating shaft sleeve 6 and the first sleeve portion 141 is firmer.

Further, a guide surface 144111 is disposed at a side end of the third limit portion 14411.

It may be understood that the guide surface 144111 is a transitional structure of the third limit portion 14411, when the floating shaft sleeve 1441 is installed, the guide surface 144111 may guide the third limit portion 14411 to slide to the first limit groove 1413, so as to facilitate to sleeve the floating shaft sleeve 1441 in the first sleeve portion 141.

Further, the floating shaft sleeve 1441 is detachably connected with the rotary driving shaft 122.

In one embodiment of the present application, the floating shaft sleeve 1441 and the rotary driving shaft 122 are detachably connected in a snap manner, and in another embodiment of the present application, the floating shaft sleeve 1441 and the rotary driving shaft 122 are detachably connected by magnetic attraction.

Specifically, in an embodiment of the present application, the floating shaft sleeve 1441 is detachably connected with the rotary driving shaft 122 by magnetic attraction.

Further, a top of the floating shaft sleeve 1441 is provided with a third embedded groove 14414, and a cross section of the third embedded groove 14414 is in a polygonal shape; and a cross section of the rotary driving shaft 122 is in a polygonal shape, and a lower portion of the rotary driving shaft 122 is detachably sleeved in the third embedded groove 14414.

In an embodiment of the present application, the cross section of the third embedded groove 14414 is in a quadrangular shape, and the cross section of the rotary driving shaft 122 is in a quadrangular shape; in another embodiment of the present application, the cross section of the third embedded groove 14414 is in a pentagonal shape, and the cross section of the rotary driving shaft 122 is in a pentagonal shape; and in yet another embodiment of the present application, the cross section of the third embedded groove 14414 is in a hexagonal shape, and the cross section of the rotary driving shaft 122 is in a hexagonal shape.

The specific selection of shapes of the cross sections of the third embedded groove 14414 and the rotary driving shaft 122 may be made according to the actual situation.

It may be understood that the polygonal third engaging groove 14414 and the rotary driving shaft 122 are a limit structure, and the mating of the third engaging groove 14414 and the rotary driving shaft 122 is used to relatively limit and fix an upper portion of the floating shaft sleeve 1441 and the rotary driving shaft 122, so that the upper portion of the floating shaft sleeve 1441 is firmly embedded with the rotary driving shaft 122.

Further, a fifth magnet 17 is disposed in the third embedded groove 14414.

In an embodiment of the present application, the fifth magnet 17 is arranged at a bottom of the third embedded groove 1452; and in another embodiment of the present application, the fifth magnet 17 is arranged in a circumferential area inside the third embedded groove 1452.

The specific setting of the position of the fifth magnet 17 may be specifically selected by the workers according to the actual situation.

It may be understood that the rotary driving shaft 122 and the floating shaft sleeve 1441 are further limited and fixed by the fifth magnet 17, so that the rotary driving shaft 122 and the floating shaft sleeve 1441 are firmly embedded, and it is convenient to detach and separate the rotary driving shaft 122 and the floating shaft sleeve 1441, and finally it is convenient to detach the cleaning tray 131.

Further, the worker controls initial positions of different cleaning trays 131 by controlling different assembly directions of the rotary driving shaft 122 and the floating shaft sleeve 1441, and the floating shaft sleeve 1441 and the first sleeve portion 141.

In an embodiment of the present application, the rotation speed of the rotary driving shaft 122 driven by the rotary driver 121 is different, and the magnetic force of the fifth magnet 17 is different.

When the rotation speed of the rotary driving shaft 122 driven by the rotary driver 121 is relative high, the fifth magnet 17 with a greater magnetic force may be selected; and when the rotation speed of the rotary driving shaft 122 driven by the rotary driver 121 is relative low, the fifth magnet 17 with a smaller magnetic force may be selected. According to the rotation speed of rotary driving shaft 122 driven by the rotary driver 121, the fifth magnet 17 with a specific magnetic force is selected to ensure that the floating shaft sleeve 1441 is stably connected with the rotary driving shaft 122.

In an embodiment of the present application, the cleaning mechanism of the sweeper further includes:

a lifting module 130, which includes an elevating driver 1310 mated with the rotary driving module 110; and a lifting structure is formed between the elevating driver 1310 and the rotary driving module 110.

Further, the lifting structure includes a rack 1320 and a gear 1330 mated with the rack 1320; and the rack 1320 is connected with the rotary driving shaft 112, and the gear 1330 is connected with a power output end of the elevating driver 1310.

It may be understood that the elevating driver 1310 drives the gear 1330 to rotate in a forward direction or in a reverse direction, then drives the rack 133 to ascend and descend in a vertical direction through the mating of the gear 1330 and the rack 1320, further drives the rotary driving shaft 112 to ascend and descend in the vertical direction, and finally drives the cleaning tray 131 to ascend and descend in the vertical direction, so as to realize the lifting operation of the cleaning tray 131, which may prevent the cleaning tray from polluting the carpet, and may be effectively protect the carpet, and meanwhile, may prevent the cleaning tray from causing secondary pollution to the cleaned floor after the sweeper finishes cleaning, and improve the cleaning effect of the sweeper.

Further, the elevating driver 1310 is at least one, the rotary driving shaft 112 is at least one, and the rack 1320 is at least one.

At least one rack 1320 is connected with at least one rotary driving shaft 112 in one-to-one correspondence; or, one rack 1320 is connected with at least one rotary driving shaft 112 through a first connection rod 1340.

Specifically, in combination with FIG. 39 again, in a specific first embodiment of the present application:

the elevating driver 1310 is at least one, the rack 1320 is at least one, the gear 1330 is at least one, and the rotary driving shaft 112 of the rotary driver 111 is at least one.

The output shaft of each elevating driver 1310 is connected with a corresponding gear 1330, each rack. 1320 is connected with the rotary driving shaft 112 of a corresponding rotary driver 111, and each elevating driver 1310 realizes the ascending and the descending of the rotary driving shaft 112 of a corresponding rotary driver 111 by the mating of the gear 1330 and the rack 1320, and finally realizes the ascending and the descending of a corresponding cleaning tray 131, so that an independent control for a single cleaning tray 131 by a single elevating driver 1310, and each cleaning tray 131 may be independently controlled to ascend and descend, which is convenient for accurate control for each cleaning tray 131.

Specifically, in combination with FIG. 40 again, in a specific second embodiment of the present application:

there is one lifting driver 121 is disposed, and the lifting driver 121 includes at least one output shaft, the rack 1320 is at least one, the gear 1330 is at least one, and the rotary driving shaft 112 of the rotary driver 111 is at least one.

Each output shaft is connected with a corresponding gear 1330, and each rack 1320 is connected with the rotary driving shaft 112 of a corresponding rotary driver 111.

A plurality of output shafts of the elevating driver 1310 realize the ascending and the descending of a plurality of rotary driving shafts 112 through the mating of the rack 1320 and the gear 1330, and finally realize the synchronous ascending and descending of the plurality of cleaning trays 131, so as to realize the overall synchronous control for the plurality of cleaning trays 131 by a single elevating driver 1310, which reduce the occupied space of the lifting module 130, and simultaneously improve the lifting efficiency of the cleaning trays 131.

Specifically, in combination with FIG. 41 again, in a specific third embodiment of the present application:

the elevating driver 1310 is one, the rack 1320 is one, the gear 1330 is one, and the rotary driving shaft 112 of the rotary driver 111 is at least one.

The rack 1320 is connected with at least one rotary driving shaft 112 through a first connection rod 1340; and the output shaft of the elevating driver 1310 realizes the ascending and the descending of the first connection rod 1340 through the mating of the rack 1320 and the gear 1330, and then realizes the ascending and the descending of a plurality of rotary driving shafts 112, and finally realizes the synchronous ascending and descending of a plurality of cleaning trays 131, which reduces the occupied space of the lifting module 130, and simultaneously improves the lifting efficiency of the cleaning trays 131.

Further, the rack 1320 is disposed in a central area of the first connection rod 1340, and distances from the rack 1320 to each rotary driving shaft 112 are equa.

Further, the lifting structure includes a flexible rope 1350 and a power output shaft of the elevating driver 1310, one end of the flexible rope 1350 is connected with the rotary driving shaft 112, and the other end of the flexible rope 1350 is connected with the power output shaft of the elevating driver 1310.

It may be understood that the elevating driver 1310 drives the power output shaft to rotate in a forward direction or in a reverse direction, then drives the rotary driving shaft 112 to ascend and descend in a vertical direction through the flexible rope 1350, and finally drives the cleaning tray 131 to ascend and descend in the vertical direction, so as to realize the lifting operation of the cleaning tray 131, which may prevent the cleaning tray from polluting the carpet, may effectively protect the carpet, and simultaneously prevent the cleaning tray from causing the secondary pollution to the cleaned floor after the sweeper finishes cleaning, and improve the cleaning effect of the sweeper.

Further, the elevating driver 1310 is at least one, the rotary driving shaft 112 is at least one, and the flexible rope 1350 is at least one.

At least one flexible rope 1350 is connected with at least one rotary driving shaft 112 in one-to-one correspondence; or, one flexible rope 1350 is connected with at least one rotary driving shaft 112 through a second connection rod 1360.

Specifically, in combination with FIG. 42 again, in a specific fourth embodiment of the present application:

the elevating driver 1310 is at least one, the flexible rope 1350 is at least one, and the rotary driving shaft 112 of the rotary driver 111 is at least one.

The output shaft of each elevating driver 1310 is connected with one end of a corresponding flexible rope 1350, and the other end of each flexible rope 1350 is connected with the rotary driving shaft 112 of a corresponding rotary driver 111, each elevating driver 1310 realizes the ascending and the descending of the rotary driving shaft 112 of a corresponding rotary driver 111 through the flexible rope 1350, and finally realizes the ascending and the descending of a corresponding cleaning tray 131, so that as independent control for a single cleaning tray 131 by a single elevating driver 1310, and each cleaning tray 131 may be independently controlled to ascend and descend, which is convenient for accurate control for each cleaning tray 131.

Specifically, in combination with FIG. 43 again, in a specific fifth embodiment of the present application:

there is one lifting driver 121 is disposed, and the lifting driver 121 includes at least one output shaft, the flexible rope 1350 is at least one, and the rotary driving shaft 112 of the rotary driver 111 is at least one.

Each output shaft is connected with one end of a corresponding flexible rope 1350, and the other end of each flexible rope 1350 is connected with the rotary driving shaft 112 of a corresponding rotary driver 111;

a plurality of output shafts of the elevating driver 1310 realize the ascending and the descending of a plurality of rotary driving shafts 112 through the flexible rope 1350, and finally realize the synchronous ascending and descending of a plurality of cleaning trays 131, so as to realize the overall synchronous control for a plurality of cleaning trays 131 through a single elevating driver 1310, which reduce the occupied space of the lifting module 130, and simultaneously improve the lifting efficiency of the cleaning trays 131.

Specifically, in combination with FIG. 44 again, in a specific sixth embodiment of the present application:

the elevating driver 1310 is one, the flexible rope 1350 is one, and the rotary driving shaft 112 of the rotary driver 111 is at least one.

The flexible rope 1350 is connected with at least one rotary driving shaft 112 through a second connection rod 1360, the output shaft of the elevating driver 1310 realizes the ascending and the descending of the second connection rod 1360 through the mating of the flexible rope 1350, and then realizes the ascending and the descending of a plurality of rotary driving shafts 112, and finally realizes the synchronous ascending and descending of a plurality of cleaning trays 131, so as to realize the overall synchronous control for a plurality of cleaning trays 131 by a single elevating driver 1310, which reduce the occupied space of the lifting module 130, and simultaneously improve the lifting efficiency of the cleaning trays 131.

Further, a connection point between the flexible rope 1350 and the second connection rod 1360 is located in a central area of the second connection rod 1360, and distances from the connection point to each rotary driving shaft 112 are equal.

Further, the cleaning mechanism of the sweeper further includes a sensor 140, and the sensor 140 is electrically connected with the elevating driver 1310.

In an embodiment of the present application, the sensor 140 is a position sensor;

the cleaning mechanism of the sweeper further includes a sensing piece 150;

specifically, the sensing piece 150 is disposed on the case 113; or, the sensing piece 150 is disposed on the rotary driving shaft 112; or, the sensing piece 150 is disposed on the rack 1320; or, the sensing piece 150 is disposed on the flexible rope 1350, or the sensing piece 150 is disposed on the first connection rod 1340; or, the sensing piece 150 is disposed on the second connection rod 1360; and the specific setting of the position of the sensing piece 150 may be selected by the workers according to the actual situation.

In a specific first embodiment and a specific second embodiment of the present application, the sensing piece 150 is disposed on the rack 1320; in a third embodiment of the present application, the sensing piece 150 is disposed on the first connection rod 1340; in a specific fourth embodiment and a specific fifth embodiment of the present application, the sensing piece 150 is disposed on the rotary driving shaft 112; and in a specific sixth embodiment of the present application, the sensing piece 150 is disposed on the second connection rod 1360.

The position of the cleaning tray 131 in the vertical direction may be monitored in real time through the mating of the sensor 150 and the sensor 140, so that the position of the cleaning tray 131 may be easily adjusted and controlled, The present application also relates to a sweeper, which includes a cleaning mechanism of a sweeper as described above.

It should be understood that the above embodiments are only illustrative of part of the present application, and are not used to limit the scope of the present application.

As shown in FIG. 48 to FIG. 51, this embodiment provides a cleaning mechanism, which is applied to cleaning apparatus and includes a cleaning head assembly 3 and an electromagnetic assembly 5.

The cleaning apparatus includes a machine body 100, a cleaning mechanism is suitable for being disposed on the machine body 100, and the cleaning apparatus mops and cleans a cleaning surface through the cleaning mechanism. Where, the cleaning surface usually refers to the floor. In the specific implementation scenario, the cleaning apparatus may be a cleaning robot, such as a mop robot, or a traditional mopping machine, such as a hand-held mopping machine, a hand-propelled mopping machine, or of course a riding mopping machine, and it is not limited here.

Figure 48:
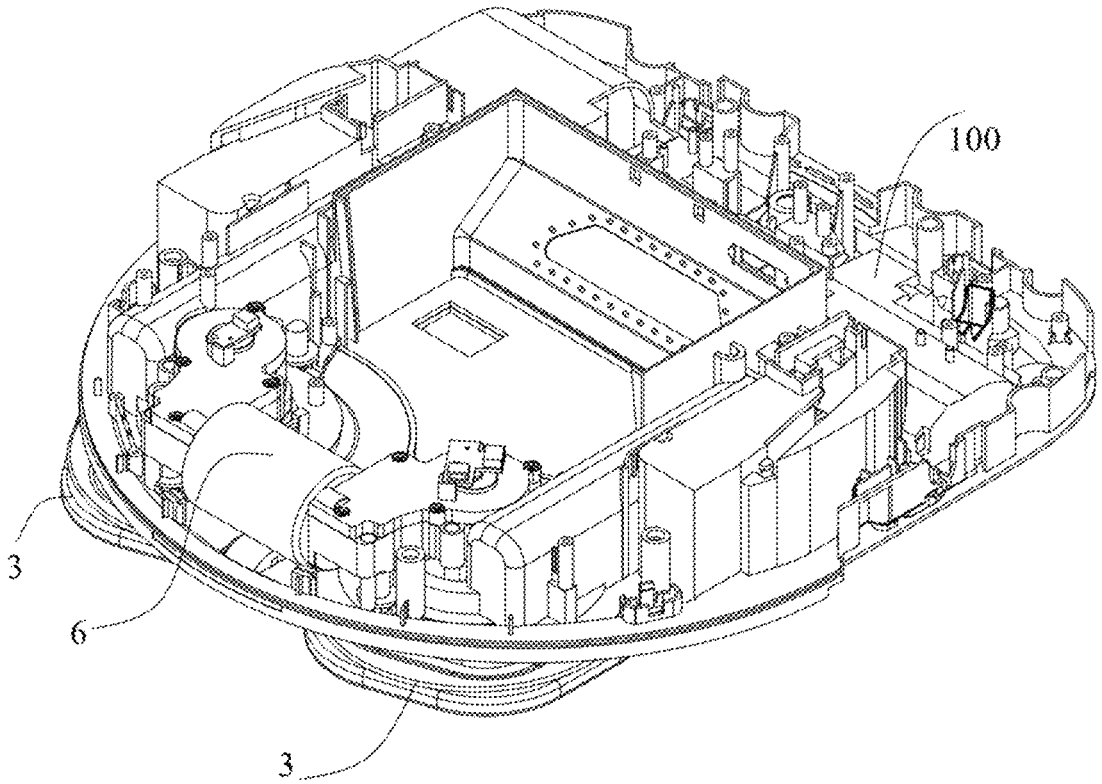
FIG. 48 is a perspective view of a cleaning mechanism applied to a cleaning apparatus provided in one embodiment of the present application.
Figure 49:
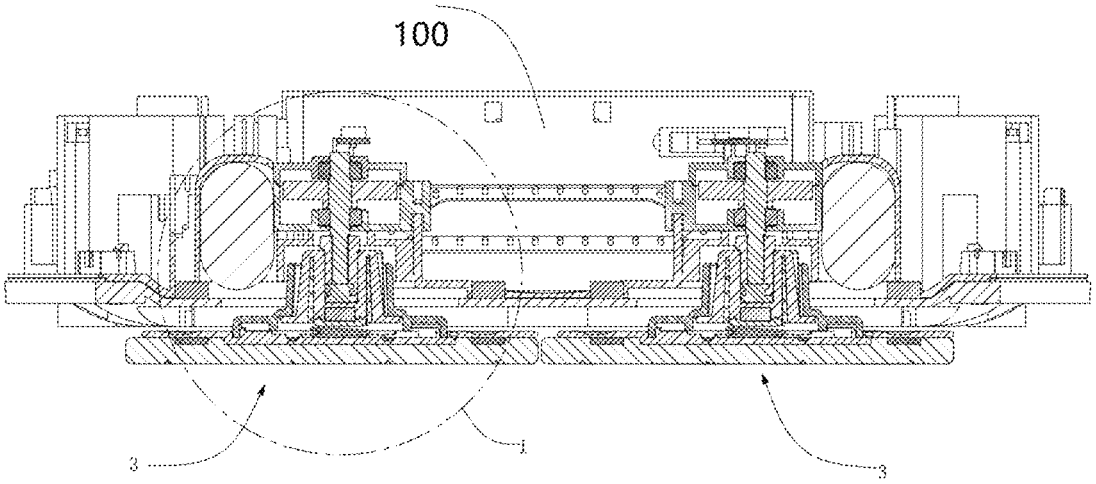
FIG. 49 is a cross-sectional view of the cleaning apparatus shown in FIG. 48.

Please refer to FIG. 48 and FIG. 49. In this specific implementation scenario, the cleaning apparatus is a cleaning robot, which may autonomously perform cleaning tasks on the floor in a work area. For convenience of explaining the purpose, reference is made to a case where the cleaning robot of the implementation scene performs cleaning on a horizontal ground, the above of the cleaning robot shown in FIG. 49 is defined as "up", the below is defined as "down", and the cleaning mechanism is disposed below the machine body 100. The above-mentioned direction definitions are for illustration objects only, and should not be construed as limitations of the present application. In this embodiment, a number of the cleaning mechanism is two, and the two cleaning mechanisms are disposed side by side. Of course, the number of cleaning mechanism may also be one or three or more.

The electromagnetic assembly 5 is suitable to be disposed on the machine body 100 of the cleaning apparatus, and the electromagnetic assembly 5 may generate an electromagnetic field when connected with a power supply, Specifically, the electromagnetic assembly 5 includes an electromagnet and a conductive coil wound on the electromagnet, and the conductive coil is connected with the power supply of the cleaning apparatus, and when the conductive coil is connected with the power supply, an electromagnetic field is generated around the electromagnet, so that the magnetically attractive material may be adsorbed. More specifically, the electromagnetic assembly 5 is connected with the power supply of the cleaning apparatus, and the power is provided in the self-owned power supply of the cleaning apparatus.

The cleaning head assembly 3 is used for mopping the floor, and includes a dishcloth tray and a connecting structure for floatably connecting the dishcloth tray with the machine body 100 of the cleaning apparatus up and down. In the specific implementation scenario, the dishcloth tray is connected with the dishcloth, and the dishcloth is used for mopping the floor, through the connection structure, the dishcloth tray and the dishcloth may move together in an up-and-down direction, so that the dishcloth and the dishcloth tray may be located in an elevating position higher than the floor or a mopping position contacting the floor. Specifically, the connecting structure includes a biasing member 35 for pushing against the dishcloth tray downward, so that it has a tendency to move to the mopping position.

The cleaning head assembly 3 further includes a magnetic attraction part 33, the magnetic attraction part 33 is disposed on the dishcloth tray and disposed oppositely to the electromagnetic assembly 5. Under the action of electromagnetic field, the magnetic attraction part 33 is attracted by a magnetic force, which will drive the dishcloth tray to move upward against the action force of the biasing member 35 to an elevating position higher than the cleaning surface. When the electromagnetic assembly 5 is disconnected from the power supply, the electromagnetic field disappears, and an upward suction force acting on the magnetic attraction part 33 disappears, under the pushing against action of the biasing member 35, the dishcloth tray will return to the mopping position.

In this embodiment, the magnetic attraction part 33 may be specifically understood as a part that may be attracted or repelled by the magnetic force of the electromagnetic field. Specifically, it may be a ferromagnet, the ferromagnet mainly includes three kinds: iron, cobalt and nickel. In this embodiment, the magnetic attraction part 33 is an iron part. The magnetic attraction part 33 itself may be non-magnetic, or may be magnetic, and is not limited here.

Specifically, the dishcloth tray includes an upper dishcloth tray 31 and a lower dishcloth tray 32, and the magnetic attraction part 33 is disposed between the upper dishcloth tray 31 and the lower dishcloth tray 32. The upper dishcloth tray 31 and the lower dishcloth tray 32 are coaxially disposed. The lower dishcloth tray 32 is used to install a dishcloth.

Based on the above technical solution, the cleaning mechanism controls the generation and extinction of the electromagnetic field by turning on and off the electromagnetic assembly 5, so as to generate magnetic attraction to the magnetic attraction part 33 to realize the elevating of the dishcloth tray. When the electromagnetic assembly 5 is powered off, the electromagnetic field disappears, and the dishcloth tray is pushed downward to the mopping position by the biasing member 35, so as to realize the lifting control of the dishcloth tray. The electromagnetic assembly is adopted to control the elevating of the dishcloth tray by electromagnetic attraction, so that the dishcloth tray may ascend or descend according to the actual demand, and the control is more flexible.

The lifting control of the dishcloth tray can effectively avoid a problem of secondary pollution caused by a second mopping of the surface that has been mopped by the dishcloth, and the floor cleaning effect is better. When encountering a floor that is not conducive to mop, such as the floor covered with carpet, the lifting of the dishcloth may avoid the contact between the dishcloth and such floor and avoid the adverse impact of such floor on cleaning work. In addition, the cleaning apparatus may be elevated to move to a specific position after the dishcloth is stained with dirt to perform the operation of replacing the dishcloth or cleaning the dishcloth.

In order to improve the efficiency of elevating the dishcloth tray by the magnetic force, the balance of elevating the dishcloth tray is ensured. In an embodiment, the electromagnetic assembly 5 is roughly uniformly arranged around a central axis of the dishcloth tray, and the magnetic attraction part 33 is uniformly distributed right below the electromagnetic assembly 5. The electromagnetic assembly 5 is uniformly arranged around the central axis of the dishcloth tray, which ensures that the electromagnetic assembly may produce uniform electromagnetic field in a central circumferential direction of the dishcloth tray. The magnetic attraction parts are located right below and arranged uniformly, which ensures that the magnetic force action direction is in the up-and-down direction, and the magnetic force action force is uniformly distributed around the center of the dishcloth tray, which ensures the stress balance of the dishcloth tray and reduces the a skew and even jamming in elevating of the dishcloth tray caused by unbalanced stress.

More specifically, the electromagnetic assembly 5 is constructed in a ring shape, and the magnetic attraction part 33 is an annular iron ring which is consistent with the shape of the electromagnetic assembly 5 and coaxially disposed. The electromagnetic assembly 5 and the magnetic attraction part 33 may be annular, elliptical, square, or other annular shapes with the same shape, only the annular shapes of the electromagnetic assembly 5 and the magnetic attraction part 33 should be consistent, and the projections on the cleaning surface generally overlap with each other. In this way, when the electromagnetic field is generated, the circumferential stress of the dishcloth tray is uniform, and the stability of magnetic lifting is further guaranteed. It may be understood that the annular shape of the electromagnetic assembly 5 may also be constructed in an unclosed state, and the annular shape of the magnetic attraction part 33 may also be unclosed, as long as the unclosed gap is small enough to not affect the stable lifting.

The cleaning mechanism further includes a control unit, the control unit includes a switch circuit for cutting off and connecting the electromagnetic assembly 5 and the power supply to control the generation and extinction of the electromagnetic field. Specifically, the switch circuit of the control unit is electrically connected with the conductive coil of the electromagnetic assembly 5, and the switch circuit is turned on and off, so that the on-off of the current of the conductive coil may be controlled, thereby controlling the generation and extinction of the electromagnetic field. The control unit may automatically identify whether it is necessary to elevate the dishcloth tray and control it automatically, thereby improving the flexibility of the lifting control of the dishcloth tray.

In a specific embodiment, the control unit further includes a reverse circuit for switching a direction of the current of the electromagnetic assembly 5, so as to change a direction of the electromagnetic field and then generate a magnetic field force that pushes against the magnetic attraction part 33, the magnetic attraction part 33 is a permanent magnet and has magnetic polarity itself. In this way, the control unit may control the current in the electromagnetic assembly 5 to reverse, so that the magnetic force of the electromagnetic field pushes against the dishcloth tray 33, which may help the dishcloth tray to return to the mopping position close to the floor on the one hand, and increase the pressure between the dishcloth tray and the floor on the other hand to improve the mopping effect.

Figure 50:
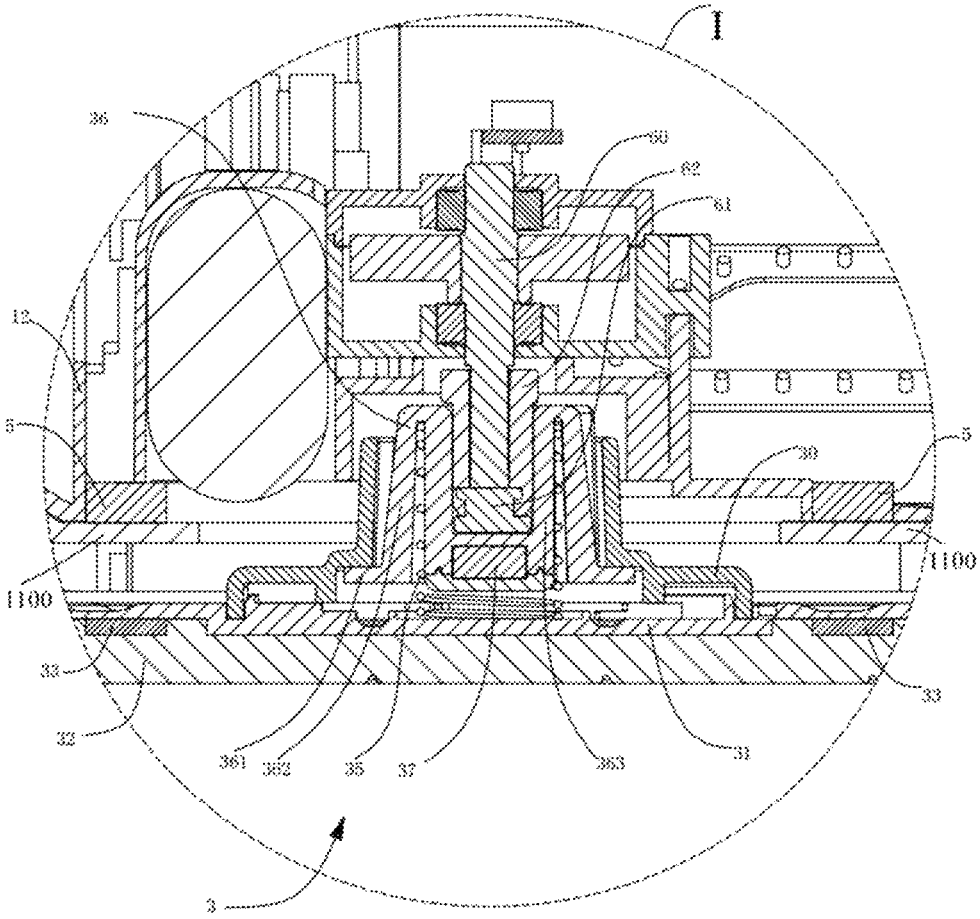
FIG. 50 is a partially enlarged diagram of portion I of the cross-sectional view of the cleaning apparatus shown in FIG. 49.
Figure 51:
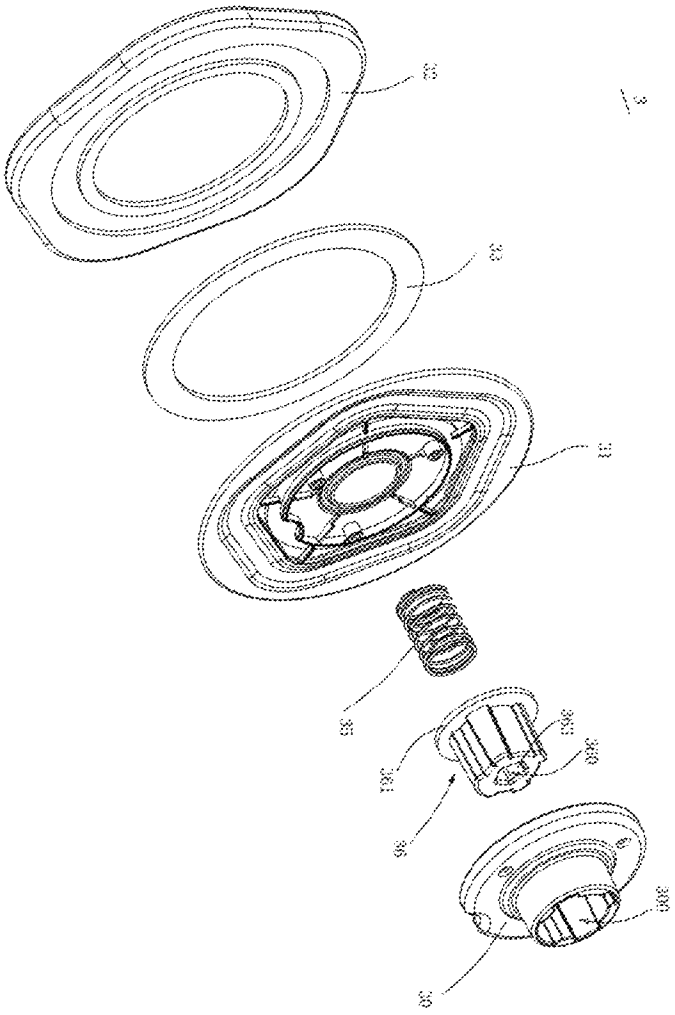
FIG. 51 is a perspective exploded view of a dishcloth tray assembly of a cleaning mechanism provided in an embodiment of the present application.

In a specific embodiment, please refer to FIG. 50 and FIG. 51. The connecting structure includes a connecting member 36 and a fixing seat 30 floatingly sleeved outside the connecting member 36. The fixing seat 30 has a sleeve hole 300 which is axially penetrated, and the connecting member 36 passes and is provided in the sleeve hole 300. The dishcloth tray is connected with the fixing seat 30, and is located below the fixing seat 30, and the fixing seat 30 may slide axially relative to the connecting member 36, thereby drive the dishcloth tray to slide in axially. An upper end of the biasing member 35 abuts against the connecting member 36, and a lower end of the biasing member 35 abuts against the dishcloth tray, so as to apply an elastic force far away from the connecting member 36 to the dishcloth tray and make it move to the mopping position.

Specifically, guide structures mated with each other are disposed on an outer side surface of the connecting member 60 and an inner wall surface of the fixing seat 30, and is used to limit the sliding of the fixing seat 30 along an axial direction of the connecting member 60. The guide structures may be a guide rib disposed on the outer side surface of the connecting member 60 and a guide groove mated with the guide rib disposed on the inner wall surface of the fixing seat 30. Of course, the guide rib may also be disposed on the inner wall surface of the fixing seat 30, and the guide groove may be disposed on the outer side surface of the connecting member 60, as long as the guiding purpose may be achieved. The guide rib may also be called a guide rail, and the guide groove may also be called a guiding groove.

More specifically, the connecting member 36 further includes a flange 361, and the fixing seat 30 has a step mated with the flange 361, and the fixing seat 30 is supported on the flange 361 of the connecting member 36, so that the fixing seat 30 does not slip out of the connecting member 36 and fall off, and the connecting member 36 cannot be detached from the fixing seat 30.

In a specific embodiment, the cleaning apparatus includes a driving device 6, the driving device 6 includes a driving shaft 60 driven by power to rotate, and the connecting member 36 includes an installation shaft hole 360 for plugging the driving shaft 60 of the cleaning apparatus, in a case where the dishcloth tray assembly 3 is installed on the machine body 100, the connecting member 36 is driven by the driving shaft 60 to rotate to drive the dishcloth tray to rotate.

The connecting member 36 includes an annular cavity with an opening at a lower end, and the biasing member 35 is disposed within the annular cavity. Specifically, the connecting member 36 includes an outer sidewall 362 and a shaft hole wall 363, the shaft hole wall 363 is located within the outer sidewall 362, and is formed to be a sidewall for installing the shaft hole 360, and an annular cavity is formed between the outer sidewall 362 and the shaft hole wall 363. The biasing member 35 is a spring, which is sleeved outside the shaft hole wall 363, and its elastic deformation direction is limited by the shaft hole wall 363, thereby ensuring the stability of pushing against the dishcloth tray.

In order to improve the convenience of detaching the dishcloth tray assembly 3. In an embodiment, a permanent magnet 37 is fixedly disposed on the connecting member 36, and an iron block 61 is fixedly disposed below the driving shaft 60, the permanent magnet 37 is installed at a bottom of the shaft hole 360, and face the iron block 61. The dishcloth tray assembly 3 is assembled by the magnetic attraction of the iron block 61 and the permanent magnet 37, and only the installation shaft hole 360 of the connecting member 36 needs to be sleeved on the driving shaft 60, so the detachment and installation process requires no tool and is very convenient.

The present application also provides an embodiment, a structure of this embodiment is substantially the same as that of the previous embodiment, and the only difference lies in the disposition of the electromagnetic assemblies and the magnetic attraction parts. The same structure adopts the same name and reference numerals, and will not be repeated here. Only the differences will be described below.

In this embodiment, the number of electromagnetic assemblies is multiple, and the plurality of electromagnetic assemblies are arranged approximately uniformly around a central axis of the dishcloth tray. Each electromagnetic assembly is connected with a power supply, and the power-on and power-off of the electromagnetic assembly is controlled by the control unit. The power-on and power-off of the plurality of electromagnetic assemblies may be controlled independently, and may also be controlled simultaneously. In order to ensure the uniform distribution of the electromagnetic field, and the specifications of each electromagnetic assembly are the same.

Further, the number of the magnetic attraction parts is the same as that of the electromagnetic assemblys, and the magnetic attraction parts are disposed in one-to-one correspondence with the electromagnetic assemblies in the up-and-down direction. Each magnetic attraction part is located right below the corresponding electromagnetic assembly.

The present application also provides a cleaning device, which including a machine body 100 and the cleaning mechanism provided in any of the above embodiments.

In this embodiment, the cleaning apparatus may be a cleaning robot, such as a mopping robot, or a traditional mopping machine, such as a hand-held mopping machine, a hand-pushed mopping machine, or of course a riding mopping machine, and it is not limited here:

Please refer to FIG. 48 and FIG. 49, the cleaning apparatus further includes a driving device 6 disposed on the machine body, and the driving device is used for driving the dishcloth tray assembly 3 of the cleaning mechanism to rotate. Specifically, the driving device includes a driving shaft 6, and the dishcloth tray assembly 3 is mounted on the driving shaft 6 through a connecting member 36.

The machine body 100 includes a lower housing 1100 and a lower housing bracket 1200, and the lower housing 1100 is fixed below the lower housing bracket 1200. The electromagnetic assembly 5 is disposed on the lower housing 1100 and supported by the lower housing 1100. The driving device 6 is disposed on the lower housing bracket 1200 and fixedly supported by the lower housing bracket 1200.

The driving device 6 further includes a shaft sleeve 62, and the iron block 61 is fixed at the lower end of the driving shaft 60 through the shaft sleeve 62. The shaft sleeve 62 is in clearance fit with the installation shaft hole 360 of the connecting member 36. The dishcloth tray assembly 3 is attracted to the iron block 61 through the permanent magnet 37, and has a characteristic of being convenient to assemble and detach. For details, please refer to the description to content related to the first embodiment.

Each embodiment in this specification is described in a progressive way, and the same and similar parts between the embodiments may be referred to each other, and each embodiment focuses on differences from other embodiments.

What is claimed is:

1. A cleaning device, comprising:

a driving module, which comprises a lifting driver;

a lifting module, which comprises a first shaft sleeve and a second shaft sleeve, the first shaft sleeve is connected with a power output shaft of the lifting driver, and the first shaft sleeve and the second shaft sleeve form a screw mechanism; and the second shaft sleeve is suitable for being connected with a cleaning member of a cleaning module;

the screw mechanism is at least subjected to a first driving force of the power output shaft of the lifting driver, so as to drive the cleaning member to perform a descending motion relative to the lifting driver, and is subjected to a second driving force so as to drive the cleaning member to perform an ascending motion relative to the lifting driver; and the driving module further comprises a housing, and the housing is sleeved outside the second shaft sleeve; and the lifting module further comprises a damping member, and the damping member is disposed between the second shaft sleeve and the housing to hinder the second shaft sleeve from reaching the same rotation speed as the first shaft sleeve and prolong time for the second shaft sleeve reaching the same rotation speed as the first shaft sleeve.

2. The cleaning device according to claim 1, wherein the screw mechanism comprises a thread groove and a rib which are mated with each other; and the first shaft sleeve comprises the thread groove, and the second shaft sleeve comprises the rib; or, the second shaft sleeve comprises the thread groove comprises the thread groove, and the first shaft sleeve comprises the rib; and wherein lead angles of the thread groove and the rib are smaller than a self-locking lead angle.

3. The cleaning device according to claim 2, wherein the second shaft sleeve comprises the thread groove, and the first shaft sleeve comprises the rib; and the lifting module further comprises a shaft sleeve cover, the shaft sleeve cover is located at a top of the second shaft sleeve, a bottom end of the shaft sleeve cover is provided with a protruding first limit portion, and the first limit portion is located at an end of the thread groove.

4. The cleaning device according to claim 1, wherein the lifting module further comprises a floating assembly; the floating assembly comprises a floating shaft sleeve and a floating element, the floating element is at least one of a spring, a torsion spring, a shrapnel, an elastic ball, a pneumatic support and a hydraulic support;

the floating shaft sleeve is connected with the first shaft sleeve, and the floating shaft sleeve is connected with the power output shaft; or, the floating shaft sleeve is connected with the second shaft sleeve, and the floating shaft sleeve is connected with the cleaning member.

5. The cleaning device according to claim 4, wherein one end of the floating shaft sleeve is fixedly connected with the power output shaft, and the other end of the floating shaft sleeve is connected with the first shaft sleeve;

the first shaft sleeve comprises a first embedded groove, and the floating shaft sleeve is disposed within the first embedded groove; the floating shaft sleeve comprises at least one first limit protrusion, a sidewall of the first embedded groove comprises at least one first limit groove, and the first limit protrusion is mated with the first limit groove; and a first floating cavity is formed between the floating shaft sleeve and the first shaft sleeve, and the floating element is located in the first floating cavity.

6. The cleaning device according to claim 5, wherein the second shaft sleeve is fixedly connected with the cleaning member, or the second shaft sleeve is integrally formed with the cleaning member;

wherein an elastic element is arranged between the first shaft sleeve and the second shaft sleeve, and the elastic element is at least one of a tension spring, an elastic rope, a torsion spring and a shrapnel; and the elastic element provides the second driving force.

7. The cleaning device according to claim 4, wherein one end of the floating shaft sleeve is fixedly connected with the second shaft sleeve, and the other end of the floating shaft sleeve is connected with the cleaning member;

the cleaning member comprises a cleaning member fixing member, the floating shaft sleeve comprises a second embedded groove, and the cleaning member fixing member is disposed within the second embedded groove; and the cleaning member fixing member comprises at least one second limit protrusion, the floating shaft sleeve comprises at least one second limit groove, and the second limit protrusion is mated with the second limit groove; and a second floating cavity is formed between the floating shaft sleeve and the cleaning member fixing member, and the floating element is located within the second floating cavity.

8. The cleaning device according to claim 1, at least one give-way hole is disposed on the housing, at least one deformation portion is disposed within the give-way hole, and the deformation portion has at least one protrusion protruding inward, and the housing is kept in interference abutment with an outer wall surface of the second shaft sleeve through the protrusion; and the protrusion is used as the damping member.

9. The cleaning device according to claim 8, wherein the deformation portion is in a wave type.

10. The cleaning device according to claim 1, further comprising a sensor and a controller, the controller is electrically or wirelessly connected with the lifting driver and the sensor, respectively.

11. The cleaning device according to claim 10, wherein the driving module further comprises a housing, and the housing is sleeved outside an outer wall of the second shaft sleeve;

the sensor comprises a light emitter and a light receiver which are oppositely disposed on the housing, and an optical path area is formed between the light emitter and the light receiver; and when the second shaft sleeve is driven by the lifting driver to reach a highest point of an ascending position, at least part of the second shaft sleeve is located in the optical path area to block light emitted by the light emitter.

12. The cleaning device according to claim 10, wherein the driving module further comprises a housing, and the housing is sleeved outside an outer wall of the second shaft sleeve;

the sensor comprises a light emitter and a light receiver which are oppositely disposed on the housing, and an optical path area is formed between the light emitter and the light receiver;

a light blocking member, liftably disposed on the housing;

a biasing member, disposed on the housing, and applies a biasing force to the light blocking member to drive one end of the light blocking member to be located right below the optical path area; and when the second shaft sleeve is driven by the lifting driver to reach a highest point of an ascending position, a top of the second shaft sleeve pushes one end of the light blocking member to perform an ascending motion to extend into the optical path area to block light emitted by the light emitter.

13. The cleaning device according to claim 4, wherein one end of the floating shaft sleeve is magnetically connected with the second shaft sleeve through a magnetic assembly, and the other end of the floating shaft sleeve is connected with a cleaning member fixing member for installing the cleaning member, a second floating cavity is formed between the floating shaft sleeve and the cleaning member fixing member, and the floating element is located within the second floating cavity.

14. The cleaning device according to claim 13, wherein the magnetic assembly comprises a second magnet and a third magnet disposed on the floating shaft sleeve and the second shaft sleeve, respectively, and polarities of ends of the second magnet and the third magnet facing each other are opposite; and the cleaning device further comprises a hall sensor for detecting whether the floating shaft sleeve and the second shaft sleeve are installed in place.

15. The cleaning device according to claim 14, wherein the second shaft sleeve is provided with a first groove area on a side facing the cleaning member fixing member, and an annular second groove area on a side facing away from the cleaning member fixing member; the thread groove or the rib is disposed in the second groove area, a top of the first shaft sleeve is connected with the power output shaft, and a bottom of the first shaft sleeve is embedded in the second groove area; and the third magnet is disposed on a groove bottom of the first groove area; at least one end of the second magnet extends into the first groove area and is magnetically fixed with the third magnet.

16. The cleaning device according to claim 14, wherein the hall sensor is disposed on a top of the power output shaft, the power output shaft is made of a magnetic conductive material, and an end of the power output shaft is distributed close to the third magnet; or the hall sensor is disposed on the top of the power output shaft, and the power output shaft is made of the magnetic conductive material, and is used as the third magnet, and the end of the power output shaft is distributed close to the second magnet.

17. The cleaning device according to claim 15, wherein there are at least two second magnets, and correspondingly, there are at least two third magnets; and wherein a bottom edge of the floating shaft sleeve is provided with an outer edge protruding outward, and the outer edge is distributed oppositely with a bottom of the second groove area; and at least one third magnet is disposed on the bottom of the second groove area, at least one second magnet is disposed on the outer edge, and the second magnet is magnetically connected with the third magnet.

18. The cleaning device according to claim 4, wherein the floating shaft sleeve is connected with the first shaft sleeve, and the floating shaft sleeve is connected with the power output shaft through a magnetic attraction assembly.

19. The cleaning device according to claim 18, wherein the magnetic attraction assembly comprises a first magnet and a fourth magnet, the first magnet is disposed on the floating shaft sleeve, and the fourth magnet is disposed on the power output shaft; and polarities of ends of the first magnet and the fourth magnet facing each other are opposite; and the cleaning device further comprises a hall sensor for detecting whether the floating shaft sleeve and the power output shaft are installed in place.

20. A cleaning apparatus, comprising: a chassis; and the cleaning device according to claim 1, wherein the cleaning device is installed on the chassis.

* * * * *